US011721890B2

(12) United States Patent
Lilja

(10) Patent No.: US 11,721,890 B2
(45) Date of Patent: Aug. 8, 2023

(54) BUILDING MATERIAL

(71) Applicant: StealthCase Oy, Tampere (FI)

(72) Inventor: Juha Lilja, Tampere (FI)

(73) Assignee: StealthCase Oy, Tampere (FI)

( * ) Notice: Subject to any disclaimer, the term of this patent is extended or adjusted under 35 U.S.C. 154(b) by 241 days.

(21) Appl. No.: 17/102,516

(22) Filed: Nov. 24, 2020

(65) Prior Publication Data

US 2021/0083375 A1 Mar. 18, 2021

Related U.S. Application Data

(63) Continuation of application No. 16/753,525, filed as application No. PCT/FI2018/050719 on Oct. 8, 2018, now Pat. No. 10,879,603.

(30) Foreign Application Priority Data

Oct. 10, 2017 (FI) ..... U20174233
Oct. 27, 2017 (FI) ..... U20174243
(Continued)

(51) Int. Cl.
*H01Q 1/44* (2006.01)
*H01Q 1/12* (2006.01)
(Continued)

(52) U.S. Cl.
CPC ..... *H01Q 1/44* (2013.01); *H01Q 1/1271* (2013.01); *H01Q 1/22* (2013.01); *H01Q 13/103* (2013.01);
(Continued)

(58) Field of Classification Search
None
See application file for complete search history.

(56) References Cited

U.S. PATENT DOCUMENTS 11,012,140 B2 * 5/2021 Mansikkamäki .. H04B 7/15514
2004/0113860 A1 6/2004 Walton
(Continued)

FOREIGN PATENT DOCUMENTS

EP 3183774 B1 7/2020
WO 2016027007 A1 2/2016
WO WO-2016027007 A1 * 2/2016 ..... E04B 1/02

OTHER PUBLICATIONS

Alfakhri et al. ("Design and analysis of compact size dual polarised ultra wideband MIMO antennas with simple decoupling structure", 2016 21st International Conference on Microwave, Radar and Wireless Communications (MIKON), May 2016). (Year: 2016).*
(Continued)

*Primary Examiner* — Ricardo I Magallanes
(74) *Attorney, Agent, or Firm* — Ziegler IP Law Group, LLC

(57) ABSTRACT

A wall or façade structure for improving quality of reception of a wireless communication device inside a building from a base station located outside of the building. The building has the structure as a part of a building envelope. The structure, which is configured to boost transmission of electromagnetic signals through the building envelope, includes at least one electrically conductive low emissivity surface, a first aperture and a second aperture. The apertures are isolated from each other for providing narrow aperture diffraction and to obtain diversity reception at a first frequency in shadow areas inside the building. A distance between the apertures is between 1 and 10 meters to provide an envelope correlation coefficient of less than 0.1 for said apertures at the first frequency.

20 Claims, 24 Drawing Sheets

(30) Foreign Application Priority Data

Nov. 22, 2017 (FI) ..... 20176043
Jan. 11, 2018 (FI) ..... 20185031

(51) Int. Cl.
*H01Q 1/22* (2006.01)
*H01Q 13/10* (2006.01)
*H01Q 15/00* (2006.01)
*H01Q 21/08* (2006.01)
*E06B 3/67* (2006.01)

(52) U.S. Cl.
CPC ..... *H01Q 15/002* (2013.01); *H01Q 21/08* (2013.01); *E06B 3/6715* (2013.01)

(56) References Cited

U.S. PATENT DOCUMENTS

2004/0206527 A1 10/2004 Yokota
2012/0098628 A1* 4/2012 Batchelor ..... H01Q 15/0066 333/24 C
2012/0305775 A1* 12/2012 Krolak ..... G01N 21/3559 250/353

OTHER PUBLICATIONS

European Patent Office, Supplementary European Search Report, Application No. 18865681.3, dated Mar. 31, 2021, 15 pages.
Fantucci et al, "Low-E paints enhanced building components: Performance, limits and research perspectives", Energy Procedia, Elsevier, NL, vol. 126, pp. 274-281, XP085181202, ISSN: 1876-6102, DOI: 10.1016/J.EGYPRO, Sep. 22, 2017, 8 pages.

* cited by examiner

BUILDING MATERIAL

FIELD

The aspects of the disclosed embodiments relate to a building material comprising at least an electrically conductive low emissivity surface provided with an aperture for transmitting radio signals, for boosting the transmission of electromagnetic signals. The aspects of the disclosed embodiments also relate to a method for manufacturing an insulating glass element/unit, and a method for transmitting radio signals from one side to the other side of an insulating glass element/unit.

BACKGROUND

Aims of the construction industry to build passive and zero energy buildings have led to a situation in which efficient thermal insulation strongly suppresses signals of mobile phones and other wireless systems so that it may be even impossible to use a mobile phone inside a building. There are many reasons for the suppression, but one has been found to be the use of so-called selective glass panes, that is, windows laminated with conductive coatings, i.e. so-called low emissivity coatings.

Communication between wireless communication devices, such as mobile phones, tablet computers, or various sensors classified under the Internet of Things (IOT), is based on the control of properties of electromagnetic energy, that is, propagating electromagnetic waves, as well as the capability of receiving and reading the information connected to these. Controlled attachment of information to an electromagnetic wave is called modulation, whereas the controlled detachment of this information from the electromagnetic wave is called demodulation. An electromagnetic signal may refer to a single discrete sinusoidally oscillating frequency component which is part of an electromagnetic spectrum. Alternatively, in some contexts, an electromagnetic signal may also refer to a range comprising a specific part of an electromagnetic spectrum which comprises a combination of discrete frequency components whose electromagnetic energy, when propagating, conveys, as a whole, a piece of information to be transmitted.

A majority of the frequency ranges of the electromagnetic spectrum currently in use for mobile phones is classified under the UHF frequency range (300 MHz to 3 GHz), and increasingly also under SHF frequencies (3 to 30 GHz). Frequency allocations for new short-range mobile communication devices are envisaged for the EHF range (30 to 300 GHz) as well.

A wireless communication connection may be either one-way (simplex) or two-way (duplex). Communication of conventional mobile devices with base stations is two-way, whereas for example the communication of wireless sensors may be one-way. Conditions for such wireless communication are fulfilled when the sensitivity level of the wireless receiving device is sufficiently low with respect to the power level of the signal received. A substantial factor on the sensitivity level of the receiving device is the noise level caused by the electronic circuits in the device itself; signals having power levels lower than the noise level are difficult to receive without losing part of the information carried by the signal. Also, accumulation of electromagnetic interference from the environment of the receiver may impair the quality of the communication and cause problems in the communication.

The power level of the signal to be received can be influenced, for example, by controlling the transmit power of the transmitting device and, in the case of mobile networks, by designing the communication network of base stations to be sufficiently dense. However, attenuation caused by buildings has turned out to be a significant drawback for such communication and poses a particularly challenging problem, because it significantly impairs the performance of wireless communication through the walls of buildings. Attenuation values measured in typical low energy buildings may range, for example, from 20 to 50 dB. For comparison, it may be mentioned that each power boost by six decibels (6 dB) in the transmit power doubles, in average, the distance between links in a free space. Conversely, it may be stated that each further attenuation by six decibels, in average, halves the maximum theoretical link distance. Therefore, attenuation caused by buildings is a significant drawback when designing the working distances of wireless links, and it cannot be compensated for merely by increasing the transmit power, for practical reasons. Furthermore, at least one of the devices in the link, for example a mobile phone, is usually a battery-operated device whose transmit power is always aimed to be minimized in order to maximize the battery charge level.

Normally, signals of wireless system can propagate into buildings through windows, but these signal paths are obstructed by conductive low emissivity coatings. In the past, electromagnetic signals have been capable of penetrating through walls of buildings in addition to windows, but aluminium coated thermal insulation boards, which are commonly used in walls today, efficiently prevent the propagation of signals into buildings. Electromagnetic signals may also be attenuated by reinforcements together with high-loss cement in concrete structures, whereby when passing through such a structure, the signal strength may be reduced too much to be sufficient for the use of e.g. a mobile phone on the other side of the structure.

Attempts have been made to solve this problem by means of, for example, a passive antenna system that comprises two separate antennas and a transfer line connecting these two antennas. However, the passive antenna repeater involves the challenge that in order to operate even at an adequate level, it has to be oriented precisely towards the base station of the operator.

Other solutions are known as well, such as frequency selective surfaces (FSS), in which recurring lattice arrangements are formed on the selective surface on a large glass area, for reducing attenuation in the transmittance of the glass. Frequency selective surfaces provided on glass surfaces are planar, two-dimensional filters which may be configured as band-reject, band-pass, high-pass, or low-pass filters. Frequency selective surfaces are also well known in the context of selective glasses. For example in U.S. Pat. No. 5,364,685 A (Central Glass Company), recurrent discontinuous segments, such as slits extending across the whole glass surface, or grid-like FSS filters, are formed in laminated selective glass to improve the transmittance of an electromagnetic signal. U.S. Pat. No. 6,730,389 B2 also discloses FSS filters formed on the surface of a selective film, for solving the same problem. Topologies typically used in elements of an FSS filter also include certain loops, as in U.S. Pat. No. 8,633,866 B2.

Also the U.S. Pat. No. 6,356,236 B1 discloses a frequency selective surface which comprises a cross-wise area and in which the low-emissivity surface is laminated between two glasses.

A primary problem with frequency selective surfaces formed on glass surfaces is the large processing area required by them. The coating may be removed, for example, by laser, by etching, or by mechanical machining. The device removing the coating has to be capable of processing the selective surface both in the width direction and the longitudinal direction of the glass sheet. In continuous mass production, this is technically difficult to implement with the precision and at the speed required by the process. Moreover, a frequency selective surface comprising a large processing area easily becomes a quality defect in window glass, discernible to the eye.

Frequency selective surfaces formed on glass surfaces also involve another technical problem which is due to the low electrical conductivity of the selective surface. Very low attenuations in the transmission of electromagnetic signals may be achieved in frequency selective surfaces provided on typical metals, such as aluminium or copper. However, the frequency selective surface provided on the selective surface of the glass has considerably higher resistive losses, which is manifested as a reduction in the efficiency of the transmitting performance of the surface. Surface resistances of low emissivity surfaces used on glass surfaces may be, for example, between 10 and 100 Ω/sq, although they may also be slightly lower in some cases and also much higher in other cases. The large range in the surface resistance is due to the large variation in the uses of the coatings. Some of the low emissivity coatings are used in a gas-insulated space of a thermal glass element, whereas some are used in the outermost layers of thermal glass panes, or are laminated between two glass panes. In general, the gas-insulated space is provided with a so-called soft film, whereas a so-called hard film is used in the outermost glass surfaces, for eliminating the load on the window caused by outdoor air and cleaning, among other things. Coatings of the outermost glass surfaces may be used to affect, among other things, the transmission of luminosity, the filtering of solar energy, or the frosting of the glass.

The frequency selective coatings formed on glass surfaces also involve a third technical problem which is due to the effect of increasing the size of the transmitting aperture on the accumulation of the penetrating waves. In practice, this is manifested in that the reflective pattern which is formed by the surface and which may also be described, in terms of antenna technology, as a directivity pattern, is normally determined in a narrow beam in a single maximum direction, wherein the orientation of the maximum direction is determined by the direction of the incoming electromagnetic wave. The transmitting properties of the frequency selective surface are typically impaired when an electromagnetic signal illuminating the surface comes from a direction different from the primary maximum direction. In other words, if the transmitting properties of the surface are optimized, for example, for an electromagnetic signal coming from the direction of the normal of the glass surface, due to the symmetry, the directional pattern of the electromagnetic wave penetrating through it is focused on a relatively narrow beam indoors, in the direction of the normal of the glass surface. This is not a favourable feature for improving the indoor coverage of a mobile communication network because the positions of base stations and the position of the wireless device are both unknown and unpredictable. In practice, penetration may only be efficient in single cases in which both the position of the base station outdoors and the position of the wireless device indoors within the building have carefully selected orientations.

A technical problem is involved in the interdependence between the surface areas of apertures in a low emissivity surface and the thermal insulation capacity of a building material. For example, Finnish utility model application U20144180—StealthCase Oy, discloses that one or more electrically conductive surfaces of a glass pane can be provided with electrically non-conductive points (openings); in other words, points intended to be provided with slot radiators are left uncoated, wherein the slot radiators are referred to as substantially non-conductive discontinuities in an electrically conductive surface, and advantageously having an elongated shape. A broadband slot radiator can be implemented, for example, with a wide aperture whose impedance manifested at resonance can be adjusted to the wave impedance of an electromagnetic wave propagating in the air, but the area of the wide aperture constitutes an area which leaks thermal energy if implemented in a low emissivity surface. In addition to the reflection of a wave caused by the impedance of a single narrow aperture, the performance of the single narrow aperture is also reduced by the behaviour of the currents around the aperture. With a narrow aperture, the actual current forming the current mode generating the electromagnetic radiation remains relatively weak, whereas the current on both sides of the narrow aperture, flowing in opposite directions, becomes too strong. Two currents flowing close to each other in opposite directions and having an almost equal strength offset the radiation caused by each other. A solution increasing thermal dissipation would be to make the aperture wider, whereby the behaviour of the currents becomes more favourable for radiation. The solution according to an advantageous embodiment of the present disclosure offsets said opposite currents which reduce the radiation, whereby narrow openings can be turned into more efficient radiators.

A planar frequency selective surface formed on the selective surface of a glass pane has properties which are, with respect to the technical functions, similar to those of a large aperture without a selective film. In practice, this means that the diffraction of an electromagnetic wave from said aperture behaves in both cases like a wide aperture, wherein the width of the aperture is equal to several wavelengths. The diffraction pattern caused by a wide aperture differs significantly from the diffraction pattern of a narrow aperture.

Minimization of suppression of a wireless communication signal is often the primary way of improving the quality of the connection, or creating the conditions for the wireless connection in shadow regions in the first place. Modern wireless communication systems are also capable of improving the quality of the wireless connection by means of several parallel communication channels, whereby the parallel channels are created on propagation channels which do not correlate with each other physically. This approach has already become an almost necessary part of modern systems, as is used in e.g. the diversity technology of 3G and 4G networks, as well as in MIMO (Multiple Input-Multiple Output) and Massive MIMO technology of 4G and future 5G (IMT 2020) networks.

The MIMO technology is based on uncorrelated data streams created by several transmitter and receiver antennas. The technology can be used for improving connection problems due to multipath propagation (diversity gain), or for increasing the capacity and spectral efficiency of a wireless communication channel, whereby the maximum data transmission rate to be achieved in a given time is increased.

The wireless transmission path, as such, is an environment that changes continually in time and space and is very harmful for a wireless signal. However, multipath propagation may be utilized for boosting the communication. The utilization of the diversity and MIMO technologies is based on a rich scattering environment. Multipath components are always present, but in different environments, the scattering environments vary even to a great extent. A significant structural challenge impairing the scattering environment inside buildings is very limited incoming directions of signals. It is normally possible to receive significantly more multipath-propagated signal components immediately on the building envelope than inside the building, as the damping wall structures filter out almost all other signals than signals coming through open apertures.

One way of boosting the scattering environment inside the building is to guarantee the scattering of signals coming from the base station network outside the building, to the inside of the building from several locations and directions. The several directions refer to the use of a larger number of apertures in the wall structures of a single room, but also taking into account several directions of incidence outside the building envelope.

Another way of boosting the scattering environment within the building is to guarantee the scattering of several signals coming in uncorrelated polarizations, into the rooms of the building.

A rich scattering environment introduced in the interior of the building, based on an external base station network, is a particularly efficient way to improve the quality of reception indoors. Wireless communication devices based on diversity reception are capable of functioning at weaker signal strengths than wireless devices functioning without diversity reception, if uncorrelated signal streams are introduced into the interior of a building.

BRIEF SUMMARY

It is an aim of the present disclosure to provide a wall or façade structure for improving quality of reception of a wireless communication device inside a building from a base station located outside of the building. The building has the wall or façade structure as a part of a building envelope, wherein said wall or façade structure is configured to boost transmission of electromagnetic signals through the building envelope. The wall or façade structure comprises at least one electrically conductive low emissivity surface, wherein the wall or façade structure comprises a first aperture and a second aperture, wherein said first aperture and said second aperture are isolated from each other for providing narrow aperture diffraction and to obtain diversity reception at a first frequency in shadow areas inside the building, and a distance between said first aperture and said second aperture is between 1 and 10 meters to provide an envelope correlation coefficient of less than 0.1 for said apertures at the first frequency.

From the technology of conventional slot antennas supplied by a coaxial cable or a planar transmission line, such as a microstrip or a coplanar conductor, it is commonly known how the width of the slot affects the impedance of the slot antenna. According to Babinet's principle, an equivalence can be calculated for the impedance of a slot antenna in relation to the impedance of a dipole antenna. From dipole antennas, it is known how widening the metal conductor of the antenna widens the operational band of the antenna, when e.g. a conventional 50Ω transmission line is used as the supplying impedance. Correspondingly, the impedance behaviour of a slot antenna supplied by a transmission line can be made favourable towards this impedance when the width of the slot of the slot antenna can be increased.

A corresponding analogy can also be found in a resonating opening formed in an electrically conductive coating, wherein the electric field vector comprised by the non-conductive area of the opening constitutes a resonance circuit with the surface current oscillating in the conductive area defined by the edge curve of the aperture. The impedance of the aperture is determined by the ratio between the electric and magnetic fields comprised by the aperture. In a typical case, for example the wideband impedance of a rectangular resonating aperture is matched with the surge impedance of a free space by openings having a width of e.g. 20 to 40 mm, although this is strongly dependent on, among other things, the properties of the dielectric material loading the opening.

The purpose of the low emissivity surface is to reduce the quantity of thermal radiation passing through the envelope of the building. Implementing wide openings of the type of the preceding example on a low emissivity surface causes local degradation in the capacity to insulate thermal radiation.

The aim of an advantageous embodiment of the present disclosure is to solve the above described problem in such a way that the physical area of an opening formed in a low emissivity surface is substantially reduced in such a way that a behaviour favourable for the impedance matching of the opening is simultaneously achieved, whereby the impedance of the opening at the resonance frequency can be adjusted by modifying the behaviour of the electric field comprised by the opening, as well as the current loop encircling the same. The low emissivity surface may be provided with a virtual aperture comprised by a sinuous narrow linear opening, having a silhouette that defines a surface area which is substantially larger than the physical area of the opening.

Another advantageous effect of the winding edge curve of the narrow opening is the lengthening of the path of the resonating current loop. This means that the physical surface area required by the antenna is reduced in comparison with a corresponding opening tuned to the same frequency range and not utilizing the edge curve of the winding opening presented herein.

There is also provided an insulation glass unit for a wall or façade of a building envelope for improving quality of reception of a wireless communication device inside the building from a base station located outside of the building by boosting transmission of electromagnetic signals through the building envelope, the insulation glass unit comprising at least one electrically conductive low emissivity surface having at least a first aperture and a second aperture, wherein said first aperture and said second aperture are isolated from each other for providing narrow aperture diffraction and to obtain diversity reception at a first frequency in shadow areas inside the building, and a distance between said first aperture and said second aperture is between 1 and 10 meters to provide an envelope correlation coefficient of less than 0.1 for said apertures at the first frequency.

An insulation glass unit for a wall or façade of a building envelope for improving quality of reception of a wireless communication device inside the building from a base station located outside of the building by boosting transmission of electromagnetic signals through the building envelope comprises at least two glass panes and at least one of the two glass panes comprising at least one electrically conductive low emissivity surface having at least a first aperture and a second aperture, wherein said first aperture and said second aperture are isolated from each other for providing narrow aperture diffraction and to obtain diversity reception at a first frequency in shadow areas inside the building, and a distance between said first aperture and said second aperture is between 1 and 10 meters to provide an envelope correlation coefficient of less than 0.1 for said apertures at the first frequency.

The present disclosure boosts the transmission of an electromagnetic signal through an electrically conductive low emissivity surface based on narrow aperture diffraction, whereby a shadow region formed within a building can be provided with a larger coverage of an electromagnetic wave than by solutions based on wide aperture diffraction.

Some advantageous embodiments of the present disclosure compensate for a reduction in efficiency which is typically due to losses of a low emissivity surface with low electric conductivity, by providing sections of openings in the low emissivity surface close to each other so that the differential currents which reduce the radiation efficiency partly offset each other, whereby the proportion of current modes having a positive effect on the radiation efficiency around the slot radiator increases.

Furthermore, the present disclosure compensates for a reduction in efficiency which is typically due to losses of a low emissivity surface with low electrical conductivity, by increasing the efficiency of signal transmission by means of a coherent wave front formed by several focused slot radiators.

The present disclosure boosts the transmission of an electromagnetic signal through an electrically conductive low emissivity surface by providing the low emissivity surface with a virtual aperture formed by focused radiation sources and having an effective area for receiving electromagnetic energy larger than physical openings in the conductive surface formed in the low emissivity surface.

Furthermore, the present disclosure boosts the transmission of an electromagnetic signal through an electrically conductive low emissivity surface based on narrow aperture diffraction, whereby a shadow region, which is formed within a building when solutions of prior art are used, can be provided with a larger coverage of an electromagnetic wave than by solutions based on wide aperture diffraction.

The operation of the device according to the present disclosure is based on re-emission of electromagnetic energy received from an electromagnetic plane wave on a low emissivity surface, as a combination of several focused wave sources, wherein part of the electromagnetic wave received from the plane wave is redirected to the side of the low emissivity surface opposite to the incoming electromagnetic wave by utilizing constructive interference. Coherent transmission from several focused radiation sources amplifying each other compensates for a reduction in efficiency due to losses in the resistive conductive surface.

Furthermore, the operation of the device according to the present disclosure is based on the operation of slot radiators formed in the low emissivity surface as point-like focused radiation sources, whereby a coherent wave front formed by slot radiators placed preferably at intervals of less than the wavelength of the operation frequency is summed up in the shadow region formed by the insulating glass unit in the direction of interest. For an array of slot radiators implemented in connection with an insulating glass unit, the advantageous direction of interest is the horizontal plane in which the wave front formed by the array of slot radiators constitutes a flat directivity pattern. A directivity pattern having a maximum area in the horizontal plane both inside and outside the insulation glass efficiently receives incoming horizontal signals from a base station and provides a wide indoor coverage in the horizontal plane with respect to the insulating glass unit of a window installed in the wall.

A locally focused radiation source can be considered a point-like radiation source when the electromagnetic wave emitted by it is viewed in its far field. For example, a radiation source having the length of one wavelength, half the wavelength, or for example a quarter of the wavelength is seen as a point-like radiation source when the wave front emitted by it is seen from a sufficiently far distance, in other words, in the far field.

The aim of the disclosed embodiments is to boost the quality and the capacity of wireless communication used within buildings and based on an external network of base stations, by increasing the number of uncorrelated communication channels through the building envelope. The device according to the present disclosure improves the scattering environment present within a building by receiving two electromagnetic signals coming in cross polarizations from the building envelope, and by re-transmitting these two electromagnetic signals received in cross polarizations to the interior of the building.

The implementation of an advantageous embodiment of the present disclosure comprises two cross polarized apertures for transmitting radio signals, further comprising cross polarized focused radiation sources for re-emitting electromagnetic energy of an electromagnetic signal incident on the building material.

The implementation according to an advantageous embodiment of the present disclosure comprises two circularly polarized apertures which transmit a radio signal and in which the rotation directions of the polarizations are crosswise.

The implementation according to an advantageous embodiment of the present disclosure comprises a loading impedance and a control unit which are arranged in connection with a low emissivity surface and which may be used for controlling the radiation pattern formed by a building material. Said control of the radiation pattern may be used for improving, for example, wireless connections formed in base stations, for filtering spurious signals, or for optimizing the resourcing of a wireless network.

DESCRIPTION OF THE DRAWINGS

In the following, the present disclosure will be described in more detail with reference to the appended drawings, in which.

DETAILED DESCRIPTION

Figures 1A, 1B:
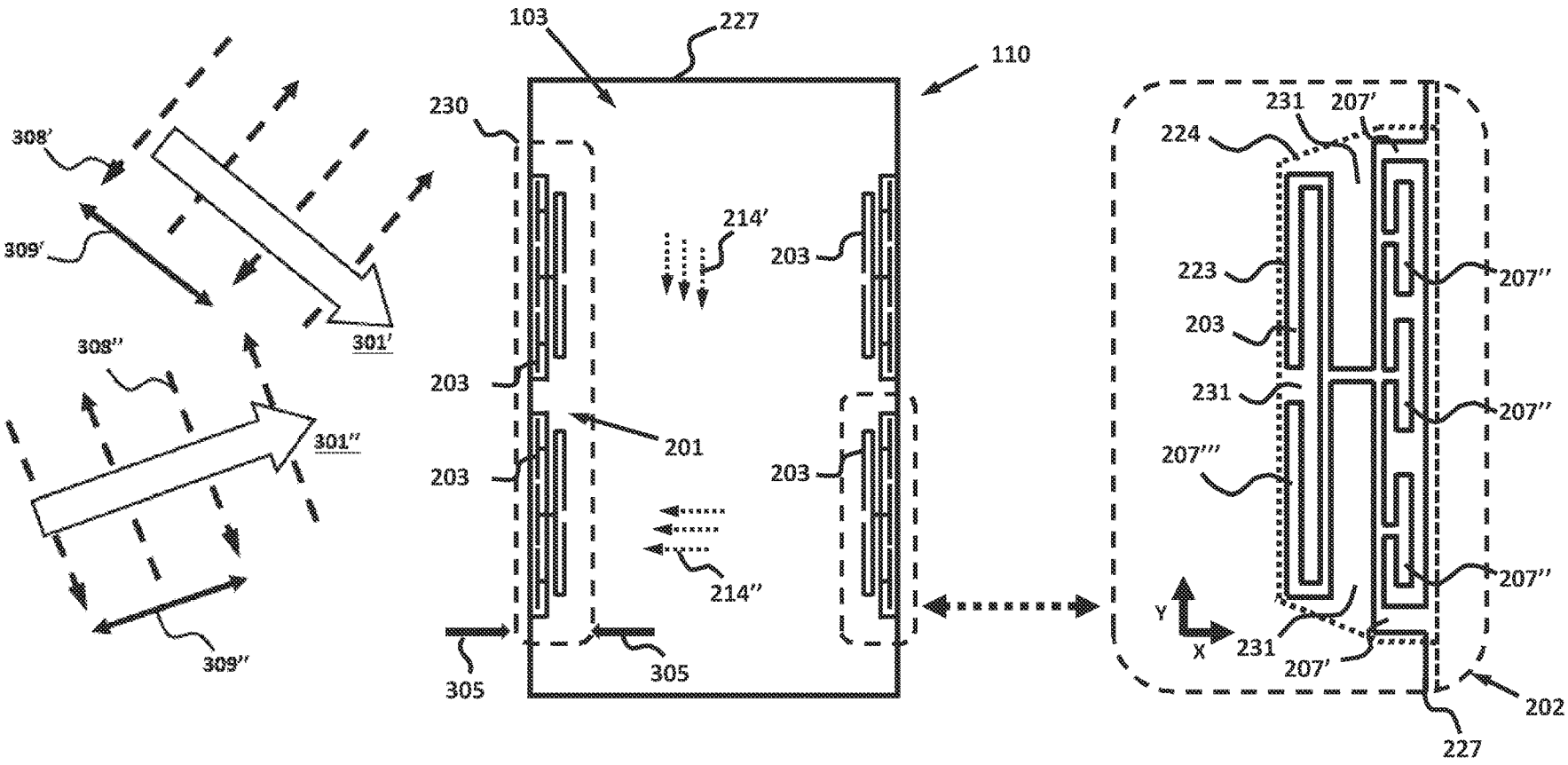
FIG. 1*a* shows a building material according to an advantageous embodiment of the present disclosure.
FIG. 1*b* shows a detail in the building material of FIG. 1*a;*

FIG. 1*a* shows a typical building material 110 comprising an electrically conductive low emissivity surface 103 arranged for boosting the thermal insulation properties of the building material. Typical building materials in which low emissivity surfaces, such as selective films or aluminium films, are used, may include, for example, energy-efficient windows and insulating glass elements used in façades, as well as e.g. aluminium coated insulation panels or aluminium-plastic composites for façades.

FIG. 1*a* shows an arrangement according to an advantageous embodiment of the present disclosure, wherein the building material 110 comprises at least one electrically conductive low emissivity surface 103 equipped with an opening 203 for boosting the transmission of an electromagnetic signal through the building material, the opening having a substantially lower electrical conductivity than the low emissivity surface 103.

FIG. 1*b* shows the opening 203 of FIG. 1*a* in more detail, whereby the edge of the opening 203 arranged in said low emissivity surface 103 forms at least one closed edge curve 223, and said opening defines a closed envelope curve 224 so that said opening 203 is within the closed envelope curve 224, and the surface defined by the closed envelope curve 224 has an area substantially larger than the area of the opening 203 within the closed envelope curve 224 and a length substantially smaller than the length of the closed envelope curve 224, whereby at least one such low emissivity surface 103 area 231 is formed inside the area defined by the closed envelope curve 224, at which the closed envelope curve 224 is not congruent with the edge curve 223.

In the arrangement according to an advantageous embodiment of the present disclosure, shown in FIG. 1*b*, the closed edge curve 223 of the opening is congruent with the closed edge curve 227 defining the low emissivity surface 103. An advantageous embodiment of said opening 203 is configured to be narrow and linear. The narrow opening may be preferably arranged as an opening with a width of, for example, smaller than 100 μm in the low emissivity surface 103.

Definition of Planar Wave

An electromagnetic wave propagating at a sufficient distance from the transmitter, or more precisely the discrete frequency components contained in it, may be considered a planar wave, i.e. a plane wave. In the propagating planar wave, the oscillating electric and magnetic field vectors are perpendicular to each other, and they oscillate in a plane defined by the direction of propagation, perpendicular to a so-called Poynting vector. The relation between the strengths of the electric and magnetic fields is represented by wave impedance. An electromagnetic signal coming normally from a base station to a building envelope may be regarded as a planar wave 301 (FIG. 1*a*), although reflections caused by the immediate surroundings outside the wall may modify the properties of the signal.

The polarization plane of the planar wave 301 is determined according to the electric field vector 308 comprised by it. The planar wave 301 may comprise an electric field vector 308' oscillating in a first polarization (FIG. 1*a*), and it may also comprise an electric field vector 308" oscillating in a second polarization, whereby the electric field vectors 308' and 308" oscillating in the first and second polarizations cross each other. Furthermore, the electric field vectors 308' and 308" oscillating in the first and second polarizations may be orthogonal to each other.

A planar wave 301' may be defined as a planar wave 301 carrying electromagnetic energy which is determined by the interaction between the electric field vector 308' oscillating in the first polarization and the oscillation of the magnetic field orthogonal to it.

A planar wave 301" may be defined as a planar wave 301 carrying electromagnetic energy which is determined by the interaction between the electric field vector 308" oscillating in the second polarization and the oscillation of the magnetic field orthogonal to it.

The planar wave 301 may comprise two electric field vectors 308' and 308" oscillating in cross polarization, whereby the planar waves 301' and 301" represent the propagation of polarized wave fronts in the first and second polarizations, and these may propagate in parallel.

The wave fronts 301' and 301" of the planar wave may also come from independent directions, whereby either one of the wave fronts 301' or 301" of the planar wave may be generally referred to as the planar wave 301.

Polarization of an Electromagnetic Wave

The polarization level of an electromagnetic wave is determined according to the oscillation level of the electric field of the wave. The polarization of the wave may be either linear, elliptical, cross, or circular polarization. Linear polarization comprises one dominating direction of oscillation of the electric field, in which the amplitude of the cross polarization component is significantly lower. In elliptical polarization, the electric field comprises a dominating direction of oscillation of the electric field in a plane perpendicular to the Poynting vector, and also a minor direction of oscillation of the electric field. The relation between the strengths of these two polarization components is represented by components parallel to the so-called major axis and minor axis. In practice, radio transmission seldom remains purely linearly polarized even if it were transmitted as such, because various reflections, refractions and diffractions modify the properties of the signal on its path.

In cross polarization, the wave typically carries two orthogonally oscillating electric field components. This is a particularly important form of polarization in modern communication applications, because in two orthogonal polarizations it is possible to transmit almost uncorrelated communication channels simultaneously.

A more specific form of cross polarization is circular polarization. Circular polarization comprises two electric field vectors which are typically waves carrying the same information and transmitted at equal amplitudes and with a phase difference of 90 degrees. The electric field of a circularly polarized wave rotates as the wave propagates, and the direction of rotation of the wave depends on the sign of the phase difference of the polarization components to be summed up. Two circularly polarized transmissions may cross each other when their directions of rotation are opposite. Fully orthogonal circular polarizations are uncorrelated with each other.

A circularly polarized transmission may be generated, for example, by two orthogonal linearly polarized antennas or antenna groups whose separate polarization components are distributed from the same communication signal by e.g. a power divider, and where the partial components are implemented with a 90° phase difference. An alternative way of implementing phased partial components of a circularly polarized transmission is, for example, to use a hybrid coupler for implementing both the distribution and the phasing in the same component. Also, a circular polarized antenna may be used to implement a circularly polarized transmission without distributing the signal before the antenna. Thus, the antenna element as such is capable of forming two orthogonal polarization components from the same signal, and of providing them with a phase difference.

Particularly in MIMO and diversity use, established transmission levels of linear cross polarization in base station antennas include −45° and +45° polarization levels at which it is possible to emit signals orthogonal to each other. Furthermore, the utilization of orthogonal circularly polarized signals in wireless communication devices is particularly efficient. For example, so-called massive MIMO technology utilizing narrow antenna beams could utilize orthogonal circularly polarized signal streams as well.

Electromagnetic Diffraction from an Aperture (Narrow Vs. Wide Aperture)

For the sake of clarity, we shall define an aperture 201 transmitting a radio signal. An aperture refers to any opening or hole in general. In this context, the aperture 201 for transmitting radio signals in the low emissivity surface 103 comprises a surface area defined by a closed curve 230, wherein said aperture 201 for transmitting radio signals is within said closed curve 230, and the area of the surface defined by the closed curve 230 is substantially smaller than the area of the surface defined by the closed edge curve 227 defining the low emissivity surface 103, and which is passed by an electromagnetic signal with a significantly lower transmission resistance than regions outside the area of the aperture in the same material or structure.

The aperture 201 for transmitting a radio signal on the low emissivity surface 103 comprises an area which further comprises mechanical or artificial methods for boosting the transmission of electromagnetic signals. In this context, an artificial method refers to the utilization of the energy comprised by the electromagnetic signal in such a way that interference formed in the electrically conductive surface of the low emissivity surface 103 is used to create focused radiation sources 303 which are activated as radiation sources by the energy carried by the electromagnetic signal. These new radiation sources emit electromagnetic energy to the side of the shadow region of the low emissivity surface 103 for boosting the transmission of the electromagnetic signal through the building material. Incident on the low emissivity surface 103, the electromagnetic signal passes the aperture 201 formed in it for transmitting radio signals, with a considerably lower transmission resistance than when it passes the low emissivity surface 103 outside the aperture 201 for transmitting radio signals.

FIG. 1*a* shows an aperture 201 for transmitting radio signals according to an advantageous embodiment of the present disclosure, formed by array assemblies 202 of slot radiators 207 formed by narrow openings 203 in the low emissivity surface 103, for boosting the transmission of electromagnetic signals through the building material. Said slot radiators 207 of said aperture 201 are configured to constitute at least focused radiation sources for emitting an electric field vector 308' of a first polarization, as well as focused radiation sources for emitting an electric field vector 308" of a second polarization, whereby the first and second polarizations are crosswise.

Said aperture 201 for transmitting radio signals defines an area in the building material 110 which is limited by a closed curve 230, wherein said aperture 201 for transmitting radio signals is arranged within said closed curved 230, and the area of the surface defined by the closed curve 230 is substantially smaller than the area of the surface defined by the closed edge curve 227 delimiting the low emissivity surface 103.

FIG. 1*b* shows the array of slot radiators 202 presented in FIG. 1*a* in more detail, whereby the closed edge curve 223 of said opening 203 is configured in the form of a resonating system and to receive electromagnetic energy comprised by the electric field vector 308' of the first polarization at a first operating frequency of the slot radiator 207', as well as electromagnetic energy comprised by the electric field vector 308" of the second polarization at the first operating frequency of the slot radiator 207'". Said slot radiators 207 and 207'" constitute a dual polarized array of slot radiators operating at the first frequency.

FIG. 1*b* further shows an array of slot radiators operating at a second operating frequency and comprising slot radiators 207" for receiving electromagnetic energy comprised by an electric field vector 308" in the direction of the second polarization.

FIGS. 2*a* to 2*d* show an insulating glass unit 100 comprising at least two glass panes 102, a space 105 between these, at least one of the glass panes 102 being provided with said low emissivity surface 103.

Figure 2B:
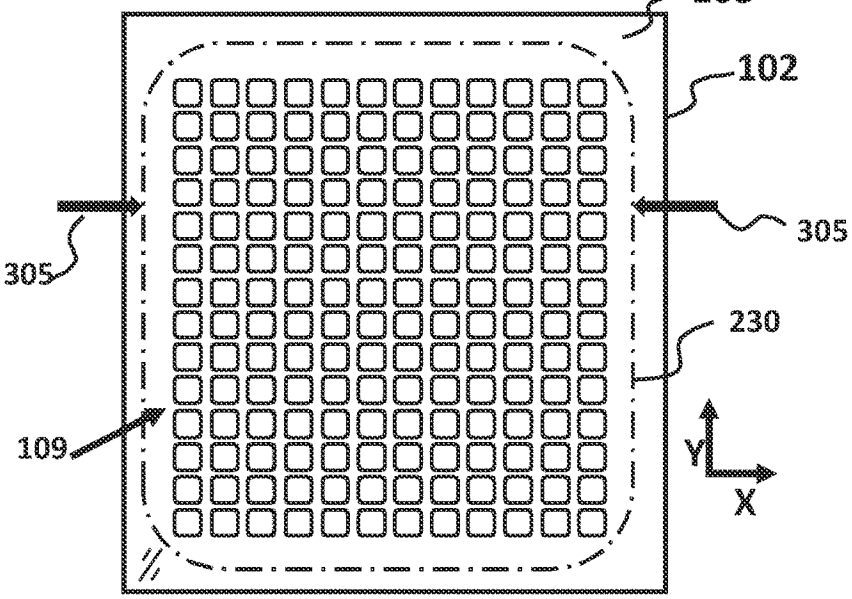
FIGS. 2*a* to 2*d* show an insulating glass unit comprising at least two glass panes, a space between these, at least one of the glass panes being provided with said low emissivity surface.
Figure 2A:
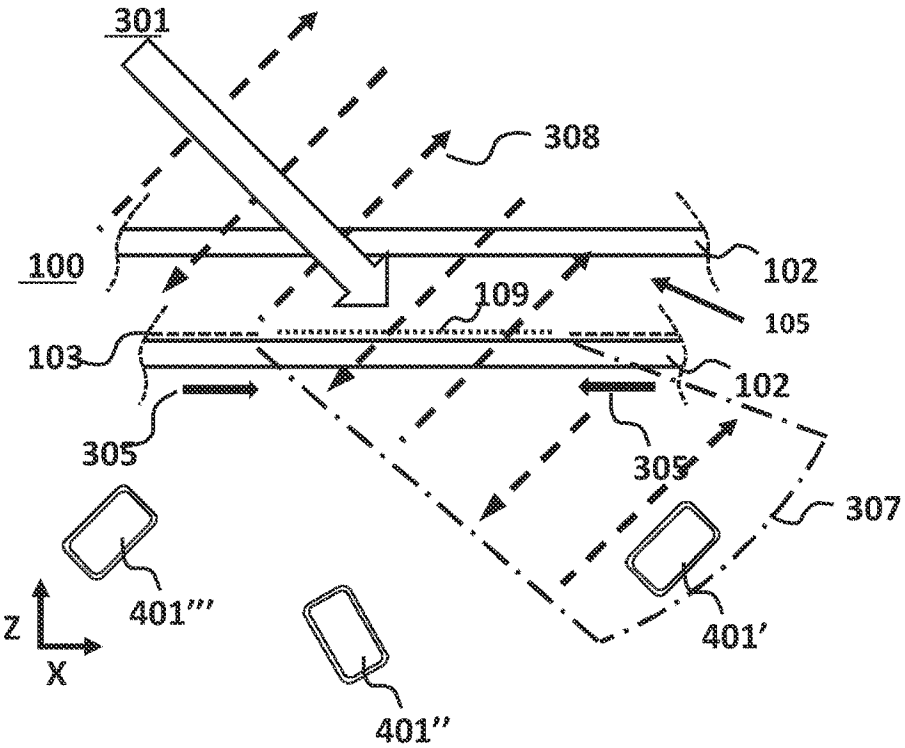
Figure 2D:
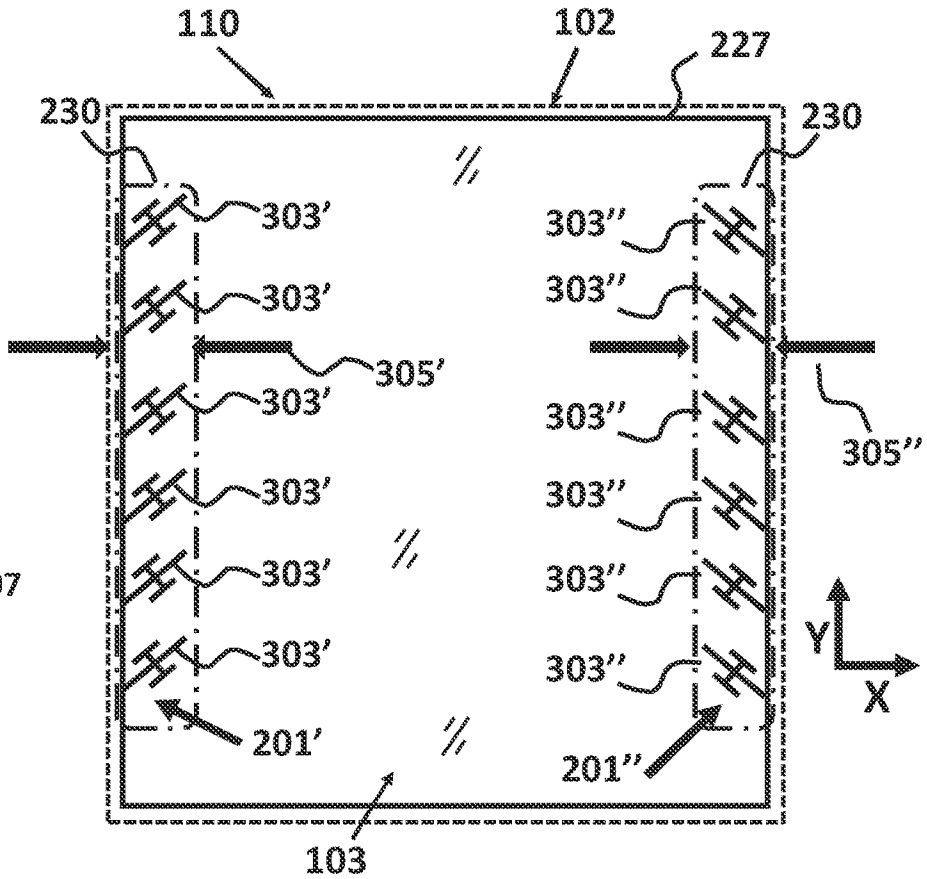
Figure 2C:
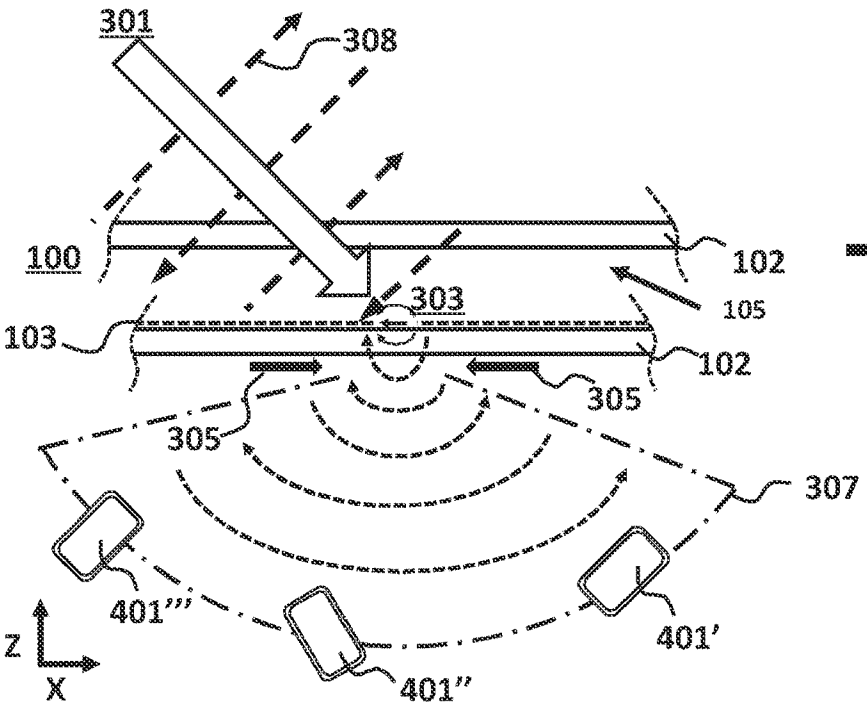

FIG. 2*a* shows the diffraction of an electromagnetic wave from a wide aperture, and FIG. 2*c* shows the diffraction of an electromagnetic wave in a narrow aperture according to an advantageous embodiment of the present disclosure, wherein said aperture 201 is arranged in connection with a glass pane 102 comprising a low emissivity surface 103, and the glass panes 102 are arranged in the form of an insulating glass unit 100. FIG. 2*a* shows the arrival of a planar wave 301 onto a glass pane 102 comprising a low emissivity surface 103 in a situation in which the low emissivity surface 103 is provided with a wide aperture. The wide aperture refers to an aperture whose width is greater than the wavelength 309. In this context, the wide aperture may be implemented e.g. by means of a planar frequency selective filter 109, or by leaving the glass pane 102 uncoated.

FIG. 2*b* exemplifies a planar frequency selective filter 109 of prior art, in which the aperture transmitting an electromagnetic signal has a physical width 305 of several wavelengths. In a case such as the example of FIG. 2*a*, wireless communication devices 104', 104", and 401"' placed in an unknown direction in a room only receive signal coverage in random situations in which the incoming electromagnetic planar wave 301 is not faced with significant shadowing. In a case such as the example, the wireless communication device 401"' receives the diagonally incoming electromagnetic planar wave 301, but the wireless communication devices 4011 and 401" remaining in the shadow region are not capable of setting up a reliable wireless connection to the base station, due to the narrow transmission sector 307.

Now, FIG. 2*c* shows an arrangement according to an advantageous embodiment of the present disclosure, wherein electromagnetic energy received from the planar wave 301 and oscillating in first and second polarizations is re-transmitted and distributed in a wide transmission sector 307 efficiently to the shadow region of the room, by utilizing the diffraction of the narrow aperture.

The low emissivity surface 103 comprised by the glass pane 102 is provided with a narrow aperture 201' having a width preferably smaller than half of the wavelength and transmitting radio signals (FIG. 2*d*) by several slot radiators 207 used as focused radiation sources 303'. The slot radiators 207 comprised by the aperture 201' for transmitting radio signals are polarized in the direction of first polarization and arrayed as an array of slot radiators which is activated as a radiation source by the electromagnetic energy carried by the electromagnetic planar wave 301 received by it.

Furthermore, the low emissivity surface 103 comprised by the glass pane 102 is provided with another narrow aperture 201" having a width preferably smaller than half the wavelength and transmitting radio signals by several slot radiators 207' used as focused radiation sources 303". The slot radiators 207' comprised by the aperture 201" for transmitting radio signals are polarized in the direction of second polarization diagonal to the first polarization and arrayed as an array of slot radiators which is activated as a radiation source by the electromagnetic energy carried by the electromagnetic planar wave 301 received by it.

FIG. 2*d* illustrates how the aperture 201' for transmitting radio signals, implemented by slot radiators 207, as well as the aperture 201" for transmitting radio signals can be implemented in a structure like an advantageous embodiment according to the present disclosure, in which the insulating glass unit 100 comprises the aperture 201' for transmitting radio signals, polarized in a first polarization, and the aperture 201" for transmitting radio signals, polarized in a second polarization, whereby the first and second polarizations cross each other.

For the sake of clarity, we shall define the aperture 201 for transmitting radio signals to refer generally to either one of the aperture 201' for transmitting radio signals, polarized in the first polarization, or the aperture 201" for transmitting radio signals, polarized in the second polarization. Correspondingly, we shall define the physical width 305 of the aperture to refer to either the width 305' of the aperture 201' for transmitting radio signals, polarized in the first polarization, or the width 305" of the aperture 201" for transmitting radio signals, polarized in the second polarization.

The physical width 305 of the aperture 201 for transmitting radio signals is preferably smaller than half the wavelength. For achieving a diffraction pattern of a narrow aperture, and for minimizing null points of radiation in the transmission sector 307, the incoming planar wave 301 has to illuminate the whole aperture 201 for transmitting radio signals as it propagates a distance not greater than one wavelength 309 from the moment when the wave front of the incoming planar wave 301 first impinges the edge of the area defined by the aperture 201 for transmitting radio signals. For illustration, the frequency range of 800 MHz can be given as a non-limiting example, at which narrow openings may have a width of e.g. 5 mm, 10 mm, 30 mm, 50 mm, 100 mm, or 150 mm. For clarity, it is mentioned that the physical width 305 of the aperture 201 for transmitting radio signals, shown in FIG. 2*d*, is defined in the direction of the X-axis shown in the figure, and correspondingly, the length of the aperture 201 for transmitting radio signals is defined in the direction of the Y-axis. For achieving sufficient directivity, the height of the aperture 201 for transmitting radio signals should be at least equal to the one wavelength 309 of the operating frequency.

An aperture 201 according to an advantageous embodiment of the present disclosure, permeable to radio signals, comprises an edge curve 230 which delimits a surface area delimited from a low emissivity surface 103. Said area may have any shape. An advantageous shape is a rectangle or an oval having a width 305 advantageously smaller than one wavelength at the lowest operating frequency of the array 202 of slot radiators comprised by said aperture. The width 305 of said area may also be determined in a direction deviating from the horizontal plane, said aperture 201 deviating from a vertically oriented rectangle or oval. The length of said aperture may be determined in a direction which deviates from the direction of the width 305 and is substantially longer than said width 305.

The diffraction pattern of the narrow aperture according to the present disclosure is illustrated in FIG. 2*c* by a wide transmission sector 307, wherein the focused radiation source 303 represents, depending on the context, either one of the focused radiation source 303' comprised by the aperture 201' for transmitting radio signals, polarized in the first polarization, or the focused radiation source 303" comprised by the aperture 201" for transmitting radio signals, polarized in the second polarization, whereby the first and second polarizations cross each other.

In the situation illustrated by the example, the wireless communication devices 401', 401" and 401"' placed in unknown directions in FIG. 2*c* are now more likely to obtain an adequate connection to the base station, because the energy of the signal coming from the base station is distributed over a wide transmission sector 307 based on narrow aperture diffraction.

The aperture 201 according to the present disclosure for transmitting radio signals utilizes narrow aperture diffraction and has a physical width 305 preferably smaller than half the wavelength. To be more specific, the aperture may also be a multifrequency structure, or it may operate in broadband. Thus, the advantageous maximum width of the aperture is determined according to the wavelength 309 of the minimum operating frequency.

The aperture 201 according to the present disclosure for transmitting radio signals may also comprise several focused radiation sources 303 next to each other in the direction defined by the physical width 305 of the aperture. In this case, the electromagnetic wave passing through the low emissivity surface 103 constitutes an interference pattern which determines the behaviour of the transmission sector 307. The beam width of the transmission sector 307 determined by the interference pattern caused by two focused radiation sources can be kept wide and uniform when the distance between the focused radiation sources 303 in the width direction X of the aperture is maintained preferably shorter than half the wavelength. When the distance between two focused radiation sources is increased to exceed half the wavelength, several zero and maximum points begin to appear in the interference pattern, and their number increases as the distance between the radiation sources increases.

A substantial difference between the wide aperture and the present narrow aperture is the following. A wave front of an electromagnetic planar wave 301 transmitted from a base station and arriving preferably from the horizon illuminates the whole surface of the aperture 201 for transmitting radio signals when passing a distance not exceeding one wavelength 309 and impinging on the aperture, irrespective of whether the electromagnetic planar wave 301 comes from the direction of the normal of the low emissivity surface 103 or from an azimuth angle substantially deviating from it.

As an illustrative example, said azimuth angle deviates at least 30° from the normal vector of the surface of the low emissivity surface 103. In another illustrative example, said azimuth angle deviates at least 60° and less than 90° from the normal vector of the surface of the low emissivity surface 103. In yet another illustrative example, said azimuth angle deviates 90° from said normal vector, and the width 305 of the aperture 201 less than said one wavelength 309.

Impulse of the Planar Wave on the Low Emissivity Surface

When the electromagnetic planar wave 301 impinges on the electrically conductive low emissivity surface 103, part of the energy of the wave is reflected back in its incoming direction or in other directions in which the reflected wave front 306 continues to propagate, and part of the energy of the wave is converted into heat as a result of resistive losses of the conductive surface.

Figure 3B:
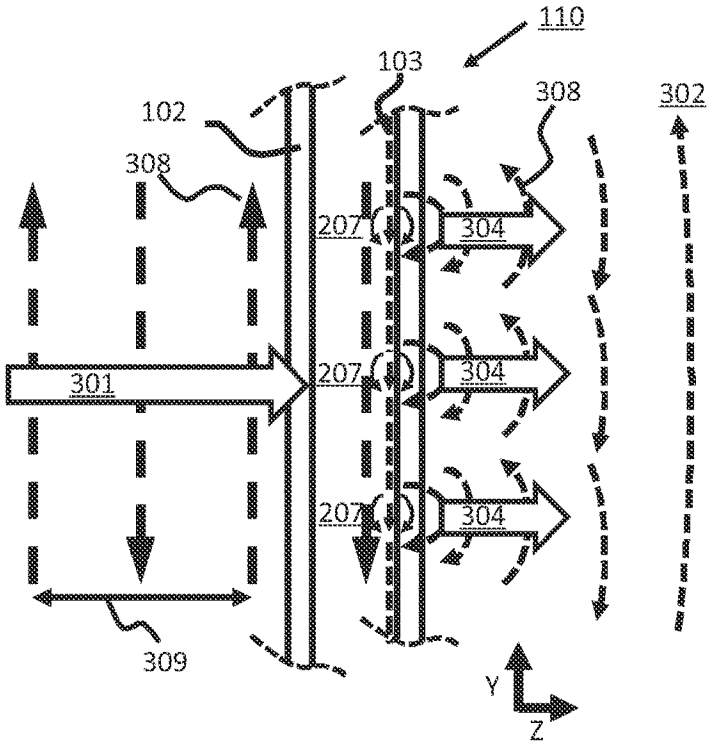
FIGS. 3*a* and 3*b* show an example of a coherent wave front caused by an array of focused radiation sources comprised by a narrow aperture.
Figure 3A:
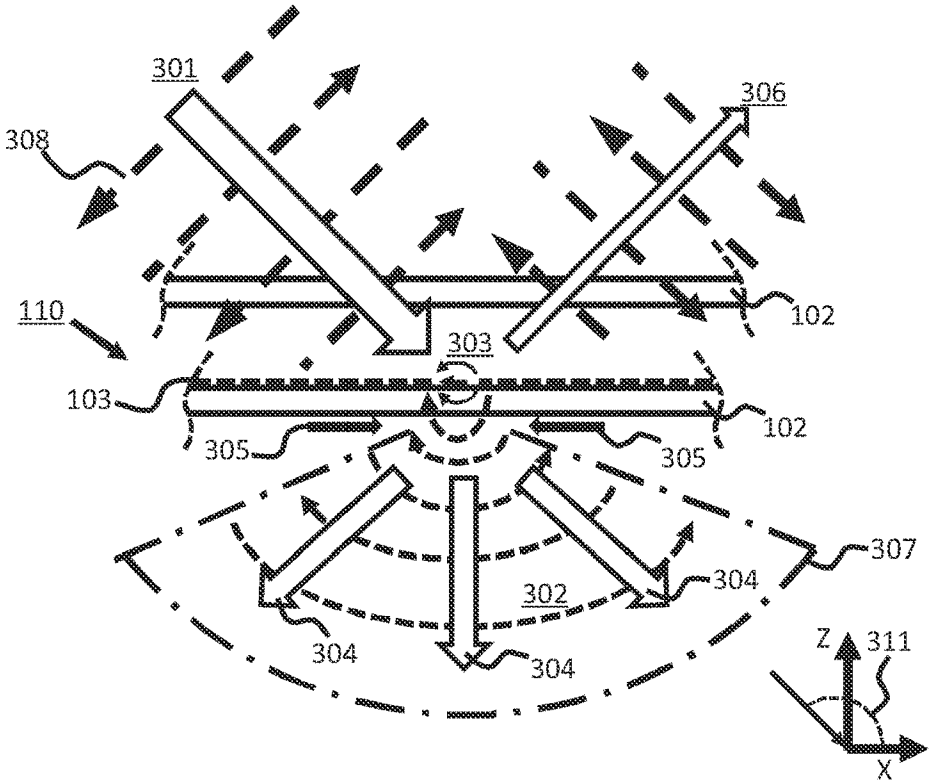
Figure 3C:
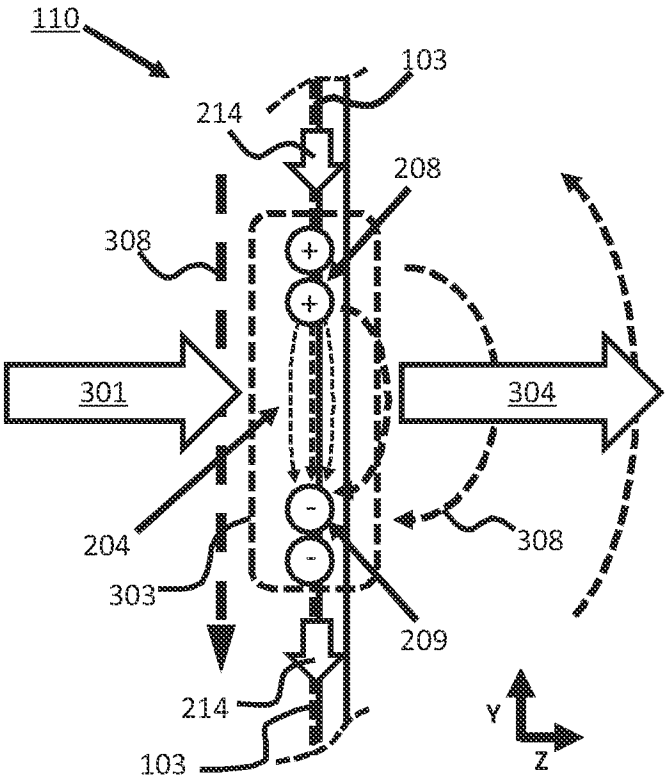
FIG. 3*c* shows a detail in the slot radiator of FIG. 3*b;*

FIGS. 1*a* and 1 *b*, as well as FIGS. 3*a* to 3*c*, show the incidence of the wave front of the electric field vector 308 comprised by the planar wave 301 on the low emissivity surface 103. The oscillating period of the electric field vector 308 of the propagating wave front is one wavelength 309. During one oscillating period, the phase angle of the electric field vector is changed by 360 degrees. The wave front 301' of the planar wave polarized in the first polarization comprises a wavelength 309', and the wave front 301" of the planar wave polarized in the second polarization comprises a wavelength 309".

In a situation similar to the example, the electromagnetic planar wave 301 coming preferably in the horizontal direction arrives at a random azimuth angle 311. The wave front 301' of the planar wave polarized in the first polarization arrives at an azimuth angle 311', and the wave front 301" of the planar wave polarized in the second polarization arrives at an azimuth angle 311".

The oscillating electric field of the incoming planar wave 301 incites a movement of electrons oscillating at the same frequency on the conductive surface. The motion of the electrons accumulates on the outer faces of the conductive surface, forming a surface current pattern oscillating on the conductive surface. A local surface current vector 214 comprised by the surface current sheet on the conductive surface is always perpendicular to the direction of the magnetic field parallel to the surface. On the surface of a perfect electric conductor, the electric field parallel to the surface is diminished completely. The surface resistance of a non-ideal conductive surface converts part of the energy contained in the signal into heat, because of resistive losses. This surface resistance is dependent on the low emissivity surface 103 in use.

An electric field vector 308' oscillating in the first polarization induces a surface current vector 214' on the low emissivity surface 103. An electric field vector 308" oscillating in the second polarization induces a surface current vector 214" on the low emissivity surface 103.

For the sake of clarity, we shall define the azimuth angle to be parallel with the XZ plane and the elevation angle to be parallel with the YZ plane. Surface current vectors 214 induced by electromagnetic energy of the planar wave 301 arriving at the azimuth angle 311 build up a motion of electrons flowing in the form of a wide wave on the low emissivity surface 103, wherein the length of the oscillating period of the flowing pattern can be detected as a projection 310 of the wavelength 309 of the incoming planar wave on the low emissivity surface 103. The polarization plane defined by the electric field vector 308 of the incoming planar wave 301 also primarily determines the direction of oscillation of the surface current vectors 214 formed in the low emissivity surface 103. The polarization plane may be a vertical plane of oscillation, a horizontal plane of oscillation, or anything between these. The primary travel direction of the wave pattern propagating as an oscillating surface current sheet on the low emissivity surface 103 is determined according to the direction of incidence of the incoming planar wave 301 acting as an impulse. The impulse caused by the electromagnetic energy of the incoming planar wave 301 induces oscillation of the surface current vectors 214 on the low emissivity surface 103 in the polarization direction determined by the electric current vector 308 of the incoming wave. In addition to this polarization and flow direction, secondary movement of the surface current occurs in the low emissivity surface 103, primarily resulting from the flow of electrons caused by the induced surface current vectors 214. This is typically manifest in the form of eddy currents which primarily flow in areas not illuminated in the first place by the electric field vector 308 of the incoming planar wave 301. The return flow of the surface current normally forms loop-like flow patterns.

The array of slot radiators 202 comprised by the aperture 201 according to the present disclosure for transmitting radio signals, consisting of focused radiation sources 303 formed by narrow linear openings 203, is based on appropriate interference on the flow paths of the surface current vectors 214.

The narrow opening 203 according to the present disclosure is configured to implement interference on the flow of the surface current vector 214 induced by the electric field vector 308 in such a way that this interference results in the formation of a first positive charge distribution 208 at the first edge of the narrow opening 203, and the formation of a first negative charge distribution 209 at the second edge of the narrow opening 203, as well as an electromotive force 204 effective in the non-conductive area of the narrow linear opening 203. Said electromotive force 204 acts as the focused radiation source 303 for re-emitting electromagnetic energy to the shadow region caused by the insulating glass unit 100.

The focused radiation source 303, comprising an electric field used as a radiation source and arranged in the non-conductive area of the slot radiator 207, and this radiation source may be configured in the form of an efficient radiator when said electric field is configured to resonate together with the surface current flowing in the low emissivity surface 103. The first positive 208 and negative 209 charge distributions arranged in the low emissivity surface 103 act as a source and a pole for said surface current 210. Said charge distributions are formed by providing interference in the flow of surface current vectors 214 induced from the electromagnetic planar wave 301 on the low emissivity surface.

The aperture 201' for transmitting radio signals according to the present disclosure, arranged in the low emissivity surface 103, is configured to receive and re-emit electromagnetic energy in the first polarization, wherein the electric field vector 308' comprised by the first polarization causes an electromotive force 204' in the direction of the first polarization in the non-conductive region of the narrow opening 203 provided in the low emissivity surface. The resulting electromotive force 204' is configured to generate a resonance circuit together with the current loop 210' encircling the opening and used as the focused radiation source 303' polarized in the first polarization.

Said resonance in the electromagnetic system refers, in general, to an oscillation phenomenon in which the system interacts with its environment and is capable of receiving or transmitting electromagnetic energy at an intrinsic oscillation frequency. The energy oscillating at an electromagnetic resonance is stored in the electric and magnetic fields of the system in an alternating way. In the resonance comprised by the slot radiator 207 formed in the low emissivity surface 103, the surface currents formed at the edges of the slot radiator 207 are substantially connected to the resonating magnetic field.

The aperture 201" for transmitting radio signals according to the present disclosure, arranged in the low emissivity surface 103, is configured to receive and re-emit electromagnetic energy in the second polarization, wherein the electric field vector 308" comprised by the second polarization causes an electromotive force 204" in the direction of the second polarization in the non-conductive region of the narrow linear opening 203 provided in the low emissivity surface. The resulting electromotive force 204" is configured to generate a resonance circuit together with the current loop 210" encircling the opening and used as the focused radiation source 303" polarized in the second polarization.

Causing appropriate interference in the flow of the surface current vector 214 in the low emissivity circuit 103 by the narrow linear openings 203 either by interrupting or redirecting the path of the current will result in a set of electromotive forces 204 inducing electromagnetic radiation fronts whose propagation is utilized on the basis of constructive interference. This set of electromotive forces constitutes an array of slot radiators 202 consisting of focused radiation sources 303.

With regard to the effect of a single narrow linear opening 203 on the surface current vector 214, it can be stated that as the electric field vector 308 induced by the surface current is still effective on the movement of electrons on the conductive surface, the path of the surface current vector 214 is curved and forms a current loop 210 encircling the opening. FIG. 3*c* shows an advantageous embodiment of the present disclosure, in which a narrow linear opening 203 is oriented orthogonally to the direction of the electric field vector 308 of an incoming planar wave 301. Such an opening causes two symmetrical current loops 210 encircling the narrow linear opening 203 on its either side.

In combination with the electromotive force 204, the current loop 210 encircling the narrow linear opening 203 constitutes a resonance circuit which enables the operation of the narrow opening as an effective radiator. The dimensions of the narrow linear opening 203 are brought into resonance at the operating frequency of the planar wave 301 carrying electromagnetic energy, whereby the narrow linear opening 203 becomes an efficiently emitting slot radiator 207 which re-emits the electromagnetic energy received by it from the electromagnetic planar wave 301.

An Array of Focused Radiation Sources Comprised by a Narrow Aperture as a Transmitter of a Coherent Wave Front The aperture 201 transmitting radio signals and comprising an array of slot radiators 202 emits a wave front based on narrow aperture diffraction into its transmission sector 307. The physical width 305 of the aperture for transmitting radio signals is preferably smaller than half the wavelength. Thus, the wave front of the electromagnetic planar wave 301 transmitted from a base station and arriving preferably from the horizon illuminates the whole surface of the aperture 201 for transmitting radio signals when passing a distance not exceeding one wavelength, preferably half the wavelength when impinging on the aperture, irrespective of whether the electromagnetic planar wave 301 comes from the direction of the normal of the low emissivity surface 103 or from an azimuth angle substantially deviating from it.

By the above described condition, a situation is achieved in which the electric field vector 308 of the incoming planar wave 301 illuminates the whole aperture for transmitting radio signals, almost simultaneously and in the same cycle. As a result, an array of slot radiators 202 is formed inside the aperture 201 for transmitting radio signals, each single slot radiator 207 comprising an electromotive force 204 oscillating in the same cycle. The array of slot radiators 202 comprised by the narrow aperture, the slot radiators 207 oscillating in the same cycle, generates a coherent wave front 302 which transmits electromagnetic energy conveyed by the electromagnetic planar wave 301 to the shadow region on the opposite side of the insulating glass unit 100.

In the case of a wide aperture, single focused radiation sources are formed which do not oscillate in the same cycle and which emit electromagnetic radiation that does not form a coherent wave front in the shadow region. The single slot radiators comprised by the wide aperture oscillate in different cycles with respect to each other, and for this reason, the reflection and radiation pattern caused by the wide aperture is strongly dependent on the angle of incidence of the electromagnetic planar wave illuminating it. This is a typical technical feature of e.g. planar frequency selective surfaces forming a wide aperture.

The present disclosure utilizes surface currents formed of the planar wave on the low emissivity surface 103 for generating new focused radiation sources 303 so that the electromagnetic wave front emitted by the radiation sources is summed up coherently on the opposite side of the low emissivity surface in a horizontal beam having a maximum width and an angle which is preferably at least 90 degrees. The present disclosure thus makes it possible for an electromagnetic signal to pass through an insulating glass unit comprising a low emissivity surface by creating a virtual aperture whose effective area is larger than the physical openings formed in the low emissivity surface. Furthermore, the insulating glass unit 100 according to the present disclosure is capable of receiving electromagnetic energy from a horizontal beam having a maximum length in a space comprising the direction of incidence of the planar wave.

FIGS. 3*a* and 4*b* show an example of a coherent wave front caused by an array of focused radiation sources comprised by a narrow aperture, wherein said aperture is arranged in connection with a building material 110.

FIG. 3*a* shows a top view of a situation in which a coherent wave front 301 impinges the surface of the outermost glass pane 102 of the insulating glass unit 100, whose outer surface is provided with a low emissivity surface 103 comprising narrow openings 203. These openings constitute focused radiation sources 303, by means of which electromagnetic energy of the wave front 301 is transmitted to the other side of the glass pane 102 and from which electromagnetic energy is radiated in the form of a coherent wave front 302 to the interior side. FIG. 3*b* shows the situation of FIG. 3*a* in a side view. It shows that the wave front 302 extends at least to the height of the window in the vertical direction, but in practice, it is very large in this direction as well and covers substantially the whole room in the height direction, particularly at a distance from the insulating glass unit 100.

The redirected wave 304 emitted by the focused radiation source 303 provides network coverage for the shadow region caused by the insulating glass unit 100.

The reception and re-emission of the energy of the incoming electromagnetic wave via several focused radiation sources 303 is implemented by precisely positioned narrow openings in the low emissivity surface. In the above described way, the incoming electromagnetic wave induces surface currents in the electrically conductive coating. The direction of the surface currents in the conductor is determined in a direction perpendicular to the magnetic field vector of the incoming wave. When the travel direction of the formed surface currents is interfered by the narrow openings 203 in the low emissivity surface, the surface current encircles the formed opening by following its edges and creating a resonance circuit together with the electromotive force 204 effective across the narrow opening 203.

The building material 110 according to the present disclosure may comprise a single aperture 201 for transmitting radio signals and configured to be operated in one or more polarizations at one or more frequency ranges. The building material 110 may also comprise several apertures for transmitting radio signals and having polarizations or operating frequencies different from each other. The present building materials may also be used for implementing wall or façade structures which comprise several apertures 201 for transmitting radio signals, wherein the distance between said apertures is preferably configured to be shorter than ten meters. Advantageous distances between said apertures may also be, for example, 2 to 5 meters, or 1 to 2 meters, whereby an isolation may be provided between the operation of single apertures, for securing the desired operation.

Coherent Reception and Transmission from Several Slot Radiators

It is known that the efficiency of passive repeaters is weak. Factors behind this include, for example, thermal loss in cabling between antennas, as well as quick damping of electromagnetic energy emitted from the antenna element as a function of the distance. This efficiency of the repeater may be improved in single directions by using directional rake antennas, whereby an improved efficiency in a narrow sector is achieved by amplification of the antenna. However, such a repeater involves the problem that the rake antennas comprised by it, for example a Yagi antenna, will have to be oriented in the direction of a single base station. Rake antennas having a narrow antenna beam do not receive signals efficiently from lateral directions.

According to an advantageous embodiment of the present disclosure, the horizontally wide receiving and transmitting beam produced by the diffraction pattern formed by the narrow aperture 201 arranged in the low emissivity surface 103, for transmitting radio signals, provides advantages to directional antennas with a narrow beam.

It is an aim of the present disclosure to improve the efficiency of a building material 110 used as a passive system for transmitting signals, by appropriate control of the energy of electromagnetic waves in the shadow region formed by the building material, wherein the low emissivity surface 103 is provided with an opening 203 for boosting the transmission of an electromagnetic signal through the building material. Said electromagnetic signal comprises an incoming planar wave 301, and said electromagnetic signal passed through the building material comprises a redirected wave 304.

In addition to the horizontally wide receiving and transmitting beam formed by the narrow aperture as described above, the present disclosure has the advantageous feature of increasing the efficiency in the horizontally wide beam so that the low emissivity surface 103 is preferably provided with several focused radiation sources 303 formed in the vertical direction, emitting redirected waves 304 which comprise electric field vectors that are summed up in the same phase in the shadow region formed by the building material 110. Said wave front of the redirected wave 304 formed by the electromagnetic waves summed up in the same phase is known as a coherent wave front 302.

The focused radiation sources 303 forming the redirected waves 304 that comprise said coherent wave front 302, may be advantageously arranged at a distance smaller than the wavelength from each other in a preferably vertical line, wherein the line may be either straight or sinuous. When the distance between adjacent focused radiation sources 303 in the line exceeds the wavelength of the operating frequency, the number of side beams present in the radiation beam increases, whereby part of the electromagnetic energy intended to be transmitted in the effective direction is lost in unwanted directions. The vertical line formed by said focused radiation sources may be preferably arranged to have a length greater than the wavelength of the operating frequency, whereby an increase in the amplification of the radiation and receiving beam formed is achieved in the effective directions.

Figure 4:
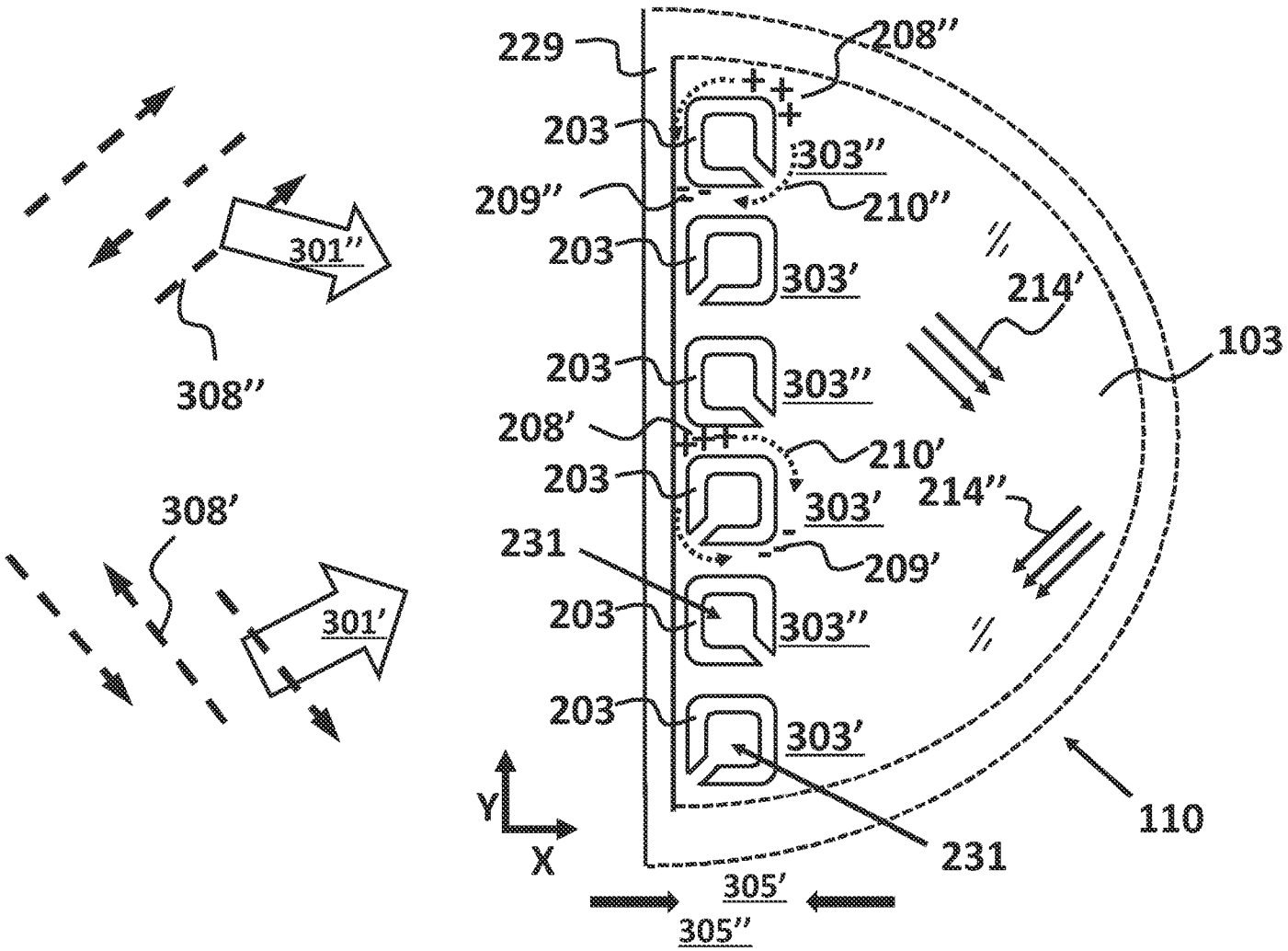
FIG. 4 shows an array of slot radiators arrayed according to an advantageous embodiment of the present disclosure, on a low emissivity surface comprised by a building material.

FIG. 4 shows an advantageous embodiment of a building material 110 according to the present disclosure, wherein said building material comprises at least one electrically conductive low emissivity surface 103 equipped with an opening 203 for boosting the transmission of an electromagnetic signal opening having a substantially lower electrical conductivity than the low emissivity surface 103. Furthermore, the edge of the opening 203 arranged in said low emissivity surface 103 forms at least one closed edge curve 223, and said opening defines a closed envelope curve 224 so that said opening 203 is within the closed envelope curve 224, and the surface defined by the closed envelope curve 224 has an area substantially larger than the area of the opening 203 inside the closed envelope curve 224 and a length substantially smaller than the length of the closed envelope curve 224, whereby at least one such low emissivity surface 103 area 231 is formed inside the area defined by the closed envelope curve 224, at which the closed envelope curve 224 is not congruent with the edge curve 223.

In the example of FIG. 4, the low emissivity surface 103 is provided with an array of slot radiators 202 comprising at least two slot radiators 207 for forming an aperture 201 for transmitting radio signals, wherein said slot radiators 207 are configured to constitute focused radiation sources 303 emitting an electric field vector at least in the direction of said first polarization, and wherein said aperture 201 for transmitting radio signals defines an area in the building material 110 which is delimited by a closed curve 230 wherein said aperture 201 for transmitting radio signals is within said closed curve 230, and the area of the surface delimited by the closed curve 230 is substantially smaller than the area of the surface delimited by the closed edge curve 227 defining the low emissivity surface 103.

In the example of FIG. 4, the low emissivity surface 103 is further provided with an opening 203 comprising at least two said slot radiators 207, wherein said opening 203 is configured to form at least one positive 208 and one negative 209 charge distribution which act as poles for the surface current formed on the low emissivity surface 103, by the effect of the electromagnetic signal oscillating in the second polarization and impinging on the building material 110, as well as an electric field vector oscillating in the second polarization within the opening 203, between its two edges, wherein the electric field vector in combination with said surface current formed in the low emissivity surface 103 generates a resonance circuit for forming a slot radiator 207 which operates as a focused radiation source 303 in the second polarization and in which the first and the second polarizations are crosswise, for boosting the transmission of the electromagnetic signal through the building material.

The width 305' of the area comprised by the closed curve 230 delimiting said aperture 201 for transmitting radio signals in the first polarization may be preferably arranged shorter than the wavelength of the operating frequency. Correspondingly, the width 305" of the area comprised by the closed curve 230 delimiting said aperture 201 for transmitting radio signals in the second polarization may be arranged preferably shorter than the wavelength of the operating frequency.

FIG. 4 shows an array of slot radiators 202 arranged on the low emissivity surface 103 comprised by the building material 110 according to an advantageous embodiment of the present disclosure, wherein the low emissivity surface 103 is provided with several narrow apertures 201' for transmitting radio signals, having a width preferably smaller than half a wavelength, defined in the direction of the X-axis, by several slot radiators 207 operating as focused radiation sources 303'. The slot radiators comprise polarizations of +45 and −45 degrees and are linearly polarized. Thus, the slot radiators 207 are placed at an angle of 90 degrees to each other. When a wave front arrives from the direction indicated by the arrow 301', whereby the electric field oscillates in the direction of the arrows 308', i.e. in a direction perpendicular to the direction of propagation of the wave front, the electric field generates an electric field that opens to the edges of the opening in the travel direction of the wave front. The other end of the opening is shorted out, whereby a current loop 210' encircling the opening is formed in its vicinity. Arrows 214' indicate the surface current vector induced by this electric field on the low emissivity surface 103 farther away from the slot radiators. Correspondingly, the electric field of the wave front arriving from the direction indicated by the arrow 301" oscillates in the direction of arrows 308", and this electric field induces an electric field at the edges of the opening in the direction of the wave front. This opening is an opening in a direction perpendicular to the preceding aperture, whose second end is shorted out. Thus, a current loop 210" encircling the opening is formed in the vicinity of this second opening. Arrows 214" indicate the surface current vector induced by this second electric field on the low emissivity surface 103 farther away from the slot radiators.

In both of the situations described above, the array of focused radiation sources 303 formed by single slot radiators 207 generates a coherent wave front formed of the electromagnetic energy of the incoming planar wave 301', 301" in the shadow area formed on the interior side of the building by the building material 110.

In the structure shown in FIG. 4, the low emissivity surface 103 is provided with a number of narrow apertures 201 for transmitting radio signals and having a width preferably smaller than half the wavelength. These apertures 201 comprise openings 203 which make a turn in the low emissivity surface 103 so that the open ends of each opening are close to each other and a narrow conductive area is provided between them. The openings of the adjacent slot radiators are at an angle of 45 degrees to each other, whereby these slot radiators comprise polarizations of +45 and −45 degrees and are linearly polarized. The short circuit of the inside and outside of the low emissivity surface 103, i.e. said narrow area, forces the zero point of the electric field to those corners. The openings act as focused radiation sources 303'. Which one of the polarizations can be received and re-emitted by the opening, will depend on the direction of the electric field of the incoming wave front in relation to the location of the short circuit in the opening, i.e. the way in which the electric field is formed around the opening. When the wave front comprises an electric field vector oriented according to the polarization of the opening, the opening 203 is activated as a focused radiation source 303 which is polarized according to the electric field vector 308 illuminating it. On the other hand, an electric field polarized in the direction perpendicular to this direction will not induce a corresponding electric field around the opening.

Arranging a Narrow Linear Opening

A narrow linear opening in the low emissivity surface 203 may be defined as an opening in the conductive surface of the low emissivity surface, wherein the opening in the conductive surface causes a substantial impairment in the conductivity in the area comprised by the opening, and wherein the opening comprises an edge curve, in which the distance between the sections of the edge curve defining the opening at at least two edges is substantially smaller than two sections of the edge curve selected in another direction. As an example but not exclusively, it is mentioned that the width of the narrow linear opening may have a width of, for example, 10 to 100 μm and a length of, for example, 20 to 50 mm. The width of the narrow linear opening may also be, for example, 0.5 to 2 mm. Furthermore, with some mechanical tools, the width of the narrow linear opening may be 5 to 10 mm.

In geometry, a point refers to a variable having a location but not a dimension. When a low emissivity surface 103 is provided with a non-conductive physical point, for example by means of a narrow milling cutter or a single impulse of a pulse laser, the surface is provided with a non-conductive area which can be, in practice, interpreted to have a surface area as well as a circumference. For example, a single point made by a pulse laser may have a diameter in the order of micrometers or tens of micrometers, or smaller, depending on the technique used, such as a femtolaser.

A point moving in a space draws up a line. The line may be either straight, or it may be sinuous or curved, or a broken line consisting of several straight sections. The line may have an initial point and an end point, or it may constitute a closed circumference having a random shape. Special cases of such a random closed circumference include, for example, a circle, an oval, a square, a rectangle, a triangle, as well as polygons. The line may also intersect itself.

A line or a combination of lines, consisting of vectors, may be used for controlling a device for providing a low emissivity surface 103 with an opening 203. For example, the path of the focus of a milling cutter or a pulse laser may be controlled by means of a linear path, as well as a method or a device arranged for a chemical or other possible contactless etching or removing method. Corresponding control may be used to prevent the formation of a conductive surface in desired areas before providing the building material 110 with the low emissivity surface 103.

A physical point moving in a space, such as the focus of a laser, also comprises a circumference and a surface area. As an example, but not exclusively, 100 μm may be mentioned as a diameter for the circumference. When the exemplary physical point moves along the low emissivity surface 103, it defines a narrow linear opening 203 in it. The opening has a closed edge curve 223 and a surface area delimited by it. The slot radiator 207 comprised by the opening 203 may be placed within the closed edge curve 223. The slot radiator 207 comprised by the opening 203 may also be placed outside the closed edge curve 223, if said closed edge curve constitutes a uniform edge curve with the closed edge curve 227 delimiting the low emissivity surface 103.

The two opposite edges of the opening 203 burnt by e.g. a laser on the low emissivity surface 103 are usually parallel, and they define a rectangular opening if the rounding of the edges is not separately taken into account. However, the two opposite edges of the opening 203 do not have to be parallel or identical in shape, but they may be arbitrary. For example, a section of the edge curve placed on the side of the opening opposite to a straight section of the edge curve may be curved, sinuous, or e.g. serrated. Thus, the width of the non-conductive area of the opening may vary in its different sections. The opening 203 may also have several edge curves, as in the case of openings in the shape of e.g. the letter Y or T, which intersect the low emissivity surface from one edge to another.

In this context, the non-conductive area refers to an area which is substantially electrically non-conductive. In reality, there is no boundary between an absolute electrical conductor and an absolute insulator, because almost all materials can be considered to have an electrical conductivity, even if it were very low. In practice, for example copper, silver, aluminium, and selective surfaces having a surface resistance lower than 400 $\Omega/m^2$ can be regarded as conductors, whereas for example wood, PVC and glass are known as typical non-conductive insulators. In reality, however, a selective surface having a surface resistance higher than 100 $\Omega/m^2$ is considered a weak conductor, and antennas made in it have a particularly low radiation efficiency, whereas selective surfaces having a surface resistance of e.g. 1 to 10 $\Omega/m^2$ may, in fact, be used to make antennas having a moderate efficiency, and selective surfaces having a surface resistance lower than 100 $m\Omega/m^2$ may be used to make good antennas. When the surface resistance is close to the wave impedance of free space, the conductor surface behaves like a planar resistance, whereby it converts the energy of an electromagnetic signal efficiently into heat.

An opening 203 in the low emissivity surface 103 may be defined as an opening in the conductive surface of the low emissivity surface, wherein said opening causes a substantial impairment in the conductivity in the area comprised by the opening, and wherein the opening 203 comprises a closed edge curve 223, in which the distance between the sections of the edge curve defining the opening at at least two edges is substantially smaller than two sections of the edge curve selected in another direction. As an example but not exclusively, it is mentioned that the width of the narrow linear opening may have a width of, for example, 10 to 100 μm and a length of, for example, 20 to 50 mm. The width of the narrow linear opening may also be, for example, 0.5 to 2 mm. Furthermore, with some mechanical tools, the width of the narrow linear opening may be 5 to 10 mm.

The opening 203 according to an advantageous embodiment of the present disclosure is arranged as an opening for transmitting radio signals in such a way that the opening is arranged to have a sinuous or curved shape and to cause interference in the flow of surface current vectors 214 formed in the low emissivity surface 103, and wherein the edge of the opening 203 formed in the low emissivity surface 103 forms at least one closed edge curve 223, and said opening defines a closed envelope curve 224 so that said opening 203 is within the closed envelope curve 224, and the surface defined by the closed envelope curve 224 has an area substantially larger than the area of the opening 203 inside the closed envelope curve 224 and a length substantially smaller than the length of the closed envelope curve 224, whereby at least one such area 231 of the low emissivity surface 103 is formed inside the area defined by the closed envelope curve 224, at which the closed envelope curve 224 is not congruent with the edge curve 223.

The narrow linear opening may be implemented by any method suitable for the purpose, but conventional methods include machining, such as grinding. Other methods include, for example, lasering or a chemical method, such as etching, whereby the conductivity of the electrically conductive coating is substantially impaired. An example is a method by which the electrical conductivity of the coating is impaired by printing of a desired pattern onto the surface of the low emissivity surface and by subsequent baking of the pattern at a high temperature.

The building material 110 according to the present disclosure comprises at least a low emissivity surface 103 delimited by a closed edge curve 227, as well as an opening 203 provided in said low emissivity surface 103, wherein said opening 203 is delimited by at least one closed edge curve 223. Said edge curve 223 may be connected to the edge curve 227 delimiting the low emissivity surface 103, or it may constitute an edge curve independent of this edge curve 227. The area of said opening 203 is preferably less than one percent of the area of said low emissivity surface 103.

Figure 5A:
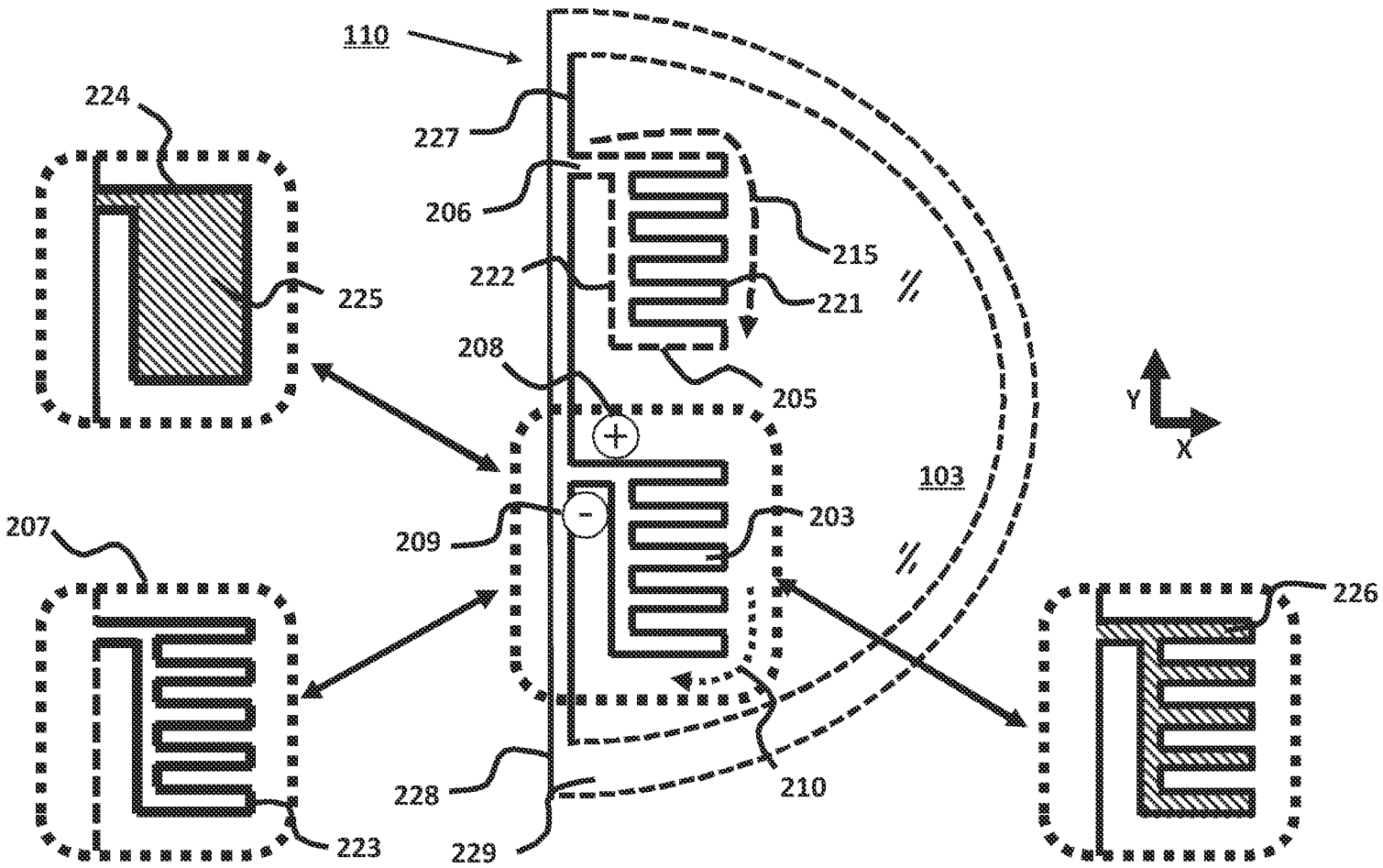
FIGS. 5*a* to 5*c* show examples of apertures on a low emissivity surface.
Figure 5B:
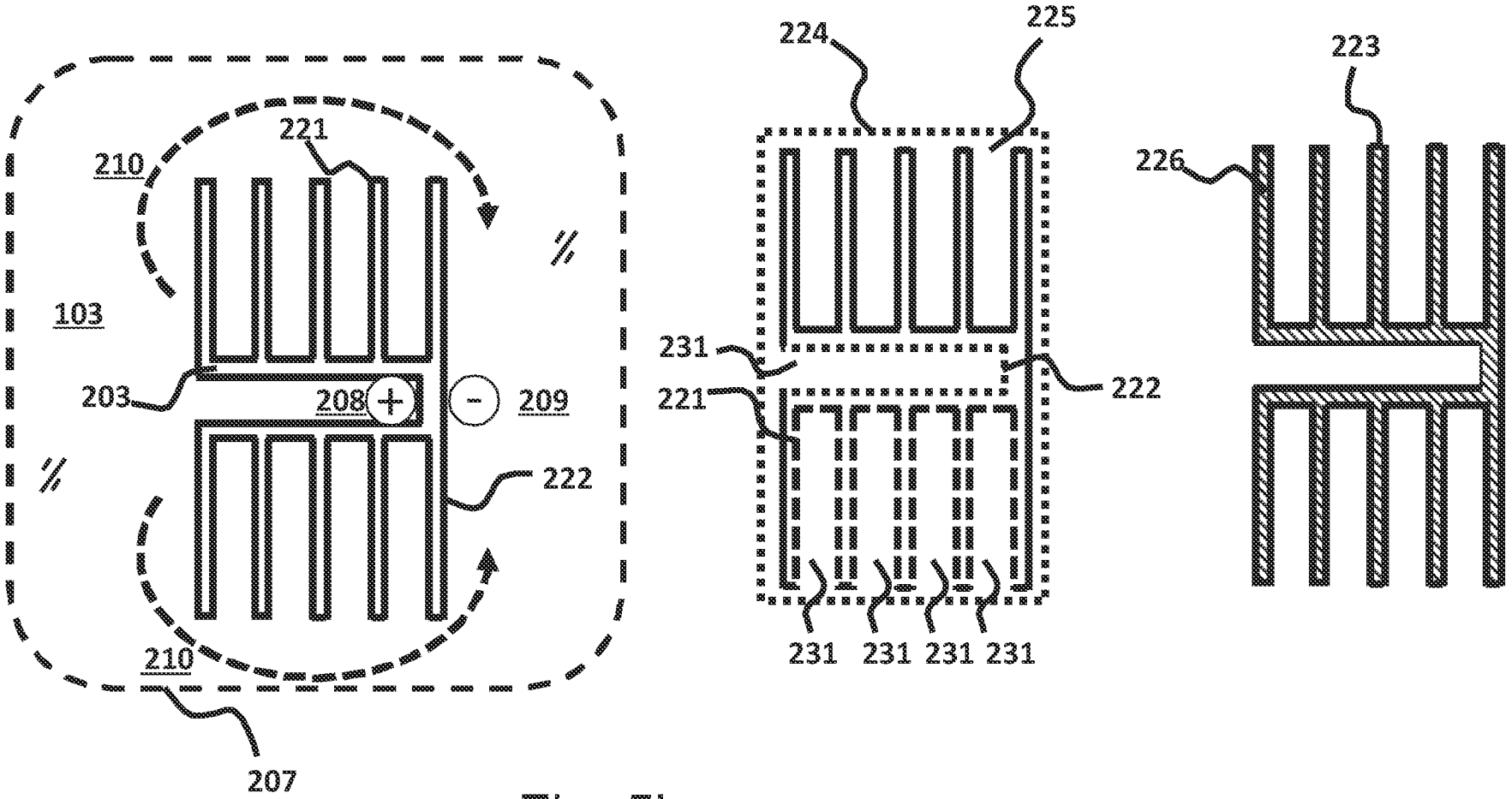
Figure 5C:
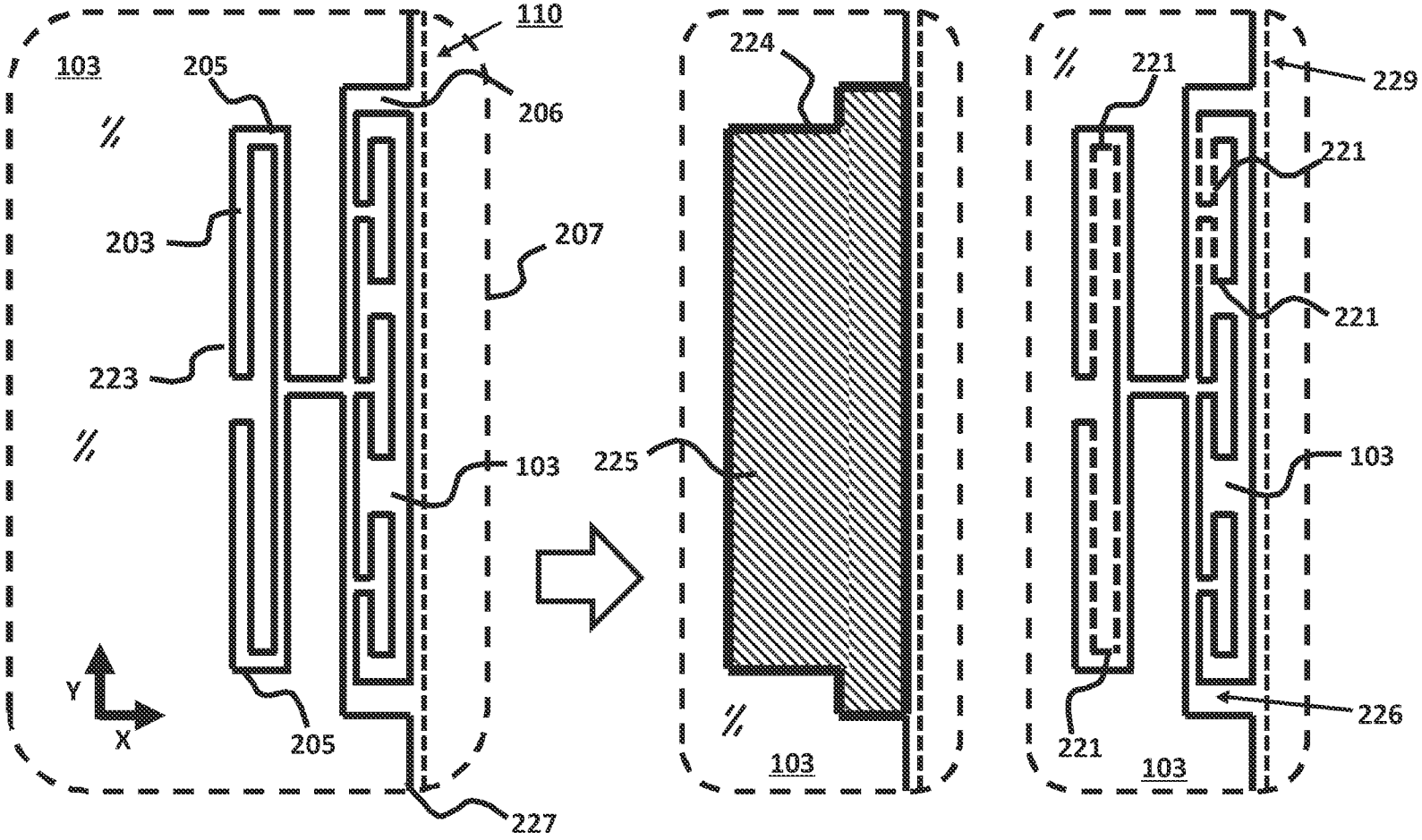

FIGS. 5*a* to 5*c* show examples of building materials 110 according to advantageous embodiments of the present disclosure.

FIG. 5*a* shows a building material 110 according to an advantageous embodiment of the present disclosure, wherein the building material 110 is an aluminium-coated thermal insulation board comprising at least one electrically conductive low emissivity surface 103 equipped with an opening 203 for boosting the transmission of an electromagnetic signal through the building material, the opening having a substantially lower electrical conductivity than the low emissivity surface 103. In the exemplary embodiment of FIG. 5*a*, the edge of the opening 203 arranged in said low emissivity surface 103 forms at least one closed edge curve 223, and said opening 203 defines a closed envelope curve 224 so that said opening 203 is within the closed envelope curve 224, and the surface defined by the closed envelope curve 224 has an area 225 substantially larger than the area 226 of the opening 203 inside the closed envelope curve 224, and a length substantially smaller than the length of the closed envelope curve 224, whereby at least one such area 231 of the low emissivity surface 103 is formed inside the area defined by the closed envelope curve 224, at which the closed envelope curve 224 is not congruent with the edge curve 223.

The exemplary building material 110 of FIG. 5*a* comprises a low emissivity surface 103 comprising an opening 203 whose closed edge curve 223 is configured to be congruent with the closed edge curve 227 delimiting the low emissivity surface 103. Said low emissivity surface 103 is provided on the surface of a dielectric material 229, wherein said dielectric material is delimited by a closed edge curve 228. Said dielectric material is a thermal insulation material having a density preferably lower than 200 kg/m$^3$. Materials which may be used for said thermal insulation material include, for example, EPS, XPS, PIR, or PUR foams, or corresponding dielectric materials made of plastic. Said low emissivity surface 103 may be provided with, for example, an aluminium coating.

The low emissivity surface 103 of FIG. 5*a* comprises an opening 203 which is configured to form at least one positive 208 and one negative 209 charge distribution which act as poles for the surface current formed on the low emissivity surface 103, by the effect of the electromagnetic signal oscillating in the first polarization and impinging on the building material 110, as well as an electric field vector oscillating in the first polarization within the opening 203, between its two edges, wherein the electric field vector in combination with said surface current formed in the low emissivity surface 103 generates a resonance circuit for forming a slot radiator 207 operating as a focused radiation source 303 in the first polarization, for boosting the transmission of the electromagnetic signal through the building material.

The closed edge curve 223 of the exemplary opening 203 of FIG. 5*a* comprises a first edge curve section 221 and a second edge curve section 222, wherein the first edge curve section 221 is arranged to be sinuous. The width of said opening 203 is not uniform but varies as a function of the location. The sinuous arrangement of said edge curve section provides effects which are advantageous to the operation of the slot radiator 207. The sinuous edge curve section 221 has an effect lengthening the flow path of the resonating surface current formed in the low emissivity surface 103, whereby the resonating dimension of the opening 203 becomes longer and the resonant frequency of the opening 203 is shifted to lower frequencies. This has an effect reducing the size of the opening 203, because the frequency shift is normally compensated for by reducing the size of the slot radiator 207. This, in turn, has an effect reducing thermal loss in the low emissivity surface 103. The maximum of the resonating current loop 210 is typically placed in the area of the shorted-out end 205 of the opening 203. In many cases, the area of the open end 206 of the opening comprises a maximum value for the electric field determining the electromotive force formed within the opening. Said open end 206 may be formed if the closed edge curve 223 of the opening is configured to be congruent with the closed edge curve 227 delimiting the low emissivity surface 103.

Arranging at least one edge of the opening to be sinuous may improve the radiation properties of the slot radiator 207, because increasing the closed envelope curve 224 delimiting the opening 203 has the same effect on the impedance matching and the bandwidth as increasing the opening 203. Arranging said edge curve to be sinuous may also induce new resonances at new frequency ranges, or in new polarizations, in the opening, wherein a single opening 203 may be provided with several focused radiation sources 303 at different frequency ranges and for different polarization components.

The low emissivity surface 103 of FIG. 5*a* is provided with an array of slot radiators 202 comprising two said slot radiators 207, wherein the focused radiation sources 303 comprised by said slot radiators 207 are arrayed in a vertical row. The vertical distance between two adjacent focused radiation sources 303 is preferably arranged not greater than one wavelength at the lowest resonance frequency of said slot radiators 207, and said vertical row may be arranged to be preferably straight or sinuous.

FIG. 5*b* shows a building material 110 according to an advantageous embodiment of the present disclosure, comprising at least one electrically conductive low emissivity surface 103 equipped with an opening 203 for boosting the transmission of an electromagnetic signal through the building material, the opening having a substantially lower electrical conductivity than the low emissivity surface 103. In the exemplary embodiment of FIG. 5*b*, the edge of the opening 203 arranged in said low emissivity surface 103 forms at least one closed edge curve 223, and said opening defines a closed envelope curve 224 so that said opening 203 is within the closed envelope curve 224, and the surface defined by the closed envelope curve 224 has an area substantially larger than the area of the opening 203 inside the closed envelope curve 224 and a length substantially smaller than the length of the closed envelope curve 224, whereby at least one such area 231 of the low emissivity surface 103 is formed within the closed envelope curve 224, at which the closed envelope curve 224 is not congruent with the edge curve 223.

The exemplary building material 110 of FIG. 5*b* comprises a low emissivity surface 103 comprising an opening 203 whose closed edge curve 223 is configured to constitute a closed edge curve separated from the closed edge curve 227 delimiting the low emissivity surface 103.

The low emissivity surface 103 of FIG. 5*b* comprises an opening 203 which is configured to form at least one positive 208 and one negative 209 charge distribution which act as poles in the surface current formed on the low emissivity surface 103, by the effect of the electromagnetic signal oscillating in the first polarization and impinging on the building material 110, as well as an electric field vector oscillating in the first polarization within the opening 203, between its two edges, wherein the electric field vector in combination with said surface current formed in the low emissivity surface 103 generates a resonance circuit for forming a slot radiator 207 operating as a focused radiation source 303 in the first polarization, for boosting the transmission of the electromagnetic signal through the building material.

The closed edge curve 223 of the exemplary opening 203 of FIG. 5*b* comprises a first edge curve section 221 and a second edge curve section 222, wherein both the first edge curve section 221 and the second edge curve section 222 are arranged to be sinuous. The width of said opening 203 is not uniform but varies as a function of the location. The sinuous arrangement of said edge curve sections provides effects which are advantageous to the operation of the slot radiator 207. The sinuous edge curve section has a lengthening effect on the flow path of the resonating surface current formed in the low emissivity surface 103, whereby the resonating dimension of the opening 203 becomes longer and the resonant frequency of the opening 203 is shifted to lower frequencies. This has an effect reducing the size of the opening 203, because the frequency shift is normally compensated for by reducing the size of the slot radiator 207. This, in turn, has an effect reducing thermal loss in the low emissivity surface 103.

FIG. 5*c* shows a building material 110 according to an advantageous embodiment of the present disclosure, wherein the building material comprises at least one electrically conductive low emissivity surface 103 equipped with an opening 203 for boosting the transmission of an electromagnetic signal through the building material, the opening having a substantially lower electrical conductivity than the low emissivity surface 103. In the exemplary embodiment of FIG. 5*c*, the edge of the opening 203 provided in said low emissivity surface 103 constitutes at least one closed edge curve 223, and said opening defines a closed envelope curve 224 so that said opening 203 is within the closed envelope curve 224, and the surface defined by the closed envelope curve 224 has an area substantially larger than the area of the opening 203 within the closed envelope curve 224 and a length substantially smaller than the length of the closed envelope curve 224, whereby at least one such area 231 of the low emissivity surface 103 is formed within the area defined by the closed envelope curve 224, at which the closed envelope curve 224 is not congruent with the edge curve 223.

The exemplary building material 110 of FIG. 5*c* comprises a low emissivity surface 103 comprising an opening 203 whose closed edge curve 223 is configured to be congruent with the closed edge curve 227 delimiting the low emissivity surface 103. Said low emissivity surface 103 is provided on the surface of a dielectric material 229, wherein said dielectric material is delimited by a closed edge curve 228.

The closed edge curve 223 of the exemplary opening 203 of FIG. 5*c* comprises a first edge curve section 221 which is arranged to be sinuous. The width of said opening 203 is not uniform but varies as a function of the location. The sinuous arrangement of said edge curve section provides effects which are advantageous to the operation of the slot radiator 207. The sinuous edge curve section 221 has an effect lengthening the flow path of the resonating surface current formed in the low emissivity surface 103, whereby the resonating dimension of the opening 203 occurring at different frequencies becomes longer and the resonant frequency of the opening 203 is shifted to lower frequencies. This has an effect reducing the size of the opening 203, because the frequency shift is normally compensated for by reducing the size of the slot radiator 207. This, in turn, has an effect reducing thermal loss in the low emissivity surface 103.

The maximum of the resonating current loop 210 is typically found in the area of the shorted-out end 205 of the opening 203 at a single resonant frequency. In many cases, the area of the open end 206 of the opening comprises a maximum value for the electric field determining the electromotive force 204 induced within the opening. Said open end 206 may be formed if the closed edge curve 223 of the opening is configured to be congruent with the closed edge curve 227 delimiting the low emissivity surface 103.

Arranging at least one edge of the opening to be sinuous may improve the radiation properties of the slot radiator 207, because increasing the closed envelope curve 224 delimiting the opening 203 has the same effect on the impedance matching and the bandwidth as increasing the opening 203. Arranging said edge curve to be sinuous may also induce new resonances at new frequency ranges, or in new polarizations, in the opening, wherein a single opening 203 may be provided with several focused radiation sources 303 at different frequency ranges and for different polarization components.

The low emissivity surface 103 according to an advantageous embodiment of the present disclosure, shown in FIG. 5*c*, is provided with several said radiation sources 303 whose operating frequencies and polarization planes deviate from each other.

Operation of a Single Narrow Linear Opening as a Focused Radiation Source

An arrangement similar to an advantageous embodiment of the building material 110 according to the present disclosure comprises a slot radiator array 202 formed of narrow openings arranged in a low emissivity surface 103, wherein a current loop 210 encircling the narrow linear opening 203 together with an electromotive force 204 effective across the narrow linear opening 203 constitutes a resonance circuit which acts as a focused radiation source 303.

Figure 6C:
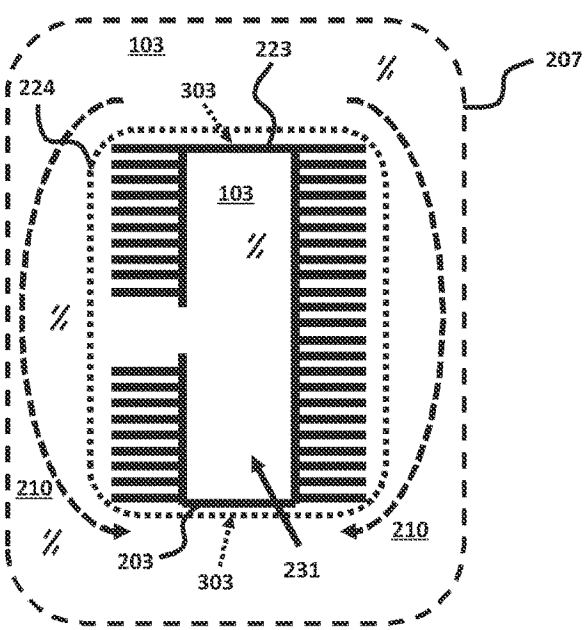
FIGS. 6*a* to 6*c* show examples of apertures on a low emissivity surface according to advantageous embodiments of the present disclosure.
Figure 6B:
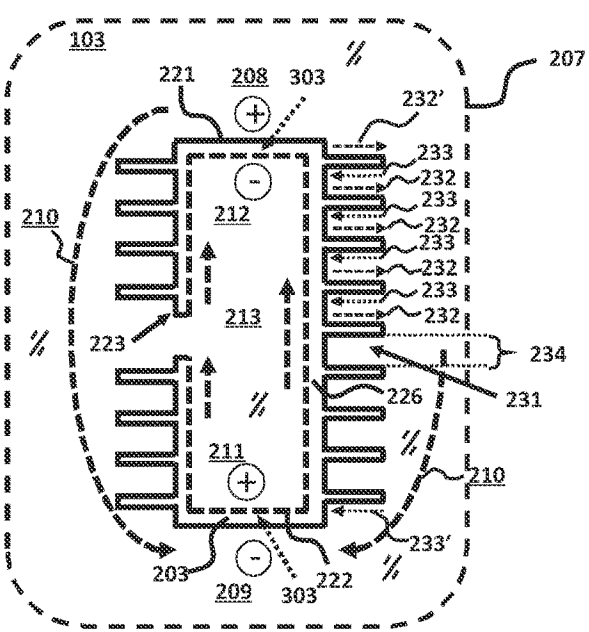
Figure 6A:
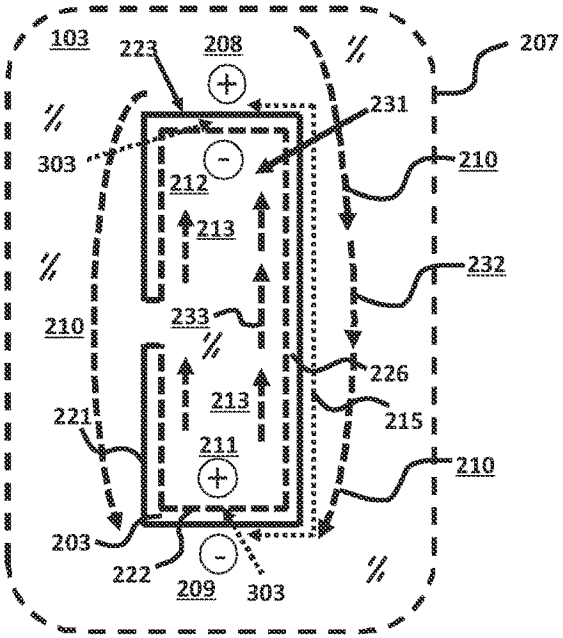

FIGS. 6*a* to 6*c* show some examples of openings 203 according to advantageous embodiments of the present disclosure in a low emissivity surface 103. FIG. 6*a* shows an example of a slot radiator 207 according to the present disclosure arranged in a low emissivity surface 103. FIG. 6*b* shows another example of a slot radiator 207 according to the present disclosure arranged in a low emissivity surface 103, and FIG. 6*c* shows how the solution shown in FIG. 6*b* can be arranged in a low emissivity surface 103 e.g. by means of a single sinuous or branched line burned by a laser.

It is typical of the examples shown in FIGS. 6*a* to 6*c* that the opening 203 provided in the low emissivity surface 103 boosts the propagation of an electromagnetic signal through a building material, and that the electrical conductivity of said opening is substantially lower than the electrical conductivity of said low emissivity surface 103. Furthermore, it is typical of said opening 203 that the edge of the opening 203 provided in said low emissivity surface 103 constitutes at least one closed edge curve 223, and said opening defines a closed envelope curve 224 so that said opening 203 is within the closed envelope curve 224, and the surface defined by the closed envelope curve 224 has an area substantially larger than the area of the opening 203 within the closed envelope curve 224, and a length substantially smaller than the length of the closed envelope curve 224, whereby at least one such area 231 of the low emissivity surface 103 is formed within the area defined by the closed envelope curve 224, at which the closed envelope curve 224 is not congruent with the edge curve 223.

Moreover, it is typical of the examples shown in FIGS. 6*a* to 6*c* that the opening 203 provided in the low emissivity surface 103 is configured to form at least one positive 208 and one negative 209 charge distribution which act as poles for the surface current formed on the low emissivity surface 103, by the effect of the electromagnetic signal oscillating in the first polarization and impinging on the building material 110, as well as an electric field vector oscillating in the first polarization within the opening 203, between its two edges, wherein the electric field vector in combination with said surface current formed in the low emissivity surface 103 generates a resonance circuit for forming a slot radiator 207 operating as a focused radiation source 303 in the first polarization, for boosting the propagation of the electromagnetic signal through the building material.

FIG. 6*a* shows an advantageous embodiment of a slot radiator 207 according to the present disclosure, wherein the narrow linear opening 203 is configured to produce a first positive charge distribution 208 and a first negative charge distribution 209 at the edges of the narrow linear opening, and wherein the electromotive force 204 induced by these two charge densities with opposite signs is effective in the non-conductive area defined by the edge curve of the narrow linear opening 203.

In the slot radiator 207 shown in FIG. 6*a* and formed by a narrow opening 203 similar to an advantageous embodiment of the present disclosure, the resonating dimension 215 of the resonant circuit is configured to be preferably half the wavelength at the oscillating frequency of the incoming planar wave 301. Said resonant circuit of said slot radiator 207' may be advantageously arranged to resonate at a frequency between 600 MHz and 6000 MHz. Said resonant circuit of said slot radiator 207' may also be advantageously arranged to resonate at a frequency between 300 MHz and 30 GHz.

FIG. 6*b* shows an advantageous embodiment of a slot radiator 207 according to the present disclosure, wherein the narrow opening 203 is configured to produce a first positive charge distribution 208 and a first negative charge distribution at the edges of the narrow opening, and wherein an electromotive force 204 induced by these two charge densities with opposite signs is effective in the non-conductive area defined by the edge curve of the narrow linear opening 203.

The electromotive force 204 comprised by the slot radiator, as well as the current loop 210 coupled to it, constitute a resonating system oscillating at a resonance frequency. Advantageously, said resonant frequency may be arranged for one or more frequencies in the frequency range from 300 MHz to 30 GHz.

The arrangement according to an advantageous embodiment of the present disclosure, shown in FIG. 6*b*, further comprises an area comprised by the low emissivity surface 103 in the region of the narrow area 203 defined by an edge curve and configured to form a second positive charge distribution 211 and a second negative charge distribution 212, whereby the arrangement presented herein is configured to generate two electromotive forces 204 which, each alone, act as focused radiation sources 303 and which induce electromagnetic radiation forming a coherent wave front 302 propagating in the shadow region.

In the slot radiator 207 shown in FIG. 6*b* and formed by a narrow opening 203 according to an advantageous embodiment of the present disclosure, the resonating dimension 215 is configured to be preferably half the wavelength at the oscillating frequency of the incoming planar wave 301.

An implementation according to an advantageous embodiment of the present disclosure compensates for a reduction in efficiency which is typically due to losses of a low emissivity surface with low electric conductivity, by providing sections of openings 203 in the low emissivity surface, which form differential currents, close to each other so that the currents which reduce the radiation efficiency partly offset each other, whereby the proportion of current modes having a positive effect on the increase of the radiation efficiency around the slot radiator increases. Said currents to be offset are generated close to each other in the same electrically conductive area of the low emissivity surface so that they are not significantly isolated by the opening provided between the currents.

The examples of 6*a* and 6*b* further include an area delimited by the edge curve of the narrow opening 203 and configured to form the first positive charge distribution 211 and the second negative charge distribution 212, whereby the arrangement presented herein comprises two electromotive forces 204 which, each alone, act as focused radiation sources 303 and which induce electromagnetic radiation forming a coherent wave front 302 propagating in the shadow region. The examples also describe a return current 213 formed between the second positive charge distribution 211 and the second negative charge distribution 212. The flowing direction of said return current 213 in the examples of FIGS. 6*a* and 6*b* is opposite to the direction of propagation of the current loop 210. In a slot radiator similar to the arrangement shown in FIGS. 6*a* and 6*b*, said return current 213 forms a differential surface current, in which the current loop 210 and the return current 213 flow close to each other in opposite directions. A transfer line conveying opposite currents flowing close to each other, such as a section of a narrow opening, does not constitute an efficient radiator of electromagnetic energy, and in accordance with the example of FIGS. 6*a* and 6*b*, the electric fields induced by coherent electromotive forces 204 constitute the sources of the actual radiation, wherein said electromotive forces 204 are induced between charge distributions 208 and 212, as well as 211 and 209, of opposite signs. In the arrangements of FIGS. 6*a* and 6*b*, the currents 210 and 213 flowing in opposite directions form a differential pair in which the differential currents are concentrated in the section of the slot radiator 207 where current concentrates at the edges of the narrow opening 203 and where the surface current flows in the electroconductive area comprised by the low emissivity surface 103.

The slot radiator 207 shown in the examples of FIGS. 6*a* and 6*b* comprises two concentrated radiation sources 303, wherein said radiation sources 303 comprise sections of the narrow opening 203 of the low emissivity surface 103, in which the surface current formed at the opposite electroconductive edges of the narrow opening 203 comprises differential current elements flowing in opposite directions, wherein said differential current elements are determined according to the current 210 and the return current 213, and wherein the sections of the opening 203, comprising the differential current elements present in the low emissivity surface 103, are arranged in an interlaced manner. FIG. 6*a* illustrates a differential current element 232 and an opposite returning differential current element 233, wherein said differential current elements are present in a section of the slot radiator 207 and wherein said currents are present at the electroconductive edges of the opening 203, said edges being partly interlaced and close to each other.

Said differential currents comprise the differential current element 232 and the opposite current element 233 flowing close to said current element 232. In the structure shown in FIG. 6*a*, the distance between said differential currents is determined by the width of the narrow opening 203 in the section where said currents are induced by external excitation. The width of the narrow opening 203, for example in the case of a single line implemented by laser, may typically be 10 to 100 um, or in the case of an area opened by laser, its width may also be, for example, 0.1 to 2 mm. Furthermore, when implemented with some mechanical tools, the width of the narrow opening may be 5 to 10 mm.

The closed edge curve 223 of the exemplary opening 203 of FIG. 6*b* comprises a first edge curve section 221 and a second edge curve section 222, wherein both the first edge curve section 221 and the second edge curve section 222 are arranged to be sinuous. The width of said opening 203 is not uniform but varies as a function of the location. The sinuous arrangement of said edge curve sections provides effects which are advantageous to the electrical operation of the slot radiator 207. The sinuous edge curve section has a lengthening effect on the flow path of the resonating surface current formed in the low emissivity surface 103, whereby the resonating dimension of the opening 203 becomes longer and the resonant frequency of the opening 203 is shifted to lower frequencies. This has an effect reducing the size of the opening 203, because the frequency shift is normally compensated for by reducing the size of the slot radiator 207. This, in turn, has an effect reducing thermal loss in the low emissivity surface 103.

FIG. 6*b* shows how the sinuous edge curve section of the opening can have a lengthening effect on the flow path of the current loop 210 in an advantageous embodiment of the present disclosure. Moreover, a particular phenomenon improving the electrical operation of the slot radiator is achieved by forcing the current loop 210 and the return current 213 of said current loop 210 to flow at a greater distance from each other, where said current loop 210 and said return current 213 flow at separate edges of the opening 203 in the low emissivity surface. This phenomenon has a particularly advantageous effect on the efficiency of the slot radiator, on the bandwidth, as well as on the possibilities of controlling the impedance present in the resonance. Said control of the impedance is also influenced by the electromotive force induced within the opening 203, whose location and strength may be controlled by arranging an edge curve of the opening to be meandering. Said phenomenon, in which the efficiency and the bandwidth of the slot radiator are improved, can be explained by the fact that so-called differential currents which typically flow in opposite directions are not efficient radiators if the opposite currents flow close to each other. When the differential surface current is interfered according to example described, the operation of the structure as a radiator can be made more efficient.

The implementation of an advantageous embodiment of the present disclosure is shown in FIGS. 6*b* and 6*c*, in which the edge of the narrow opening 203 comprises a section arranged to have a sinuous shape so that an electroconductive area 231 is delimited from the low emissivity surface 103, within the area delimited by the closed envelope curve, at which electroconductive area 231 the closed envelope curve 224 around the slot radiator is not congruent with the closed edge curve 223 of the opening 203. Said area 231 may be advantageously configured in such a way that a section 221 of the edge curve, delimiting the electroconductive area 231, defines two or more sections of the openings 203 which are arranged to be at least partly interlaced. Said sections are arranged at a distance 234 from each other, wherein the distance 234 delimits the distance between the differential current elements formed in the electroconductive area 231, wherein said differential current elements flow at opposite edges of the uniform conductive area. In an arrangement according to an advantageous embodiment of the present disclosure, said distance 234 is arranged to have a length shorter than one tenth of the wavelength of the operating frequency. As an example, it may be mentioned that for slot radiators operating in frequency ranges close to, for example, 800 and 900 MHz, differential current elements spaced from each other by a distance shorter than 50 mm begin to offset each other, and at a distance shorter than 10 mm the offsetting effect of the currents is already significant. When the distance 234 between the differential current elements is shorter than 5 mm, the opposite current elements 232 and 233 within the area 231 delimited by the interlaced sections of the opening 203 offset each other in the lateral direction, and the surface current in the direction of the current defining the current loop 210 increases in said conductive areas.

In an advantageous embodiment of the disclosure, said at least one opening 203 is configured to generate an electric field so that said at least partly interlaced edges are interlaced in the direction of the electric field effective across the edges.

FIG. 6*b* shows the formation of the differential current elements 232 and 233 in the sections formed by the section 221 of the edge curve of the opening 203, wherein the sections of the edge of the aperture are arranged to be partly interlaced. The electromagnetic energy carried by an incoming plane wave 301 excites opposite charge distributions at the edges of the openings 203 provided in the low emissivity surface 103. Said charge distributions act as sources for a surface current 210, wherein said surface current 210 is divided into a common and a differential current modes in the area of the low emissivity surface 103 comprised by an aperture 201 for transmitting radio signals and defined by a closed envelope curve 224. For the sake of illustration, FIG. 6*b* shows differential current elements 232' and 233' separated from other marked current elements 232 and 233. Said current elements 232' and 233' have a greater amplitude than said other current elements 232 and 233, because the latter current elements are now arranged to offset each other in the structure according to an advantageous embodiment of the present disclosure. The arrangement presented makes the sinuous edge curve 221 behave like a wide opening in the low emissivity surface. The presented arrangement improves the efficiency and the bandwidth of the narrow opening 203 used as the slot radiator, particularly if the width of the opening 203 is smaller than 500 um and if the opening is implemented in a low emissivity surface used as an unideal electric conductor.

FIG. 6*c* further illustrates the implementation of an opening 203 similar to the example of FIG. 6*b* by a device producing the narrow opening, such as a laser. The opening 203 may be provided in the low emissivity surface 103 preferably by using a single sinuous or branched line. Said line may have a width preferably smaller than 200 μm.

Figure 7B:
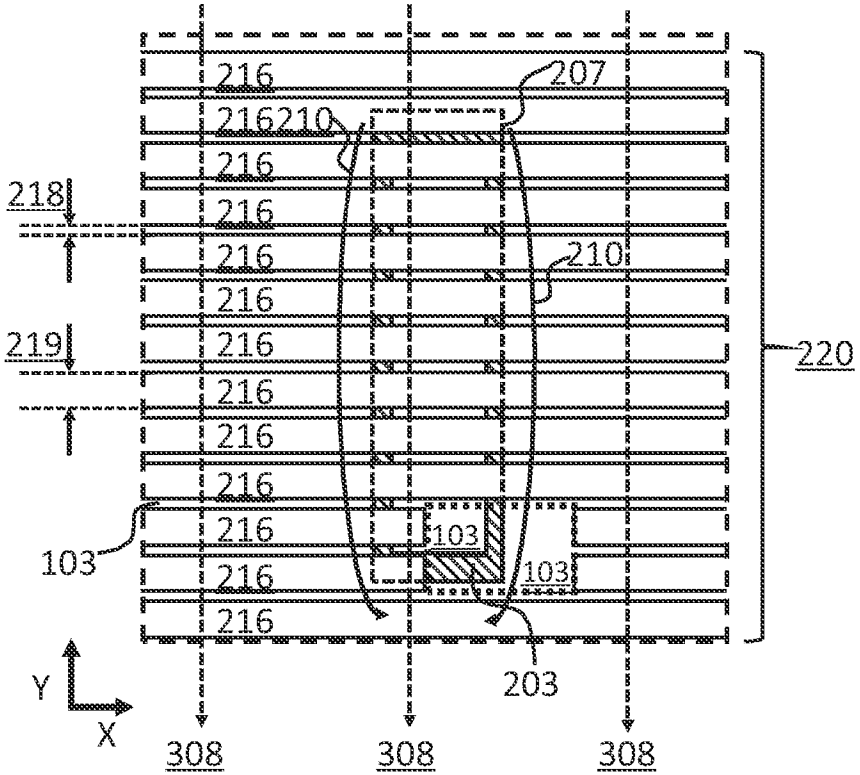
FIGS. 7*a* to 7*c* show slot radiators of an array of slot radiators comprised by an aperture for transmitting radio signals arranged in connection with a lattice structure according an advantageous embodiment of the present disclosure
Figure 7A:
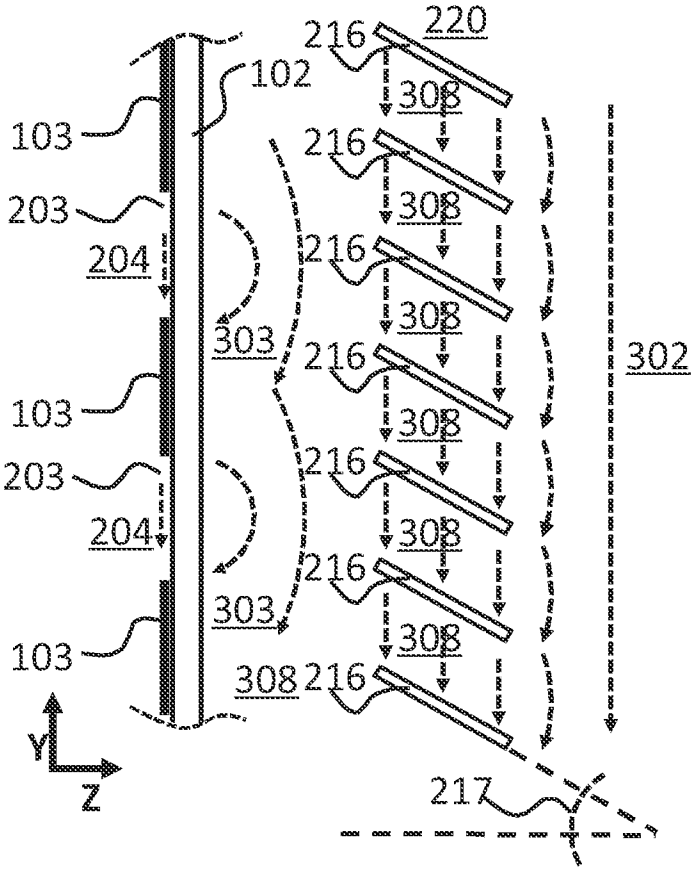
Figure 7C:
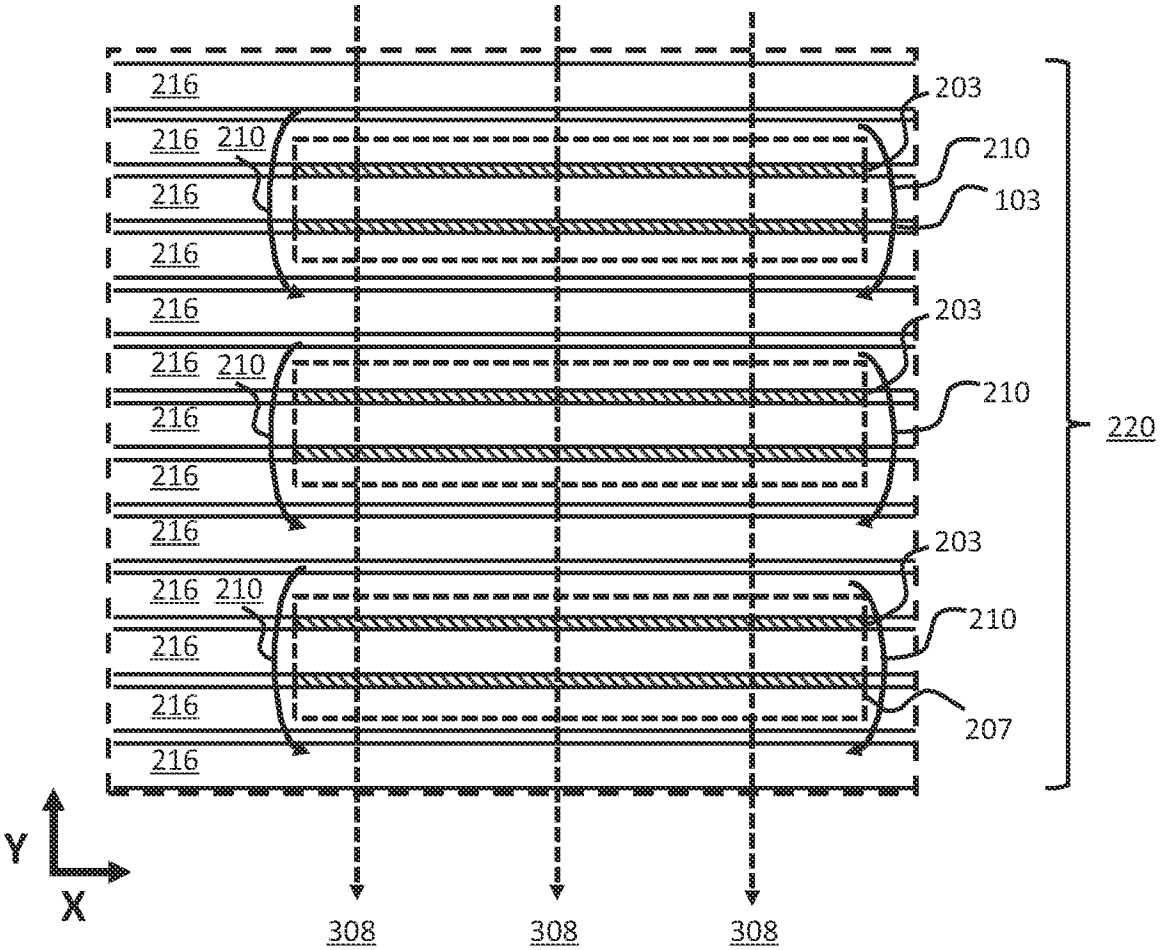

Vertically Polarized Slot Radiators in Connection with a Conductive Lattice Structure A narrow opening 203 according to an advantageous embodiment of the present disclosure can be used for boosting the transmission of electromagnetic energy of a planar wave 301 through an electrically conductive lattice structure 220. The electrically conductive lattice structure 220 may comprise window blinds made of metal. The electrically conductive lattice structure may also comprise a frequency selective surface provided in another low emissivity surface 103. FIGS. 7*a* to 7*c* show an example of such a structure.

Normally, horizontal blinds comprise several thin metal slats 216 whose position 217 may be turned to adjust the quantity of light passing through the window. Metal slat blinds are known to disturb the transmission of electromagnetic energy through a window. For example, U.S. Pat. No. 5,364,685 A (Central Glass Company) discloses the transmission properties of a conductive lattice structure implemented in two orientations in a selective glass surface. In the patent, measurements show that when the polarization of an incoming wave is parallel to the slats of the lattice structure, the dampening is significant, whereas when the polarization is orthogonal to the direction of the slats, the transmission is more efficient. In the case of metal slat blinds, this means strong disturbance in the transmission of horizontal polarization when the metal slat blinds are oriented horizontally.

In addition to the attenuation of the transmitting wave, the metal slats may disturb the operation of the frequency selective surface implemented in the selective film to a significant extent. The closeness of the metal slats may disturb the operation of frequency selective surface in at least two ways. The first disturbance in the operation of the surface is caused by loading in the near field, caused by the metal in the vicinity. This means that the metal parts of the metal slat blinds are connected as part of the filter elements of the frequency selective surface in an uncontrolled manner and tune their operating frequency and transmission impedance in an undesired way. Another disturbance in the operation of the frequency selective surface is caused by undesired reflections from an uncontrolled metal slat. In other words, part of the signal of the electromagnetic wave is reflected from the metal parts of the metal slat blinds, heading back to the direction of incidence.

FIGS. 7*a*, 7*b* and 7*c* show slot radiators 207 of a slot radiator array 201 comprised by an aperture 201 according to an advantageous embodiment of the present disclosure for transmitting radio signals, wherein the slot radiators 207 formed by narrow linear openings 203 are configured to receive a planar wave 301 and/or to re-emit a coherent wave front 302 through a conductive lattice structure 220 at least partly in a vertically polarized form.

The conductive lattice structure 220 comprises several conductive slats 216, preferably positioned in a horizontal plane and arranged at an angle 217 in the vicinity of the present low emissivity surface 103. The orientation 217 of the conductive slat 216 defines a projection 218 of the conductive slats of the lattice structure in the low emissivity surface. Correspondingly, the orientation 217 of the conductive slat 216 also defines a projection 219 of the non-conductive areas of the lattice structure in the low emissivity surface.

In an advantageous embodiment of a slot radiator 207 comprised by the aperture 201 according to the present disclosure for transmitting radio signals, a narrow opening 203 is configured to produce, from the electric field vector 308 of the incoming planar wave 301, a first positive charge distribution 208 and a first negative charge distribution at the edges of the narrow opening, and wherein the electromotive force 204 induced by these two charge densities with opposite signs is effective in the non-conductive area defined by the edge curve of the narrow opening 203, and wherein the electromotive force 204 is arranged to be at least partly vertical. The arrangement according to an advantageous embodiment of the slot radiator 207 presented herein further comprises a shorted-out end 205 formed by the narrow linear opening 203, and a current loop 210 encircling this shorted-out end 205. The electromotive force 204 comprised by the slot radiator, as well as the current loop 210 coupled to it, constitute a resonating system oscillating at a resonance frequency and emitting at least partly vertically polarized electromagnetic radiation. The narrow linear opening 203 presented herein further comprises a second shorted-out end 205 and a second current loop 210 encircling it.

An at least partly vertically polarized slot radiator 207 of the type presented herein makes it possible to transmit a wireless signal through a window comprised by metal slat blinds. The metal slat blinds comprise several metal slats oriented in the horizontal direction, but there is no electrically conductive metal contact between these. The current loop 210 encircling the shorted-out end 205 of the narrow linear opening 203 of the type presented herein comprises a current maximum having a vertical direction of flow. Any electric current flowing in the conductor will couple an electric current of an opposite direction to the surrounding conductors, but in this case, the vertically oriented current loop 210 will not switch an electric current of an opposite direction to the metal slats of the metal slat blinds, because the propagation path of the vertical current is broken in the spaces between the metal slats of the slat blinds.

An at least partly vertically polarized slot radiator 207 of the type presented herein is configured to generate an electromotive force 204 oriented at least partly in the vertical direction. This electromotive force does not couple a uniform surface current mat in the direction of the electrical field to the metal slats of the metal slat blinds, because the propagation path of the vertical current is broken in the spaces between the metal slats of the slat blinds.

An at least partly vertically polarized slot radiator 207 of the type presented herein makes it possible to receive and transmit electromagnetic energy through an insulating glass unit 100 comprising an aperture 201 for transmitting radio signals when the insulating glass unit 100 is arranged in a window that comprises metal slat blinds.

The implementation of the type of an advantageous embodiment of the present disclosure comprises an insulating glass unit 100 in which the aperture 201 for transmitting radio signals is configured in a first low emissivity surface 103, as well as a second low emissivity surface 103 equipped with a planar frequency selective filter 109, wherein the frequency selective filter 109 comprises several electrically conductive slats 216 preferably arranged in a horizontal plane. The first and second low emissivity surfaces 103 may be arranged in the same insulating glass unit 100. The first and second low emissivity surfaces 103 may also be arranged in the same window, each being arranged in different casements.

A Method and an Arrangement for Reducing Conductor Losses in a Low Emissivity Surface by Offsetting Differential Current Elements The implementation according to an advantageous embodiment of the present disclosure offsets said opposite currents which reduce the radiation efficiency, whereby single narrow openings 203 can be turned into more efficient radiators. The method according to the present disclosure can be applied in narrow openings, in which the width of the openings is advantageously smaller than 200 μm, and in which single openings are arranged to be at least partly interlaced. The method can also be applied in sections of single openings 203, wherein differential currents of a single opening offset each other, in at least some sections of the opening 203 comprising concentrated radiation sources 303 in an array 202 of slot radiators. The method reduces the ratio of the differential current amplitudes to the common-mode current amplitudes in sections of the edge curves of the opening 203, which opening 203 is used as the slot radiator, wherein said currents are concentrated in the area defined by the closed envelope curve 224 defining the array 202 of slot radiators or the aperture 201 for transmitting radio signals.

The presented method is characterized in that the offsetting effect of the differential current elements is manifested in the same area of the conductive surface without leaving an electrically non-conductive area between said currents to separate them. Thus, said currents are summed up in the area of a single conductor so that opposite current elements left between said current elements flow in the electrically non-conductive opening, separated from said current elements. As an example, three electrically conductive areas can be mentioned, which are close to each other but separated by two openings. In the sections of said openings, opposite current elements may flow on respective sides of each aperture. To put it more precisely, four current elements may flow at the edges of the two openings, in parallel with the edges of the openings, wherein the two opposite current elements in the middle conductor are summed up to offset each other.

The present disclosure compensates for a reduction in efficiency which is typically due to losses in a low emissivity surface with low electric conductivity, by increasing the efficiency of a transmitted signal by a coherent wavefront formed by several concentrated slot radiators, wherein the widths 234 of the electroconductive areas between the openings 203, which openings form separate concentrated radiation sources 303, are arranged to be asymmetrical, wherein the widths 234 define distances between the sections of the openings 203 forming at least partly interlaced differential current elements. Said asymmetric distribution may comprise widths arranged to be smaller than 5 mm, and distances arranged to be greater than 10 mm.

The arrangement according to an advantageous embodiment of the present disclosure comprises several narrow openings 203 arranged close to each other so that the currents flowing at the edges of said openings interact in such a way that the summing up and partial offsetting of said currents enhance the operation of the arrangement acting as an array, with respect to the performance of openings arranged far from each other.

Figure 8A:
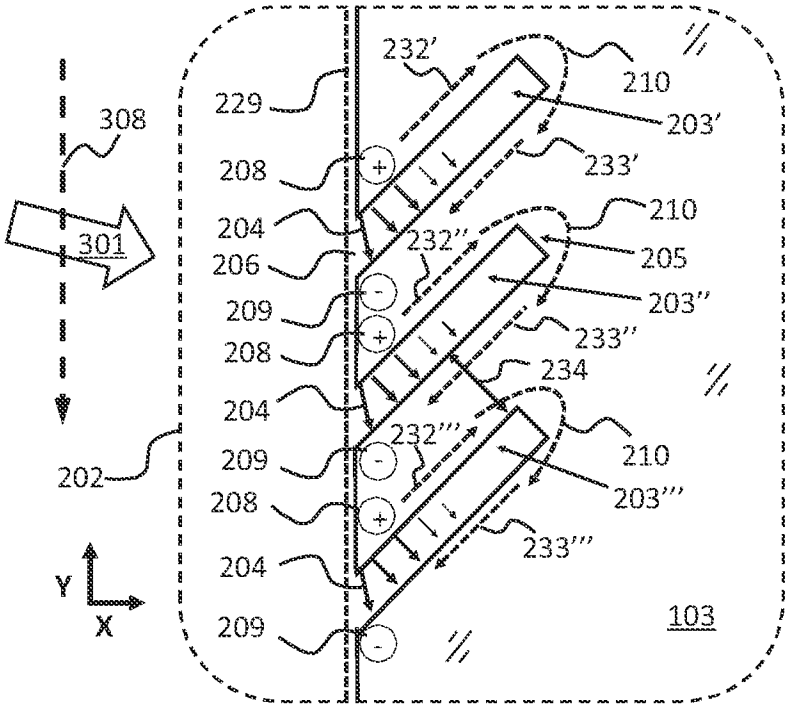
FIGS. 8*a* to 8*c* show arrangements of openings on a low emissivity surface to compensate for differential currents which decrease the radiation efficiency, according to some advantageous embodiments.

FIG. 8*a* shows an array 202 of slot radiators similar to an advantageous embodiment of the present disclosure, exemplifying three different narrow openings 203', 203" and 203''' in a low emissivity surface 103, the opening 203" being placed in the middle.

In the example of FIG. 8*a*, an electric field vector 308 of an incoming plane wave 301 induces electromotive forces 204 in the openings 203 comprised in the low emissivity surface 103 provided on the surface of a dielectric material, wherein the maximum of the electric field determined by said electromotive force is present in the area of the open end 206 of the aperture, and charge distributions 208/209 having opposite signs and currents 210 flowing in resonance around the short-circuited ends of the openings are present on each side of the aperture. For the sake of precision, said currents are illustrated by means of current loops 210 and differential current elements 232 and 233, wherein said differential current elements represent opposite currents flowing close to each other on opposite sides of the aperture, over the distance of a section of the aperture. The current element 233 may be interpreted as a return current with respect to the current element 232.

The arrangement according to an advantageous embodiment of the present disclosure comprises the arrangement of the sections of the narrow openings 203, placed close to each other, to be at least partly interlaced so that the differential current elements comprised by adjacent openings offset each other. In this way, a significant improvement is achieved in the efficiency of the narrow opening used as the slot radiator, when the slot radiator is implemented in a low emissivity surface used as an ideal conductive surface, such as a metal oxide surface of selective glass. Said interlaced sections of openings may advantageously comprise sections of a single opening which are arranged to interlace each other, by making the edge curve of the opening sinuous. Advantageously, said interlaced sections of the openings may also comprise sections of separate openings arranged to be interlaced in the way presented herein.

Said differential current elements do not function as effective radiation sources, because they flow in opposite directions at the opposite edges of a single narrow opening and thereby do not amplify each other. However, said differential currents effectively convert the electromagnetic radiation received in the slot radiator 207 provided in the low emissivity surface, into heat, by the effect of conductor losses. Coatings applied on glass surfaces typically have an electric conductivity clearly lower than that of, for example, copper, whereby resistive losses may be considerable.

When an electromagnetic wave impinges on an opening 203 provided in an electrically conductive surface and thereby forms a slot radiator acting as a new radiation source, reflection takes place at the interface between the incoming wave and the electrically conductive low emissivity surface 103, caused by the mismatching of impedances and having an intensity dependent on the difference between the wave impedance of the electromagnetic wave and the surface impedance of the low emissivity surface 103 at the different frequencies considered.

The real part of said surface impedance comprises the radiation resistance caused by the radiation loss of the slot radiator and the ohmic resistance caused by the unideal electrical conductivity of the conductor surface. Said radiation resistance represents the targeted electromagnetic energy converted into power to be re-radiated, whereas said ohmic loss resistance impairs the efficiency of the structure by converting electromagnetic energy into heat at the low emissivity surface.

In an arrangement according to an advantageous embodiment of the present disclosure, sections of openings 203 are arranged close to each other so that the differential current elements formed in the range of the sections close to each other offset each other, whereby it is possible to reduce the ohmic loss resistance of the real part of the surface impedance confronted by the electromagnetic plane wave on the low emissivity surface 103. In this way, it is possible to improve the efficiency of slot radiators provided in an unideal electric conductor with respect to slot radiators placed far from each other.

An arrangement according to an advantageous embodiment of the present disclosure comprises an arrangement of sections of narrow openings 203, placed close to each other, in an at least partly interlaced manner so that the differential current elements comprised by the adjacent openings offset each other and thereby reduce resistive losses formed in the low emissivity surface.

Part of the currents of the resonating current loop of the opening 203' shown at the top in the example of FIG. 8*a* is illustrated, in this context, with differential current elements 232' and 233'. Correspondingly, the resonating current loop of the opening 203" shown in the middle is, in this context, illustrated with differential current elements 232" and 233" and a current loop 210 circling the short-circuited end 205 of the aperture; and the resonating current loop of the opening 203''' shown at the bottom is, in this context, illustrated with differential current elements 232''' and 233''' and a current loop 210 circling the short-circuited end of the aperture. Advantageously, the openings 203', 203" and 203''' may be arranged close to each other to enhance the offsetting effect of the differential current elements. By way of non-exclusive example, an array of slot radiators resonating in the frequency range of 900 MHz can be mentioned, wherein the distance 234 between the opposite differential current elements 232 and 233 flowing at the edges of two adjacent openings 203 and offsetting each other is advantageously arranged to be shorter than 30 mm, corresponding to one tenth of the wavelength of the operating frequency. With a distance shorter than 10 mm between the current elements, the opposite currents begin to offset each other in a particularly efficient way. When the distance 234 between the differential current elements is shorter than 5 mm, the opposite current elements 232 and 233 within the area 231 delimited by the interlaced sections of the opening 203 offset each other in the lateral direction, and the surface current in the direction of the current defining the current loop 210 increases in said conductive areas.

In the example of FIG. 8*a*, the current loops forming at the edges of the openings 203', 203" and 203'" are not identical, due to the interaction of the offsetting currents. Of the differential current elements of the topmost opening 203', the current element 232' has a greater amplitude than the current element 233', because part of said surface current is offset by the current element 232" of the opening 203". Correspondingly, of the differential current elements of the lowermost opening 203'", the current element 233'" has a greater amplitude than the current element 232'". The differential current elements 232" and 233" of the middle opening 203" do not have such a severe mismatch as those of the outermost openings but they both have a reduced amplitude with respect to the outermost current elements of the outermost openings as well as to the current loop 210 circling the aperture and oscillating in the common mode.

Thanks to the above described arrangement, the narrow openings, or sections of openings, placed close to each other, advantageously at a distance smaller than one tenth of the wavelength, and interlaced each other, wherein the differential currents are significant, constitute an array, in which the differential currents offset each other but the current loops 210 circling the aperture strengthen each other, because said current loops 210 flow coherently, that is, in the same phase and in the same direction. In the example of FIG. 8*a*, the current loops 210 circling the short-circuited end of the aperture form a common-mode current pattern, wherein the currents 210 of single openings arranged close to each other form a single current pattern circling the short-circuited ends of all the interlaced openings. With the described arrangement, the currents circling the short-circuited ends of several interlaced openings constitute a current pattern closely resembling a current circling a wide aperture. As an example, a wide aperture may have a width of approximately 2 to 5 cm.

Figure 8C:
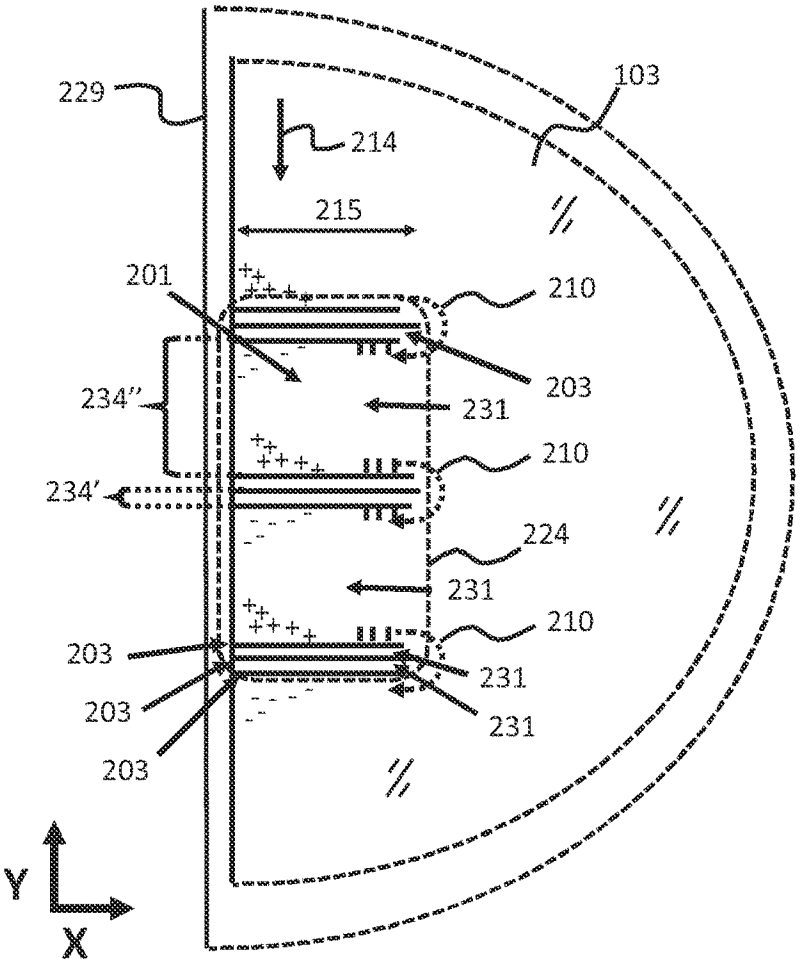
Figure 8B:
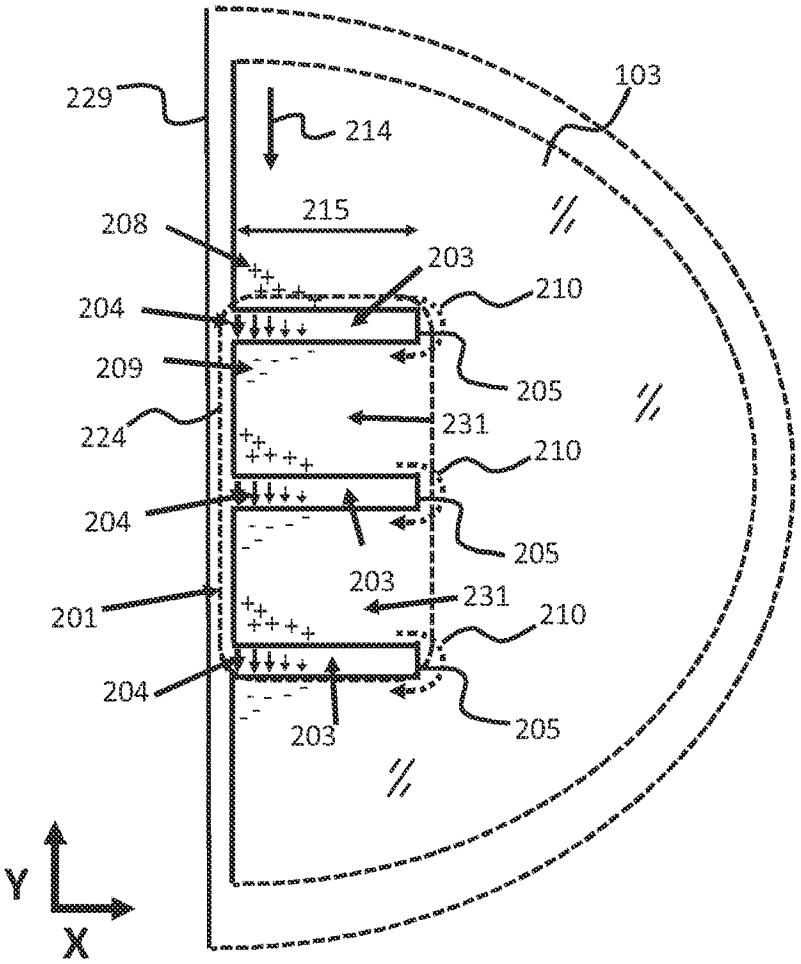

The present disclosure compensates for a reduction in efficiency which is typically due to losses of a low emissivity surface with low electric conductivity, by increasing the efficiency of a transmitted signal by a coherent wavefront formed by several concentrated slot radiators, wherein the widths 234 of the electroconductive areas between the openings 203 formed by the single concentrated radiation sources 303 are arranged to be asymmetrical in such a way that the distances 234 define distances between the sections of the openings 203 forming at least partly interlaced differential current elements, wherein said differential current elements offset each other. Said asymmetric distribution may comprise widths arranged to be smaller than 5 mm, and distances arranged to be greater than 10 mm. FIG. 8*c* shows a structure according to an advantageous embodiment of the present disclosure, wherein said openings 203 are arranged to be partly interlaced, and the distance 234 between the opposite differential current elements comprised by said openings is configured to be asymmetrical. FIG. 8*b* shows a structure according to the present disclosure with a symmetrical distribution of openings as well, wherein said openings represent slot radiators implemented to be wide. FIG. 8*c* shows an implementation in which the present method is applied to have a favourable effect on the radiation properties of narrow openings, wherein the operation of assembled narrow openings, as a slot radiator, approaches the radiation properties of apertures implemented as wide openings.

In FIG. 8*c*, current loops 210 are formed as a sum of current loops circling single openings 203, wherein opposite differential current elements formed between adjacent openings 203 offset each other, and currents circling the short-circuited ends 205 of the openings 203 are summed up at the same stage. Electromotive forces 204 induced in the electrically non-conductive areas of the single openings 203 are summed up at the same phase. In the example of FIG. 8*c*, adjacent openings 203 are separated by uniform conductive areas 231 of the low emissivity surface 103, in which the distance 234' between differential current elements offsetting each other is advantageously shorter than 5 mm. The opposite differential current elements formed in these uniform conductive areas suppress each other so that the transmitting capacity of the openings 203 acting as an array of slot radiators assembled close to each other is significantly improved, in relation to openings placed apart from each other. In the example of FIG. 8*c*, interlaced openings 203 are also separated by uniform conductive areas of the low emissivity surface 103, in which the distance 234" between differential current elements offsetting each other is arranged to be multiple with respect to the distance 234'. By the arrangement described herein, separate concentrations of assemblies of slot radiators have been created, wherein said concentrations alone act as an efficient slot radiator, and wherein the summing up of wavefronts formed by said single concentrations increases the amplification present in the radiation pattern of the building material 110 according to the present disclosure, in the targeted effective direction.

The building material 110 according to an advantageous embodiment of the present disclosure comprises at least one electrically conductive low emissivity surface 103 which is provided with at least one opening 203 for enhancing the transmission of electromagnetic signals through the building material, and the opening having a substantially lower electrical conductivity than the low emissivity surface 103, and wherein said at least one opening 203 comprises at least two sections of openings, separated by an electrically conductive area 231 of the low emissivity surface 103, wherein said sections of openings are provided with two or more narrow openings, and the distance 234" between said sections separated by an electrically conductive area 231 of the low emissivity surface 103 is multiple compared with the distance 234' between said openings in said section.

Electrical Loading of an Aperture in a Low Emissivity Surface

The implementation according to an advantageous embodiment of the present disclosure comprises a narrow opening 203 provided in a low emissivity surface 103, wherein said opening 203 is configured to act as a slot radiator 207 at an oscillation frequency having a wavelength. Furthermore, said slot radiator comprises at least a first loading area 403 and a second loading area 404, between which an electrically conductive area of the low emissivity surface 103 is provided, and within said area of the low emissivity surface 103, said opening 203 is configured to create at least one electrically non-conductive discontinuity area. According to an advantageous embodiment of the present disclosure, the slot radiator 207 between said loading areas 403 and 404 can be loaded with an impedance 405. Said impedance 405 may be arranged, for example, so that said slot radiator is configured to operate at new frequencies, or its properties of transmitting some frequencies are reduced. Moreover, the impedance of said slot radiator may be adjusted to the impedance of free space more efficiently or at new frequency ranges. Further, the impedances of single concentrated radiation sources 303 of the array 202 of slot radiators comprised by the low emissivity surface 103 may be adjusted to turn the direction of the radiation beam formed by said array of slot radiators at an operating frequency. Said loading impedance 405 may be implemented by any connecting element 402. Typical connecting elements include, for example, passive coils, resistors, capacitors, or phase shifters, each of which may be implemented by either discrete components or distributed elements, or a short or long transmission line section. The connecting elements may also include active or actively controllable loading elements, such as transistors or varactors.

Figure 9B:
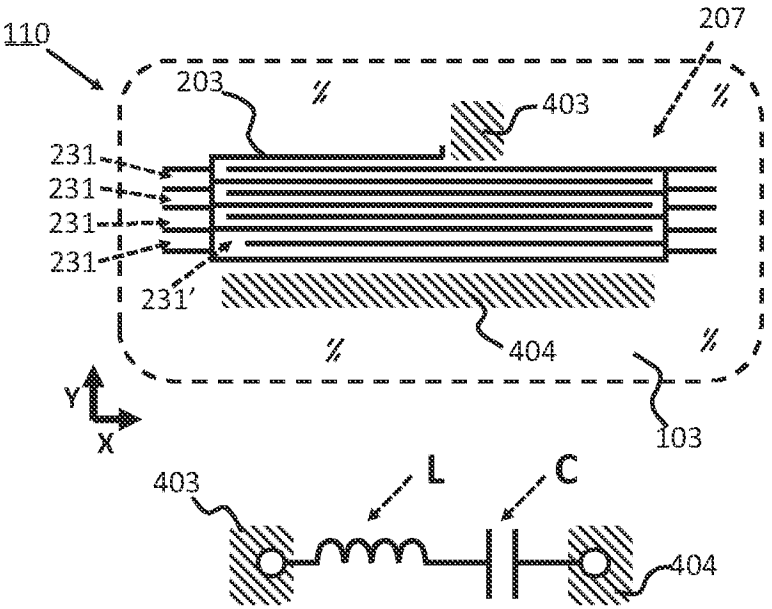
FIGS. 9*a* and 9*b* show arrangements of longitudinally distributed components on a low emissivity surface to arrange a loading impedance for the opening, according to an advantageous embodiment.
Figure 9A:
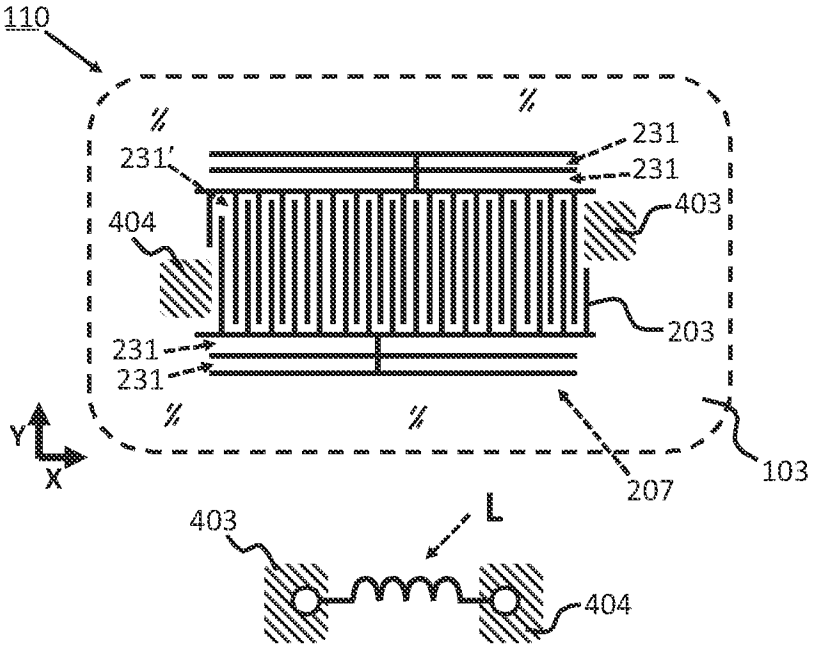

FIGS. 9*a* and 9*b* show slot radiators according to some advantageous embodiments of the present disclosure, wherein the discontinuity areas between the loading areas 403 and 404 are provided with passive distributed elements.

FIG. 9*a* shows an arrangement, in which the area between said loading areas 403 and 404 of the low emissivity surface 103 is provided with an distributed inductance, wherein said inductance is connected in parallel with two sections of the edge curve of an opening 203. Said distributed inductance may be arranged, for example, so that a section of the edge curve of the opening 203 is arranged to be sinuous. In FIG. 9*a*, said inductance is provided in the electrically conductive area 231' of the low emissivity surface 103. The parameters of said inductance depend on the geometry of the arrangement and the properties of the materials used. For example, an inductance provided in the selective surface of glass may also comprise a series resistance which may be considerably high compared with, for example, a resistance of a corresponding geometry formed in an aluminium surface. Said inductance constitutes a filter structure which is configured to constitute a parallel connection with the opening 203. Said filter structure makes up a frequency-dependent loading impedance for the slot radiator 207, wherein said loading impedance is connected in parallel with said slot radiator. Said loading impedance may comprise, for example, a high impedance approaching the loading of an open circuit, wherein the surface current formed in the low emissivity surface 103 does not substantially flow through said impedance at the frequency at which the high impedance is provided.

FIG. 9*b* shows an arrangement for forming a new resonance frequency for the slot radiator, wherein the area between the loading areas 403 and 404 of the low emissivity surface 103 is provided with a distributed inductance, as well as a capacitance connected in series with said inductance and forming a resonance circuit with it. Said resonance circuit constitutes a filter structure which is configured to constitute a parallel connection with the opening 203 and the loading areas 403 and 404. In FIG. 9*b*, said inductance is provided in the electrically conductive area 231' of the low emissivity surface 103. In FIG. 9*b*, said series capacitor forming the resonance circuit is arranged in the section between the electrically conductive area 231' and the loading area 404 in the opening 203. Said resonance circuit makes up a frequency-dependent loading impedance for the slot radiator 207, wherein said loading impedance is connected in parallel with said slot radiator.

A band-pass, band-stop, high-pass, or low-pass filter may also be provided between two discrete slot radiators 207, wherein the discrete slot radiators 207, formed by the openings 203, may be combined to create new resonance bands.

Figure 10B:
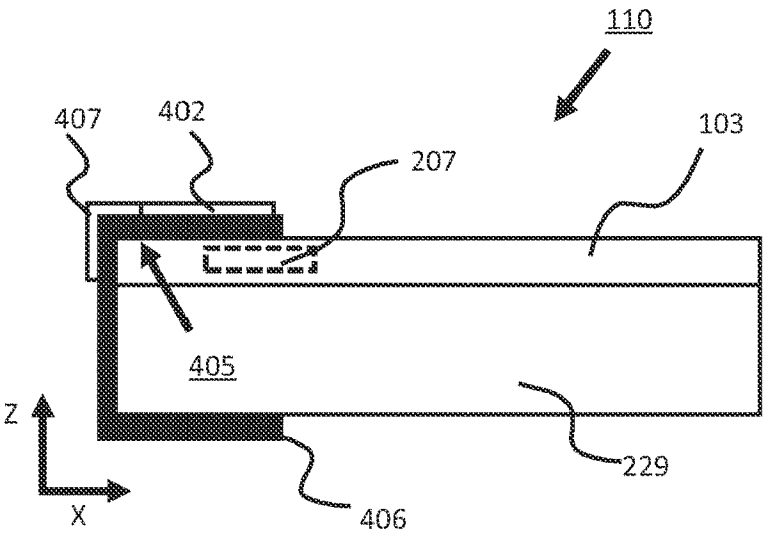
FIGS. 10*a* to 10*d* show examples of arrangements for impedance loading, according to some advantageous embodiments.
Figure 10A:
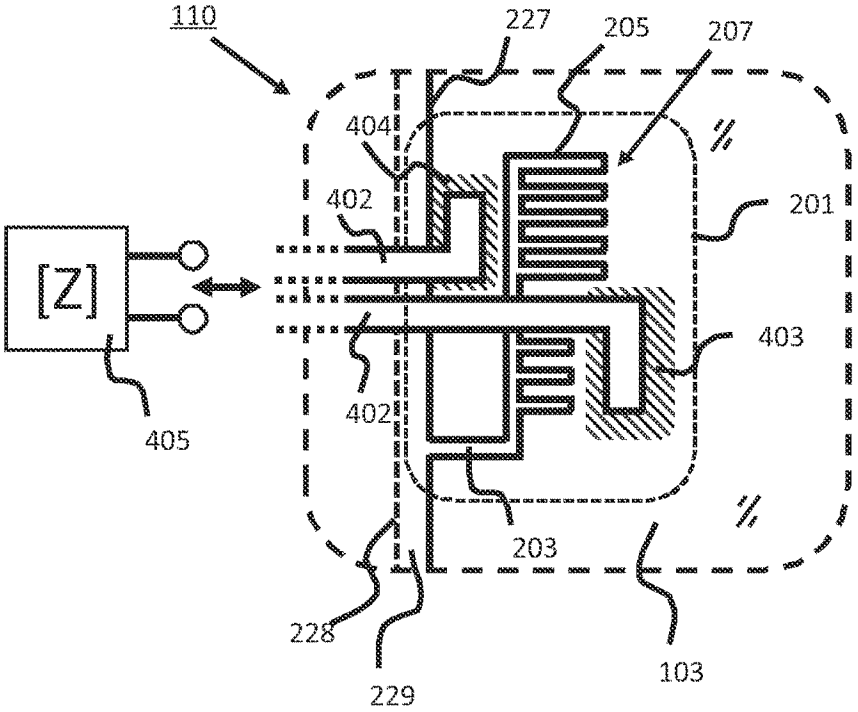

FIG. 10*a* shows an implementation according to a preferred embodiment of the present disclosure, wherein the building material 110 comprises dielectric material 229 and a low emissivity surface 103 equipped with an opening 203 for enhancing the transmission of an electromagnetic signal through the building material, and wherein the radio signal transmitting properties of the aperture 201 formed by said opening 203 are adjusted by means of a loading impedance 405. Said loading impedance is connected to a connecting element 402 which, in this example, is implemented by an electrically conductive strip. Said connecting element may be implemented either as a galvanic contact or as an arrangement operating by an electric or magnetic field only. The connecting element mentioned in the example of FIG. 10*a* is implemented with a capacitive coupling.

The connecting element 402 of FIG. 10*a* constitutes an electrical connection between the surface currents and electric fields oscillating in the low emissivity surface 103 of the slot radiator, and the loading impedance 405 controlling these. Said low emissivity surface 103 comprises an opening 203 which is arranged as a slot radiator and is provided with at least a first loading area 403 and a second loading area 404, said opening 203 being configured to have at least one electrically non-conductive discontinuity in the area therebetween. According to an advantageous embodiment of the present disclosure, the slot radiator 207 between said loading areas 403 and 404 can be loaded with an impedance 405 in different frequency ranges.

FIG. 10*b* shows a structure according to an advantageous embodiment of the present disclosure, wherein the building material 110 comprises at least dielectric material 229 and a low emissivity surface 103, as well as a slot radiator 207 arranged in said low emissivity surface 103 to form an aperture for transmitting radio signals. Furthermore, the arrangement comprises a connecting element 402 and a matching component 407. Said matching component 407 may comprise either discrete components or distributed matching elements, or a phase shifter, such as a short transmission line. The matching components and the connecting element mentioned in the Example of FIG. 10*b* are implemented on a circuit board 406, wherein the circuit board also constitutes a mechanical attachment. Said circuit board may be implemented, for example, as a flexible or rigid circuit board, and it may also comprise mechanical components, for example for installation. The connecting element 402 or the matching component 406 may be implemented without a separate circuit board as well. They may also be applied directly onto the surface of the dielectric material 229, for example, by printing, pressing, or another additive method.

Said matching component may comprise either discrete components or distributed matching elements. The matching components mentioned in the Example of FIG. 10*b*, as well as said connecting element, are implemented on a circuit board 406, wherein the circuit board also constitutes a mechanical attachment. Said circuit board may be implemented, for example, as a flexible or rigid circuit board, and it may also comprise mechanical components, for example for installation. The connecting element 402 or the matching component 406 may be implemented without a separate circuit board as well. They may also be applied directly onto the surface of the dielectric material 229, for example, by printing, pressing, or another additive method.

Figure 10D:
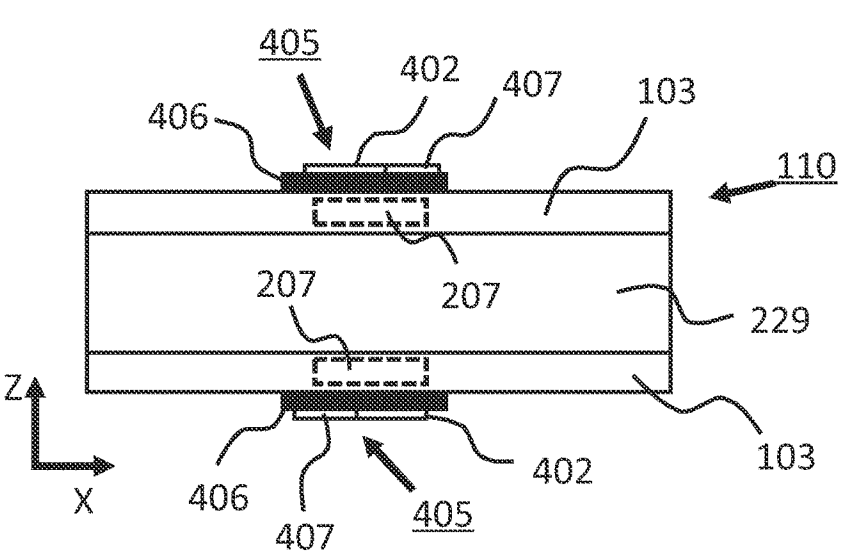
Figure 10C:
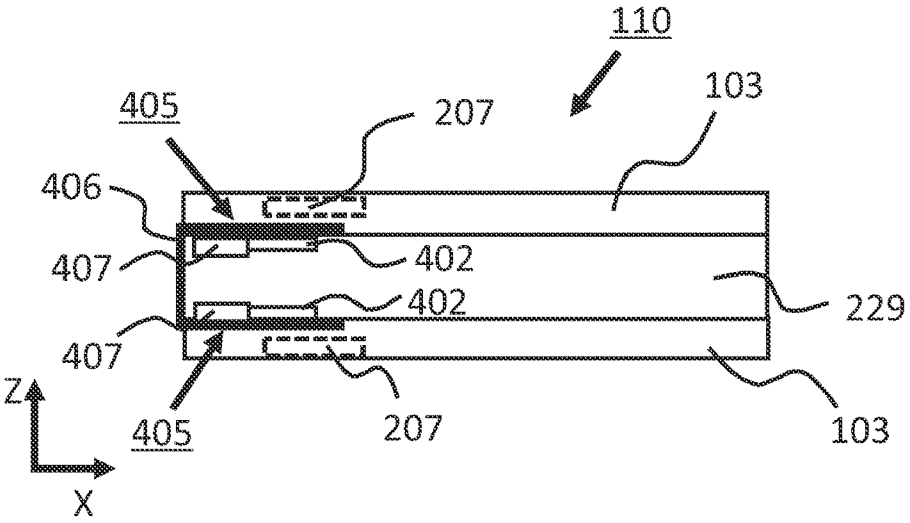

FIG. 10*c* shows a structure according to an advantageous embodiment of the present disclosure, wherein the building material 110 comprises at least dielectric material 229 and a first low emissivity surface 103 provided on its first surface, as well as a slot radiator 207 provided in said first low emissivity surface 103 to form an aperture for transmitting radio signals. Furthermore, the arrangement comprises a second low emissivity surface 103 provided on the second surface of said dielectric material 229, as well as a slot radiator provided on the second low emissivity surface 103 to form an aperture for transmitting radio signals. The arrangement also comprises a connecting element 402 as well as a matching component 407 provided in connection with each low emissivity surface. The arrangement presented in the example of FIG. 10*c* may be implemented, for example, in connection with an insulation glass element 100 which may comprise multiple low emissivity surfaces. The arrangement described forms a loading impedance implemented by the circuit board 406 which may be placed either partly or entirely in the gas space within the insulation glass element, or in a space outside the glass elements. Said circuit board 406 may be implemented either as a flexible tape or as a rigid structure.

FIG. 10*d* shows the structure according to an advantageous embodiment of the present disclosure, wherein the building material 110 comprises at least dielectric material 229 and a first low emissivity surface 103 provided on its first surface, as well as a slot radiator 207 provided in said first low emissivity surface 103 to form an aperture for transmitting radio signals. Furthermore, the arrangement comprises a second low emissivity surface 103 provided on the second surface of said dielectric material 229, as well as a slot radiator provided on the second low emissivity surface 103 to form an aperture for transmitting radio signals. The arrangement also comprises a connecting element 402 as well as a matching component 407 provided in connection with each low emissivity surface. The arrangement presented in the example of FIG. 10*d* may be implemented, for example, in connection with an aluminium-coated insulation board which may comprise multiple low emissivity surfaces. The presented arrangement constitutes a loading impedance implemented with a circuit board 406 which may be placed on either side of the low emissivity surface 103. Said circuit board 406 may be implemented either as a flexible tape or as a rigid structure. Furthermore, when implemented as a tape or a film and comprising matching components and a connecting element, the circuit board may also constitute a moisture barrier.

Adjusting the Transmitting Capacity of the Low Emissivity Surface

The capacity of the aperture to transmit radio signals can be adjusted by adjusting the properties of the slot radiators in the array of slot radiators comprised by said aperture, by adjusting the loading impedance 405 connected to them. Said loading impedance 405 is connected to the connecting element 402, wherein said connecting element forms an electromagnetic coupling with the first and second loading areas of the low emissivity surface. Said electromagnetic coupling may be implemented as a galvanic, inductive or capacitive coupling.

Figure 11B:
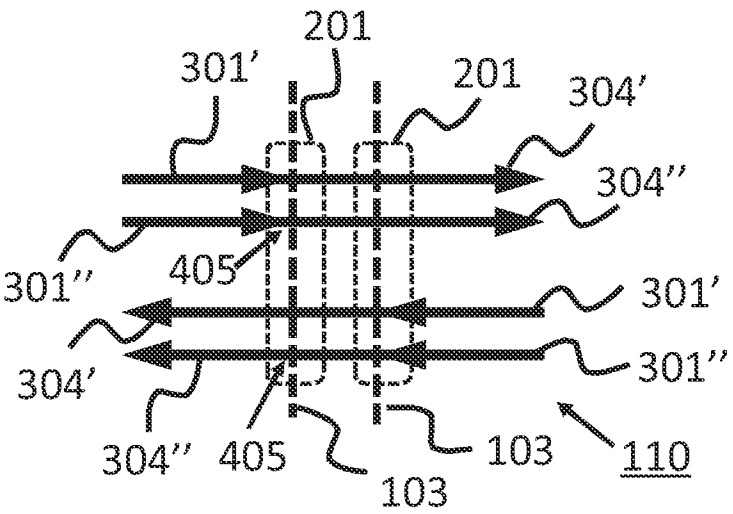
FIGS. 11*a* to 11*e* show examples of arrangements for adjusting permeability properties of an aperture permeable to radio signals comprising a low emissivity surface, according to some advantageous embodiments.
Figure 11A:
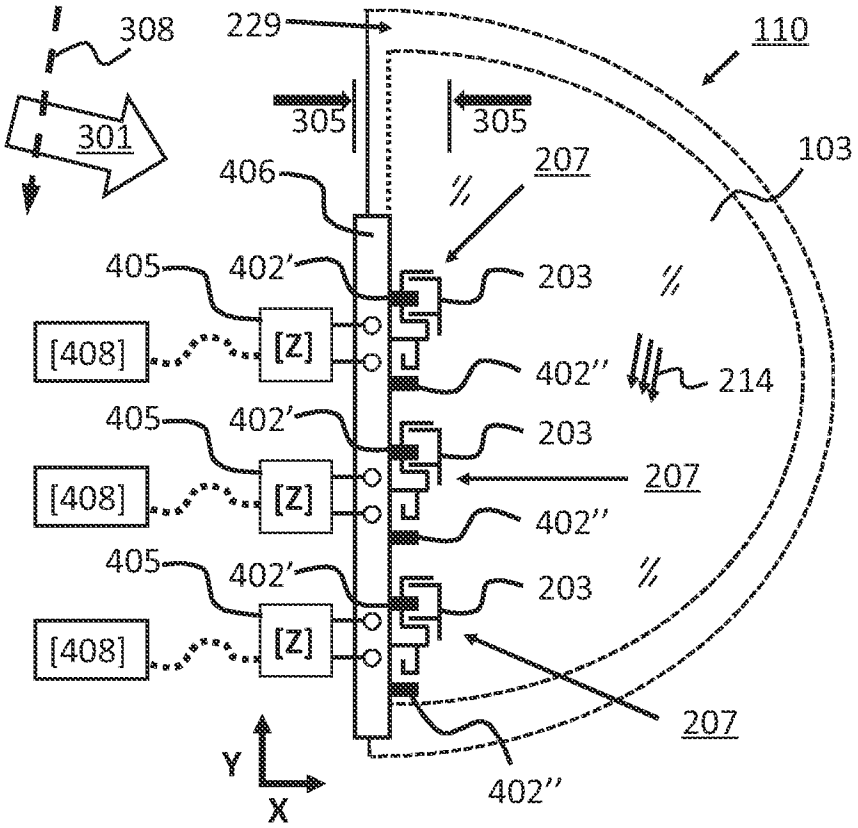

FIG. 11*a* shows a building material 110 according to an advantageous embodiment of the present disclosure, comprising at least dielectric material 229 and a low emissivity surface 103 equipped with several openings 203 for boosting the transmission of electromagnetic signals through the building material, and wherein the aperture for transmitting radio signals, formed by said openings 203, comprises an array of slot radiators formed by slot radiators 207, wherein the shortest dimensions of said aperture for transmitting radio signals is advantageously configured to be shorter than one wavelength at the lowest operating frequency of the array of slot radiators comprised by said aperture, and wherein the shortest dimension of the aperture is represented by the physical width 305 of the aperture. Said dimension 305 may be advantageously configured to be the width of the aperture in the horizontal direction. Said openings 203 comprise sinuous edge curves of openings, wherein curved openings are arranged to be partly interlaced.

The example of FIG. 11*a* further shows a control unit 408, wherein said control unit 408 sets up a connection to the matching component 407 implementing said loading impedance 405. At least part of the slot radiators 207 according to the present disclosure, arranged in the low emissivity surface 103, can be configured to act as an antenna for the control unit 408. Alternatively, the control unit 408 may comprise antennas of its own, and the control unit 408 may be used for adjusting the loading impedances 405 only, wherein said control unit 408 is only involved in adjusting the properties of the signal passing through the low emissivity surface 103. Said adjustment of the properties comprises at least adjusting the transmission impedance of the low emissivity surface, adjusting the frequency response, beamforming, as well as effects of acting as a filter.

The implementation according to an advantageous embodiment of the building material 110 according to the present disclosure comprises at least two slot radiators 207 which are loaded with differing loading impedances 405, wherein said slot radiators 207 are provided either as part of a single opening 203, or as openings 203 separate from each other.

The loading impedance shown in FIG. 11*a* is connected to connecting elements 402' and 402", wherein said connecting elements set up a connection with the loading areas 403 and 404 arranged in the low emissivity surface 103, as well as with the arrangement forming the loading impedance 405. Said connecting elements can be implemented either with a galvanic contact or with an arrangement operating merely by an electric or magnetic field, such as a capacitive plate or strip, or an inductive loop.

According to an advantageous embodiment of the building material 110 of the present disclosure, the control unit 408 comprises an arrangement for controlling the loading impedance 405. Said control unit 408 may further be configured to set up a wireless connection 409 to another wireless device. Said connections may be arranged, for example, to base stations outside a building, base stations inside a building, wireless communication devices 401 placed inside or outside a building, etc. Said control units may be provided in such a way that a single unit controls several loading impedances, or in such a way that a single control unit controls a single loading impedance.

According to an advantageous embodiment of the building material 110 of the present disclosure, the control unit 408 may perform modulation, demodulation and amplification of a wireless signal. It may also perform carrier aggregation. Said control unit 408 may be configured to transmit information between two connections applying different network technologies or protocols. Said control unit 408 may be configured, for example, to transmit information between WLAN or WiGig networks and a wireless mobile communication (such as 2G, 3G, 4G, LTE advanced, 5G, or evolutions of these).

A control unit 408 according to an advantageous embodiment of the building material 110 of the present disclosure may comprise a microcontroller, a power source, electronic memory areas, or external connections, such as a USB port.

A control unit 408 according to an advantageous embodiment of the building material 110 of the present disclosure may be configured to set up a fixed forward connection 410, wherein said control unit 408 is arranged as a part of the communication networks of a building, such as a local area network or a fibre optic cable. Thus, the signalling inside the building may be based on a conventional fibre optic network, but communication outside the building may be implemented via wireless connections.

In providing the forward connection 410 for the fibre network of a building, a separate control unit 408 may be installed in the building to control the electromagnetic signal transmitting properties of building materials 110 according to the present disclosure, placed in the wall structures of single rooms, whereby it is possible to adjust and control cells of the wireless network forming in single rooms of single buildings. This method may be utilized, for example, in favour of loading and resourcing of a base station network, wherein interference sources may be filtered, or carriers may be controlled in favour of spaces requiring the greatest resources. Said separate control unit 408 may be connected to the core network of the base station network via the forward connection 410, or it may set up a wireless connection 409 to the base stations.

A control unit 408 according to an advantageous embodiment of the building material 110 of the present disclosure comprises an arrangement for adjusting the radio signal transmitting properties of the aperture 201, as well as the radiation pattern formed by the array 202 of slot radiators comprised by said openings 203, at one or more frequencies.

A control unit 408 according to an advantageous embodiment of the building material 110 of the present disclosure comprises an arrangement for controlling the impedance of the slot radiator 207 comprised by the radio signal transmitting aperture 201, at one or more frequencies. Said control of the impedance can be used for adjusting the radiation pattern formed by the array 202 of slot radiators comprised by said aperture 201.

FIG. 11*b* shows an arrangement according to an advantageous embodiment of the building material 110 of the present disclosure, comprising a loading impedance 405 arranged in connection with a slot radiator to control the transmission properties of the low emissivity surface. The building material 110 may comprise either one or more low emissivity surfaces provided with said loading impedances 405 for controlling the impedances of the slot radiators. FIG. 11*b* shows an arrangement in which an aperture 201 formed in a building material 110 is configured to receive plane waves 301' and 301" and to re-emit plane waves 304' and 304" to the opposite side of the building material 110 where the plane waves 304' and 304" define either wave fronts propagating at different frequencies or wave fronts propagating in different polarizations.

Figure 11D:
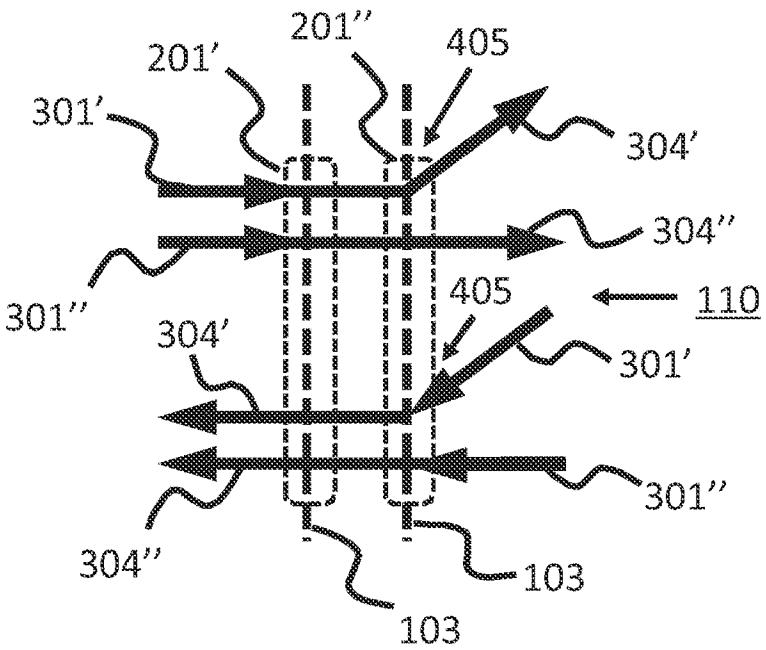
Figure 11C:
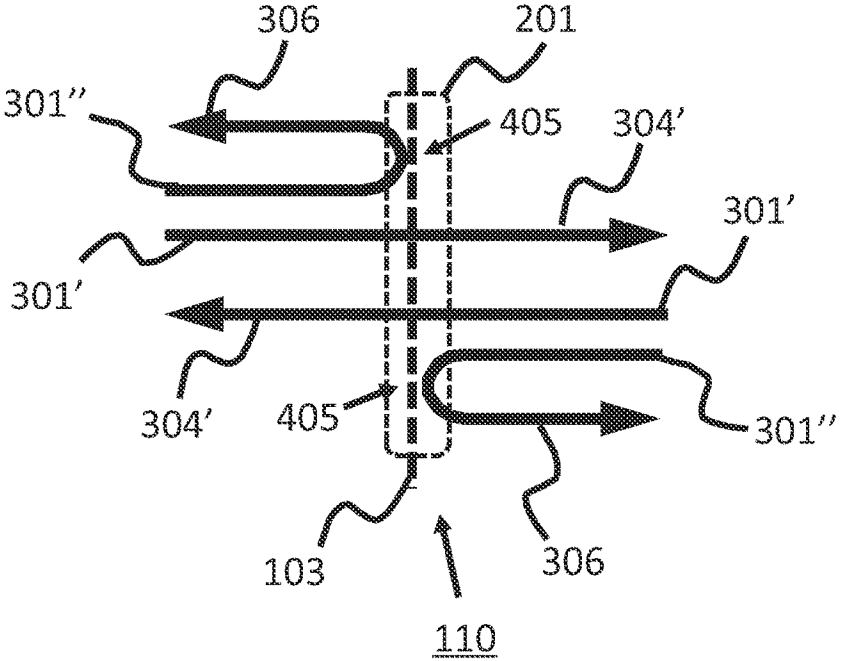

FIG. 11*c* shows an arrangement according to an advantageous embodiment of the present disclosure. Said arrangement comprises a building material 110 provided with an aperture 201 for receiving planar waves 301' and 301" and for re-emitting plane waves 304' and 304" to the opposite side of the building material 110, wherein said aperture comprises an array of slot radiators, of which at least one slot radiator comprises a loading impedance 405 arranged in connection with said slot radiator to control the transmission properties of the low emissivity surface. Said loading impedance 405 is configured to prevent the transmission of the plane wave 301" through said aperture 201, wherein said wave 301" forms a retroreflected wave front 306. An incoming wave 301" whose transmission is reduced according to the present disclosure may comprise either a spurious signal or a signal oscillating at a frequency deviating from the frequency range comprised by the wave 301'.

FIG. 11*d* shows an arrangement according to an advantageous embodiment of the building material 110 of the present disclosure, wherein the radiation pattern formed by the array 202 of slot radiators 207 comprised by the aperture 201 for transmitting radio signals, is controlled by means of a loading impedance 405 arranged in connection with a slot radiator 207 comprised by said array 202 of slot radiators 207 on at least one side of the building material 110. Said control of the radiation pattern may be implemented at one or more operating frequencies comprised by the slot radiator 207. Said control of the radiation pattern may also be implemented at a frequency deviating from the operating frequency of the array of slot radiators 207, for example at the frequency of a spurious signal. The plane wave 301' shown in FIG. 11*d* may comprise, for example, an electromagnetic signal propagating at a frequency deviating from the frequency of the wave 301". The present arrangement may be advantageous, for example, in cities in which base stations are placed on roofs of buildings. Said wave 301' may also comprise, for example, a signal transmitted by an interfering device inside the building, wherein the propagation of the signal to the base station is to be prevented, for eliminating the interference.

Figure 11E:
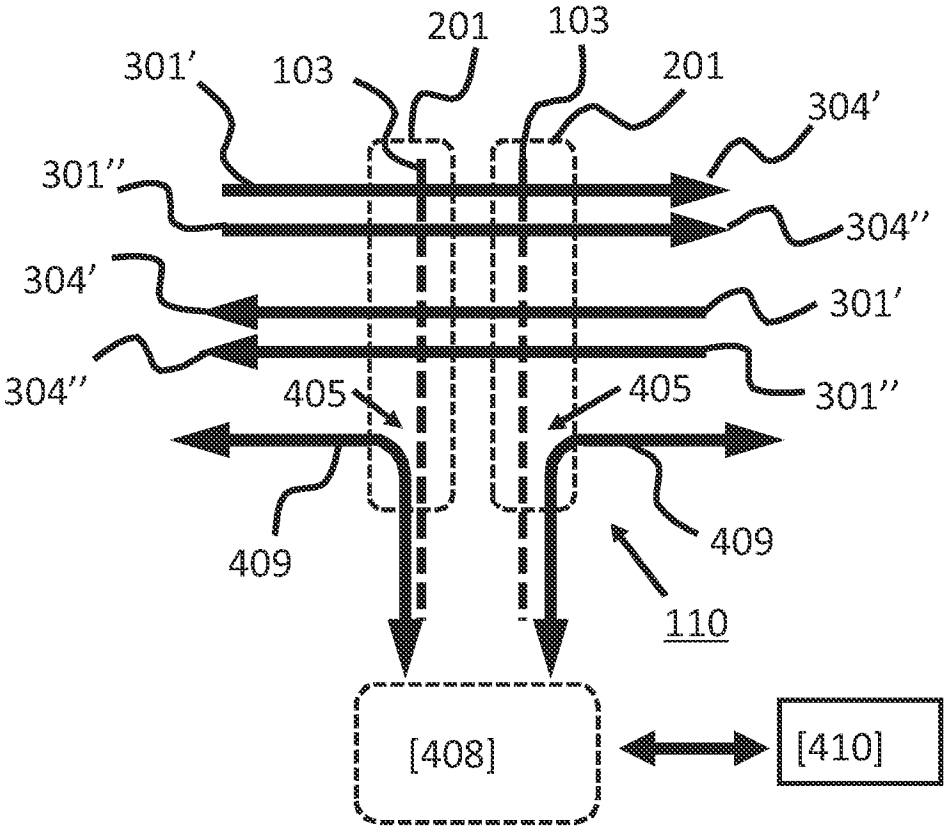

FIG. 11*e* shows an arrangement according to an advantageous embodiment of the building material 110 of the present disclosure, wherein at least one low emissivity surface 103 is provided with an opening 203 for forming an aperture 201 for transmitting radio signals, wherein said aperture 201 comprises a loading impedance 405 arranged in connection with a slot radiator 207, configured to direct at least part of the energy of the incoming electromagnetic signal to a control unit 408 provided in connection with the building material 110, wherein the control unit may advantageously comprise at least an RF transceiver or a wireless sensor. Said loading impedance 405 may be used for converting an opening 203 of the low emissivity surface 103 comprised by said building material 110 to an antenna so that said loading impedance 405 comprises at least a matching circuit or a transfer line arranged between the control unit 408 and an opening 203 of the low emissivity surface 103. Said matching circuit may comprise a structure forming either a capacitance or an inductance, or it may be an actively adjustable matching component. Said antenna may be used for setting up a wireless connection 409.

The building material 110 according to an advantageous embodiment of the present disclosure comprises at least one opening 203 which is configured to form an array 202 of slot radiators, wherein said array 202 of slot radiators is configured to act as an antenna array by means of at least one loading impedance 405, wherein said loading impedance sets up a connection between at least one slot radiator provided in the low emissivity surface 103, and the control unit arranged in connection with the building material. Said antenna array may also comprise further loading impedances, at least some of which are arranged to control the radiation pattern or the operating frequencies of the antenna array. Said antenna array may comprise several operating frequencies and several polarizations.

The building material 110 may comprise either one or more low emissivity surfaces provided with said loading impedances 405 for controlling the impedances of the slot radiators. FIG. 11*e* shows an arrangement in which an aperture 201 provided in a building material 110 is configured to receive plane waves 301' and 301" and to re-emit plane waves 304' and 304" to the opposite side of the building material 110 where the plane waves 304' and 304" define wave fronts propagating either at different frequencies or in different polarizations.

FIGS. 11*a* to 11*e* show an arrangement according to an advantageous embodiment of the building material 110 of the present disclosure, wherein the building material is a window. Said window comprises at least first dielectric material 229, wherein said dielectric material is glass, and a low emissivity surface 103 provided on the surface of said dielectric material, wherein said low emissivity surface 103 is a selective surface, an anti-frost/anti condensation surface, a solar protection surface, a semiconductor surface, or a self-cleaning surface. Furthermore, said window comprises an insulation glass element comprising at least a first and a second glass pane, wherein at least one glass pane comprises said dielectric material 229 and an airtight interspace 105 between said glass panes. Said building material may also comprise a circuit board 406 constituting a loading impedance 405, and a matching component 407. Said loading impedance 405 may be coupled to be part of a window frame structure or a wall structure, by means of e.g. a transfer line, such as a cable or a Lecher wire, wherein said frame structure or wall structure may be coupled to be part of a control unit 408 which may be coupled to be part of a forward connection 410. Said control unit may be coupled to several discrete building materials 110 according to the present disclosure in the building. Said building may comprise several building materials according to the present disclosure, setting up either a wireless connection 409 or a forward connection 410 arranged in another way, wherein said forward connection may be arranged from the building to a base station, a core network, or a wireless communication device 401.

FIGS. 11*a* to 11*e* show an arrangement according to an advantageous embodiment of the building material 110 of the present disclosure, wherein the building material 110 is a thermal insulation board. Said insulation board comprises at least a first dielectric material 229, wherein said dielectric material has a density lower than 200 kg/m$^3$. Said dielectric material may be, for example, PIR, PUR or EPS material, or another material usable as thermal insulation. The dielectric material may also be a thin film. Said film may be laminated to form a part of the low emissivity surface, for example as a moisture barrier, or it may be arranged in the form of a closed chamber to provide a vacuum. Furthermore, said insulation board comprises a low emissivity surface 103 provided on the surface of said dielectric material, wherein said low emissivity surface 103 consists of aluminium. Said building material may further comprise an at least partial moisture barrier arrangement, wherein the moisture barrier is implemented with either a film or a tape which may comprise a circuit board 406 constituting a loading impedance 405, and a matching component 407. Said loading impedance 405 may be coupled to be part of a wall structure, by means of e.g. a socket, wherein said wall structure may be coupled to be part of a control unit 408 which may be coupled to be a part of a forward connection 410. Said control unit may be coupled to several discrete building materials 110 according to the present disclosure in the building. Said building may comprise several building materials according to the present disclosure, forming either a wireless connection 409 or a forward connection 410 arranged in another way, wherein said forward connection may be arranged from the building to a base station, a core network, or a wireless communication device 401.

In an advantageous embodiment of the building material 110 according to the present disclosure, the building material comprises at least one electrically conductive low emissivity surface 103 equipped with an opening 203 for boosting the transmission of an electromagnetic signal opening having a substantially lower electrical conductivity than the low emissivity surface 103.

Figure 12:
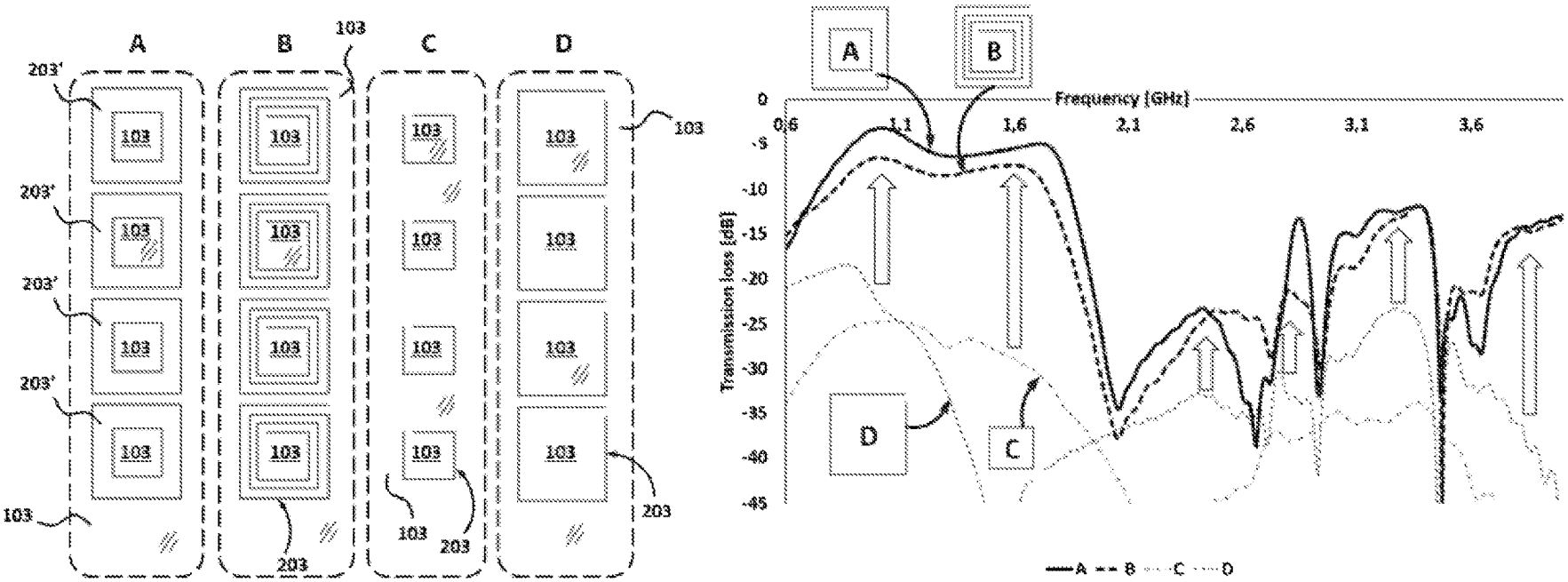
FIG. 12 presents an example of an embodiment, where a slot radiator is implemented with a narrow opening having a particularly narrow width.

FIG. 12 presents an example of an embodiment, where a slot radiator 207 similar to those of FIG. 4, FIG. 6*a*, or FIGS. 7*b*-7*c* may be implemented with a narrow opening 203 having a particularly narrow width of the opening 203.

The arrangement presented in FIG. 12 makes the sinuous edge curve 221 behave like a wide opening in the low emissivity surface. The presented arrangement improves the efficiency and the bandwidth of the narrow opening 203 used as the slot radiator, particularly if the width of the opening 203 is smaller than 500 um and if the opening is implemented in a low emissivity surface used as an unideal electric conductor.

FIG. 12 presents first a reference implementation A, which comprises wide openings 203' in the low emissivity surface 103. The slot radiators of implementation A are implemented with wide openings such that the radiators are optimized to receive the incident signal with the cost of the width of the opening 203'. The transmission loss for the reference implementation A is also provided in FIG. 12 with a thick black trace. The transmission loss results of the example implementations have been simulated using the FIT-solver of a commercial full wave simulator.

Now, to show the significant difference between an implementation of the present disclosure and a single narrow opening or a wide opening, implementation B presents an example of a preferred embodiment of the present disclosure. There is provided a narrow opening 203, which is arranged to enhance the radiation properties of the slot antenna 207. The simulation results in FIG. 12 present that using the method according to the present disclosure, a narrow opening 203 may be arranged to operate similarly to a wide opening 203'.

As a reference, implementation C shows an array of narrow openings 203 which are arranged to follow the exact pattern of the innermost loop of the openings 203 of implementation B. Furthermore, implementation D shows an array of narrow openings 203 which are arranged to follow the exact pattern of the outermost loop of the openings 203 of implementation B. It can be noticed from the simulation results that the improper arrangement of the narrow openings 203 do not create an effective slot radiator 207. Making the openings 203 wide in implementations C or D will return those back to the reference implementation A, where a wide opening 203' is used.

For the example implementation B in FIG. 12, it can be noticed that, the arrangement according to an advantageous embodiment of the present disclosure comprises several narrow openings 203 arranged close to each other so that the currents flowing at the edges of said openings interact in such a way that the summing up and partial offsetting of said currents enhance the operation of the arrangement acting as an array, with respect to the performance of openings arranged far from each other.

The arrangement according to an advantageous embodiment of the present disclosure, shown in FIG. 12, comprises the arrangement of the sections of the narrow openings 203, placed close to each other, to be at least partly interlaced so that the differential current elements comprised by adjacent openings offset each other. In this way, a significant improvement is achieved in the efficiency of the narrow opening used as the slot radiator, when the slot radiator is implemented in a low emissivity surface used as an ideal conductive surface, such as a metal oxide surface of selective glass. Said interlaced sections of openings may advantageously comprise sections of a single opening which are arranged to interlace each other, by making the edge curve of the opening sinuous. Advantageously, said interlaced sections of the openings may also comprise sections of separate openings arranged to be interlaced in the way presented herein.

An implementation according to an advantageous embodiment of the present disclosure compensates for a reduction in efficiency which is typically due to losses of a low emissivity surface with low electric conductivity, by providing sections of openings 203 in the low emissivity surface, which form differential currents, close to each other so that the currents which reduce the radiation efficiency partly offset each other, whereby the proportion of current modes having a positive effect on the increase of the radiation efficiency around the slot radiator increases. Said currents to be offset are generated close to each other in the same electrically conductive area of the low emissivity surface so that they are not significantly isolated by the aperture provided between the currents.

In accordance with the example of FIG. 12, there are provided exemplary arrangements according to advantageous embodiments of the present disclosure in FIGS. 13*a-f*.

In the examples, the edge of the narrow opening 203 comprises a section arranged to have a sinuous shape so that an electroconductive area 231 is delimited from the low emissivity surface 103, within the area delimited by the closed envelope curve, at which electroconductive area 231 the closed envelope curve 224 around the slot radiator is not congruent with the closed edge curve 223 of the opening 203. Said area 231 may be advantageously configured in such a way that a section 221 of the edge curve, delimiting the electroconductive area 231, defines two or more sections of the openings 203 which are arranged to be at least partly interlaced. Said sections are arranged at a distance 234 from each other, wherein the distance 234 delimits the distance between the differential current elements formed in the electroconductive area 231, wherein said differential current elements flow at opposite edges of the uniform conductive area. In an arrangement according to an advantageous embodiment of the present disclosure, said distance 234 is arranged to have a length shorter than one tenth of the wavelength of the operating frequency.

Figure 13C:
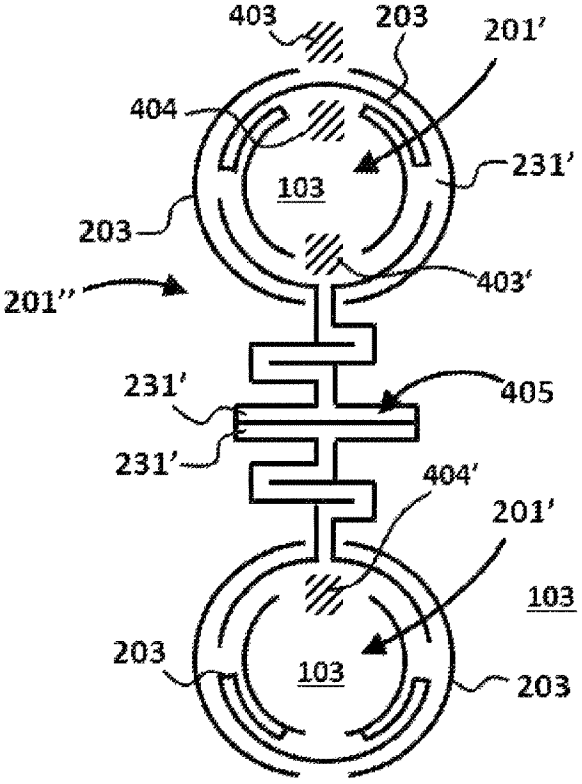
FIGS. 13*a-f* show some exemplary arrangements according to advantageous embodiments of the present disclosure.
Figure 13B:
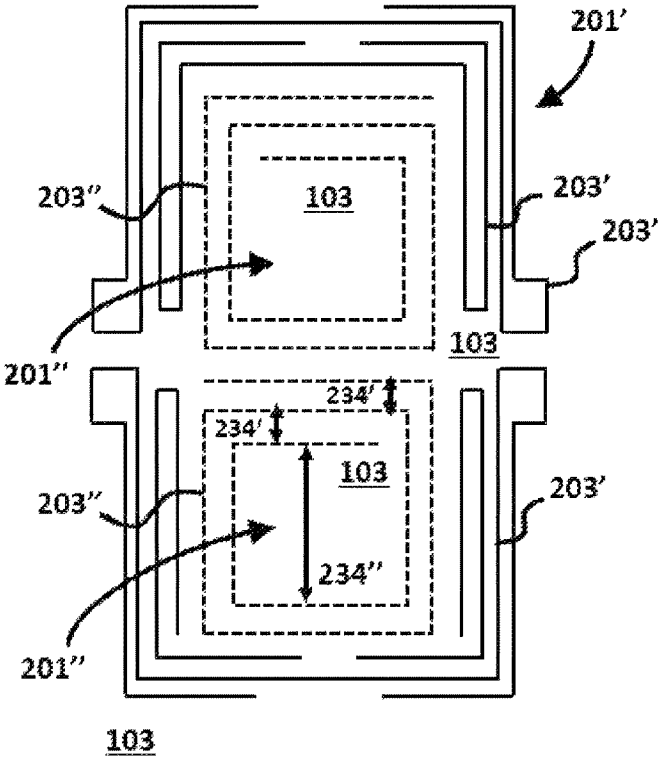
Figure 13A:
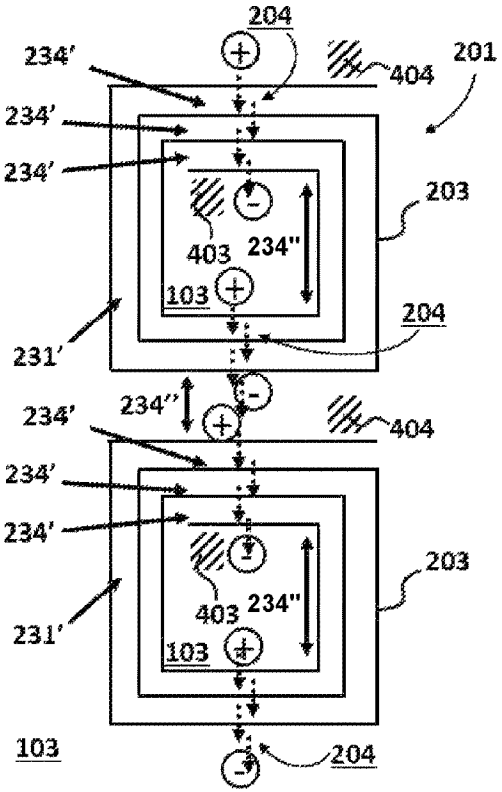

The example of FIG. 13*a* presents an aperture 201 according to an embodiment, where the low emissivity surface 103 is provided with an array of slot radiators comprising at least two slot radiators 207 for forming an aperture 201 for transmitting radio signals, wherein said slot radiators 207 are configured to constitute focused radiation sources 303 emitting an electric field vector at least in the direction of said first polarization.

The example of FIG. 13*b* shows an array of slot radiators operating at a first and second operating frequency. The array of slot radiators operating at the second frequency are formed by openings 203", and the array of slot radiators operating at the first frequency are formed by openings 203'. The openings 203" in the example of FIG. 13*b* may be arranged as loading impedances for the slot radiator operating at the first frequency.

Similarly to the examples 9*a* and 9*b*, the example of FIG. 13*c* shows an arrangement for forming a new resonance frequency for the slot radiator, wherein the area between the loading areas 403' and 404' comprise a frequency dependent loading impedance 405. Said loading impedance comprises distributed elements arranged in the low emissivity surface.

Figure 13F:
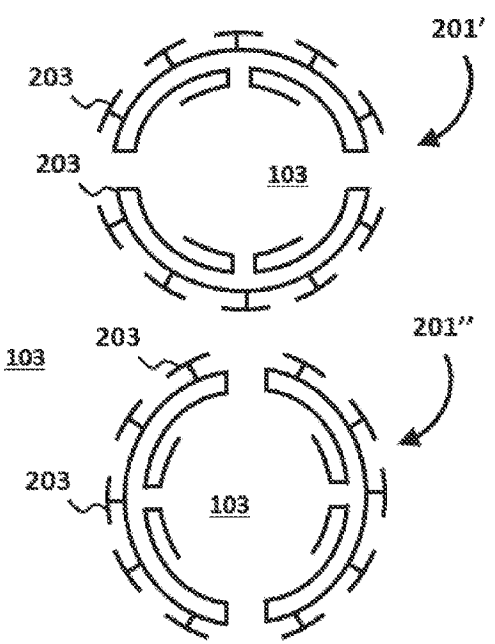
Figure 13E:
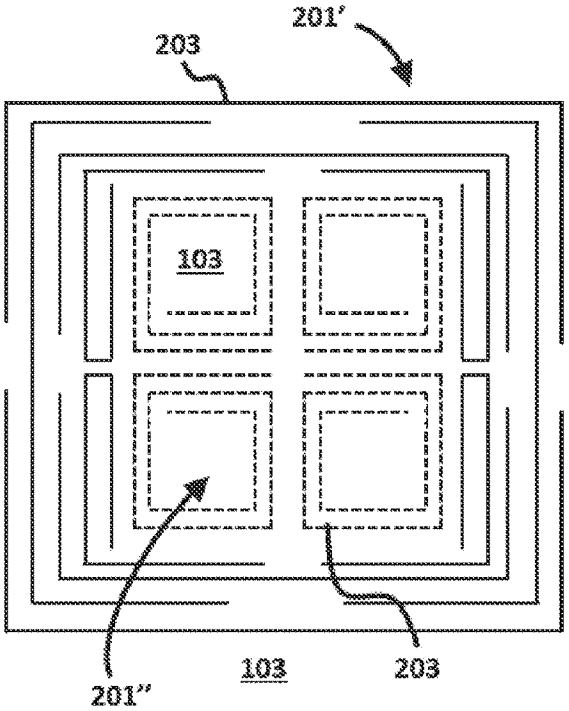
Figure 13D:
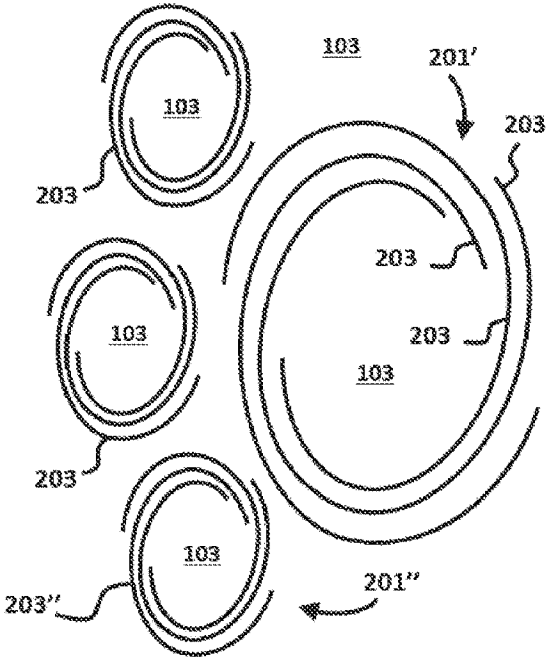

FIGS. 13*d-f* present exemplary arrangements for apertures 201' for the first frequency of operation and apertures 201" for the second frequency of operation.

The Coherent Phase Control of Diversity Apertures

The aim of the present disclosure is to boost the quality and the capacity of wireless communication used within buildings and based on an external network of base stations, by increasing the number of uncorrelated communication channels through the building envelope. FIG. 2*d* shows an example of an embodiment comprising at least two uncorrelated apertures 201, where the first aperture 201' is delimited by a width 305', and the second aperture is delimited by a width 305". The radiated fields of the focused radiation sources 303' of the first aperture 201' the first frequency may be uncorrelated with the radiated fields of the second aperture 201" at the first frequency, or in practice, the correlation between said radiated fields may be nearly zero.

In an advantageous embodiment of the present disclosure, there may be arranged at least two isolated apertures 201 within the same low emissivity surface 103, where said apertures may comprise co-polarized radiation by the focused radiation sources 303. In said arrangement, said focused radiation sources of the at least two apertures may be separated by the radiated fields of the co-polarized components 303 of separate apertures. The radiated fields are created by the oscillating electromotive forces 204 comprised by said focused radiation sources 303.

Envelope correlation coefficient (ECC) may be used to quantify the correlation between the radiated signal components in a given space. There exist analysis methods for ECC, e.g. in LTE systems that are based on the mutual coupling of separated antenna elements with certain assumptions. A more general definition for ECC is based on radiated far fields, and this definition is well known. In a MIMO- or a diversity system, the ECC relate to the achievable performance limits of said systems.

In frequency selective surfaces, the mutual coupling between adjacent unit cells of the two-dimensional lattice is large, and therefore the entire surface behaves like a single antenna, where the transmitted signal propagates in a narrow beam as shown in FIG. 2*a*. In contrast to that, the aim of the present disclosure is to provide a radiation pattern according to a narrow aperture, which may be used to provide a wide radiation pattern as shown in FIG. 2*c*. Furthermore, there may be used a plurality of said narrow apertures within the same low emissivity surface 103 by isolating said narrow apertures by the ECC of the focused radiation sources 303 comprised by said apertures, as well as providing a strong dependency in the oscillation phases of adjacent focused radiation sources 303 within the same aperture 201', and a separation of the oscillation phases of the focused radiation sources 303 between separate apertures 201' and 201". In said advantageous embodiment, said apertures 201' and 201" may be co-polarized, and arranged within the same low emissivity surface 103.

In an embodiment of the disclosure, there is provided a plurality of isolated apertures 201, where said isolated apertures 201 being arranged by a plurality of focused radiation sources 303, where said plurality of focused radiation sources 303 being arranged to operate at least at a first frequency of operation and in the first polarization of the incident electromagnetic signal, and said isolated apertures being separated by isolating the focused radiation sources 303 of separate apertures 201 by binding the adjacent focused radiation sources 303 within a first aperture 201' together by providing an ECC larger than a threshold value between any of said adjacent focused radiation sources 303, and separating the first and second aperture 201' and 201" by providing an ECC smaller than said threshold value between any focused radiation sources of the first aperture 201' and the second aperture 201".

As it is an aim to provide coherent arrays 202 of slot radiators for forming the apertures 201 of the present disclosure, a strong coupling between adjacent focused radiation sources 303 of the same aperture is required. This results that it is an aim to provide adjacent focused radiation sources having an ECC over said threshold value. An advantageous limit for having correlated radiation sources is having a threshold value larger than 0.1. In some embodiments, the ECC between adjacent focused radiation sources 303 of the same aperture 201 is preferably larger than a threshold of 0.5.

As it is an aim to provide isolated apertures 201' and 201", a minimal coupling between the radiation sources 303 of the isolated apertures is required. This results that it is an aim to provide said focused radiation sources 303 of the separated apertures having an ECC less than said said threshold value. An advantageous limit for having correlated radiation sources is having a threshold value larger than 0.1. In some embodiments, the ECC between adjacent focused radiation sources 303 of the same aperture 201 is preferably larger than a threshold of 0.5.

Said threshold of larger than 0.5 may be advantageously arranged with at least one opening 203 being arranged as an array 202 of slot radiators, where said array 202 of slot radiators comprises sections of openings that are at least partly interlaced. In an advantageous embodiment, said at least partly interlaced sections of openings are separated by the distance 234".

Said threshold of larger than 0.5 may also be advantageously arranged with at least one opening 203 being arranged as an array 202 of slot radiators, where at least one slot radiator 207 of said array 202 is loaded with the impedance 405, and the focused radiation source 303 of said loaded slot radiator 207 being arranged to form an envelope correlation coefficient larger than said threshold of 0.5 with at least another focused radiation source 303. In said arrangement, it is possible to control an array 202 of slot radiators with one or more impedances 405.

In an aim to enhance the isolation between separated apertures, it may be advantageous to provide ECC larger than a first threshold of 0.5 between said adjacent radiation sources 303 of the same aperture 201, and ECC less than a second threshold of 0.1 between the focused radiation sources 303 of separate apertures 201' and 201".

A substantial difference between the wide aperture and the present narrow aperture is the following. A wave front of an electromagnetic planar wave 301 transmitted from a base station and arriving preferably from the horizon illuminates the whole surface of the aperture 201 for transmitting radio signals when passing a distance not exceeding one wavelength 309 and impinging on the aperture, irrespective of whether the electromagnetic planar wave 301 comes from the direction of the normal of the low emissivity surface 103 or from an azimuth angle substantially deviating from it.

Figure 14B:
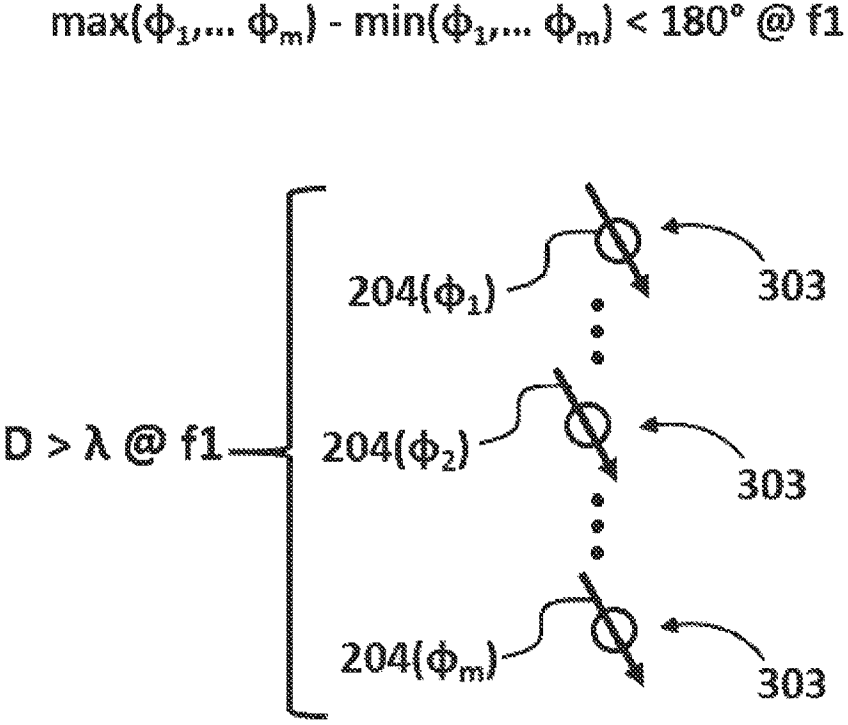
FIGS. 14*a-b* show a plurality of focused radiation sources having an oscillation phase and forming an aperture, which said radiation sources being distributed in a first and a second direction respectively.
Figure 14A:
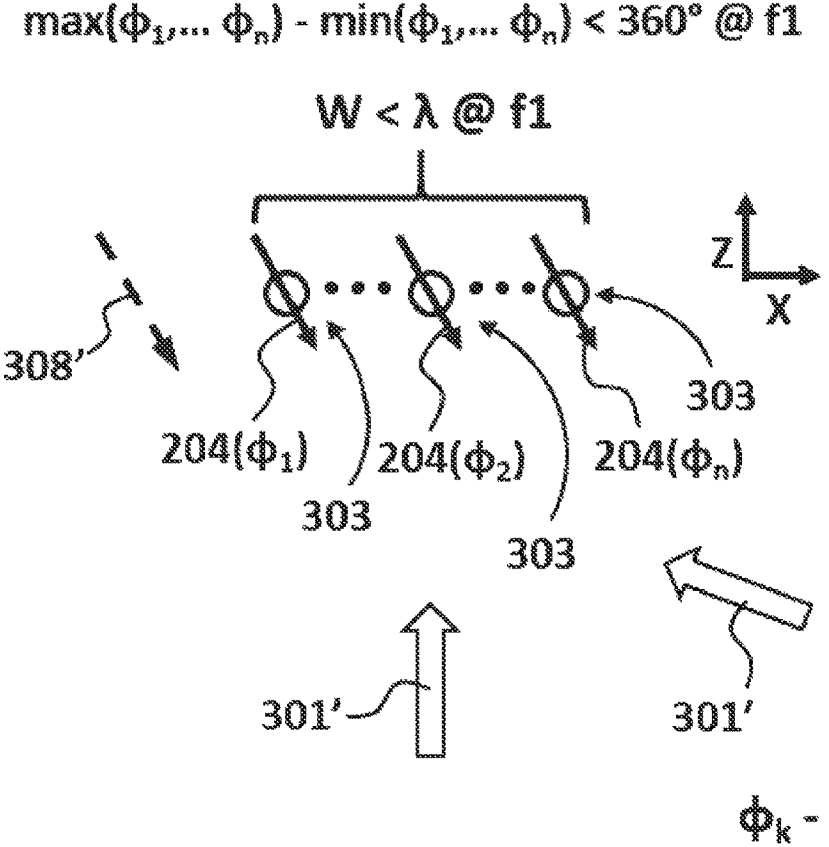

FIG. 14*a* shows an embodiment comprising focused radiation sources 303 having an oscillation phase. Furthermore, there is presented an example for a planar wave 301' arriving from the horizon. Said planar wave arrives from an azimuth angle, which may be any azimuth angle comprising the horizon (between 0° and 180°). It is advantageous to define that the wave may arrive from the direction of the normal of the low emissivity surface 103 or from an azimuth angle substantially deviating from it. In FIG. 14*a*, the X-Z-plane presents the horizontal plane, and planar waves 301' may arrive from an arbitrary angle from the horizon.

In an aim to provide coherent radiation from focused radiation sources 303 of an aperture 201, and to separate isolated apertures 201' and 201", it is advantageous to define the phase dependency of said radiation sources 303.

The oscillating electromotive force 204 of the resonance circuit oscillates in an electrical phase inside the non-conductive area of the opening 203. The oscillation phase at a fixed moment of time is referred to as phase angle (θ). The phase of a single electromotive force vector 204 constituting a single focused focused radiation source 303 may be referred to as $\theta_1$. The phase angle (θ) of a single electromotive force 204 may be in phase, or in delay with respect to the oscillation phase of the incident electric field vector 308. The (continuous/unwrapped) phase difference between the oscillation phases of two adjacent electromotive forces $\theta_1$ and $\theta_2$ may be arbitrary, and larger than 360°. The cyclic phase difference, on the other hand, presents only a folded phase difference that does not take into account the delay if it is larger than a wavelength at the frequency of operation. The phase angle (θ) of a focused radiation source 303 or of separate elements of an array of focused radiation sources 303 is observed under a condition, when the electric field vector 308 of an incident planar wave 301 has illuminated said elements, and the oscillation of said elements has been triggered.

The present disclosure compensates for a reduction in efficiency which is typically due to losses of a low emissivity surface with low electrical conductivity, by increasing the efficiency of signal transmission by means of a coherent wave front formed by several focused slot radiators.

In an embodiment of the present disclosure, the low emissivity surface 103 is provided with an array 202 of slot radiators comprising at least two slot radiators 207 for forming an aperture 201 for transmitting radio signals, said slot radiators 207 being provided by narrow openings 203, wherein said slot radiators 207 are configured to constitute focused radiation sources 303 emitting an electric field vector at least in the direction of said first polarization, and wherein said aperture 201 for transmitting radio signals defines an area in the building material 110 which is delimited by a closed curve 230 wherein said aperture 201 for transmitting radio signals is within said closed curve 230, and the area of the surface delimited by the closed curve 230 is substantially smaller than the area of the surface delimited by the closed edge curve 227 defining the low emissivity surface 103. And further, the focused radiation sources 303 of said aperture 201 comprise the electromotive force 204 oscillating in a phase angle (θ).

In an aim to provide the coherent focused radiation sources 303 of the present disclosure, the phase angles of said radiation sources 303 may be advantageously delimited. FIG. 14*a* shows a plurality of focused radiation sources 303 forming an aperture 201, which said radiation sources 303 being distributed in the first direction. Said first direction may be delimited by the width (W) 305 of the aperture. In an advantageous embodiment of the present disclosure, said with 305 is delimited being less than a wavelength at the first frequency (f1) for providing a maximally wide radiation beam according to the narrow aperture diffraction. Said first frequency may define the lowest operation frequency of said aperture 201.

FIG. 14*b* shows a plurality of focused radiation sources 303 forming an aperture 201, which said radiation sources 303 being distributed in the second direction, where said second direction being crosswise to the first direction. The length (D) of said aperture 201 in said second direction is advantageously larger than the wavelength at the first frequency, in order to steer the re-radiated electromagnetic energy to the horizon.

In an embodiment of the present disclosure, the continuous phase shift between any two members of said focused radiation sources 303 of said aperture 201, which are arranged to operate at the first frequency and in the first polarization, is less than 360°.

In an embodiment of the present disclosure, the continuous phase shift between two adjacent members of said focused radiation sources 303 of said aperture 201, which are arranged to operate at the first frequency and in the first polarization, is less than 180°.

In an embodiment of the present disclosure, the continuous phase shift between any of the two outermost focused radiation sources 303 of said aperture 201, which are arranged to operate at the first frequency and in the first polarization, is less than 360° in a first direction along the surface of the low emissivity surface 103, where said first direction is defined by the width 305 of the aperture.

In another embodiment of the present disclosure, there is provided a plurality of low emissivity surfaces 103 disposed on top of each other, and having electrically insulating layers disposed between said low emissivity surfaces, where each of said disposed low emissivity surfaces 103 are provided with an array of slot radiators 202 comprising at least two slot radiators 207 for forming an aperture 201 for transmitting radio signals, wherein said slot radiators 207 are configured to constitute focused radiation sources 303 emitting an electric field vector at least in the direction of said first polarization, and wherein each of said apertures 201 for transmitting radio signals define an area which is delimited by a closed curve 230 wherein said aperture 201 for transmitting radio signals is within said closed curve 230, and the area of the surface delimited by the closed curve 230 in each of said low emissivity surfaces 103 is substantially smaller than the area of the surface delimited by the closed edge curve 227 defining the corresponding low emissivity surface 103. And further, the focused radiation sources 303 in each of said apertures 201 comprise the electromotive force 204 oscillating in a phase angle (e).

In another embodiment of the present disclosure, there is provided at least two adjacent low emissivity surfaces 103 on top of each other, and said at least two low emissivity surfaces 103 comprising the apertures 201 according to the present disclosure. In addition, the continuous phase shift between two adjacent members of the focused radiation sources 303 of the at least two apertures 201 of adjacent low emissivity surfaces, which said focused radiation sources 303 are arranged to operate at the first frequency and in the first polarization, and localized in two different low emissivity surfaces 103, is less than 360° in the direction that deviates from the direction of the first direction.

When the focused radiation sources 303 of the aperture 201 are arranged in the above described manner, i.e. the wave front of the electromagnetic planar wave 301 arriving preferably from the horizon illuminates the whole surface of the aperture 201 for transmitting radio signals when passing a distance not exceeding one wavelength, the resulting effect is that each of the focused radiation sources 303 of the aperture 201 are acting together, and the resulting re-emitted wave front is coherent in the transmission sector 307. This arrangement of the aperture also creates a beneficial effect of having a maximally wide beam coverage regardless of the direction from where the signal arrives from the horizon.

In the following, some advantageous examples of the present disclosure are provided.

In an embodiment, there is provided a building material 110 comprising at least one electrically conductive low emissivity surface 103 provided with at least one opening 203 for boosting the transmission of an electromagnetic signal through the building material, the opening having a substantially lower electrical conductivity than the low emissivity surface 103, where the edges of said at least one opening 203 provided in said low emissivity surface constitutes at least one closed edge curve 223, and that edges of said openings 203 define a closed envelope curve 224 so that said openings 203 are within the closed envelope curve 224, and the surface defined by the closed envelope curve 224 has an area substantially larger than the area of the openings 203 within the closed envelope curve 224 and a length substantially smaller than the length of the closed envelope curve 224, whereby at least one electrically conducting area 231 of the low emissivity surface 103 is formed within the area defined by the closed envelope curve 224, at which the closed envelope curve 224 is not congruent with the edge curve 223, and in which said electrically conducting area 231 of the low emissivity surface 103 defines at least two edges of the opening 203, which are at least arranged at a distance 234 from each other, and in which said edges are at least partly interlaced, and said at least one opening 203 comprises at least two sections of openings which are separated by an electrically conductive area 231 of the low emissivity surface 103, wherein said sections of the openings comprise two or more narrow openings, and that the distance 234" between said sections is multiple compared with the distance 234' between said narrow openings.

In an embodiment, said opening 203 is configured to form at least one positive 208 and negative 209 charge distribution acting as poles for the surface current formed on the low emissivity surface 103, by the effect of the electromagnetic signal oscillating in the first polarization and impinging on the building material 110, as well as an electric field vector oscillating in the first polarization within the opening 203, between its two edges, wherein the electric field vector in combination with said surface current formed in the low emissivity surface 103 generates a resonance circuit for forming a slot radiator 207 operating as a focused radiation source 303 in the first polarization, for boosting the propagation of the electromagnetic signal through the building material.

In an embodiment, said at least one opening 203 is configured to generate an electric field, wherein said at least partly interlaced edges are interlaced in the direction of the electric field effective across the edges.

In an embodiment, the resonating dimension 215 of the resonance circuit is configured to be preferably half the wavelength at the oscillating frequency of the incoming planar wave 301.

In an embodiment, the low emissivity surface 103 is provided with an array 202 of slot radiators comprising at least two slot radiators 207 for forming an aperture 201 for transmitting radio signals, wherein said slot radiators 207 are configured to constitute focused radiation sources 303 emitting an electric field vector in the direction of at least said first polarization, and wherein said aperture 201 for transmitting radio signals defines an area in the building material 110 which is delimited by a closed curve 230, wherein said aperture 201 for transmitting radio signals is within said closed curve 230, and the area of the surface delimited by the closed curve 230 is substantially smaller than the area of the surface delimited by the closed edge curve 227 defining the low emissivity surface 103.

In an embodiment, at least two adjacent focused radiation sources 303 of said aperture 201 emitting an electric field vector in the direction of at least said first polarization being arranged to form envelope correlation coefficient larger than a first threshold.

In an embodiment, said radiation sources 303 of said aperture 201 being arranged to oscillate at the first frequency by the energy received from a planar wave 301 arriving from an azimuth angle such that the continuous phase shift between any two members of said focused radiation sources 303 of said aperture 201, which are arranged to operate at the first frequency and in the first polarization, is less than 360°, and the continuous phase shift between any two adjacent members of said focused radiation sources 303 of said aperture 201, which are arranged to operate at the first frequency and in the first polarization, is less than 180°.

In an embodiment, there is provided a building material 110 comprising at least one electrically conductive low emissivity surface 103 provided with at least one opening 203 for boosting the transmission of an electromagnetic signal through the building material, the opening having a substantially lower electrical conductivity than the low emissivity surface 103, where the edges of said at least one opening 203 provided in said low emissivity surface 103 constitutes at least one closed edge curve 223, and that said openings 203 being configured to form at least one positive 208 and negative 209 charge distribution acting as poles for the surface current formed on the low emissivity surface 103, by the effect of the electromagnetic signal oscillating in the first polarization and impinging on the building material 110, as well as an electric field vector oscillating in the first polarization within the opening 203, between its two edges, wherein the electric field vector in combination with said surface current formed in the low emissivity surface 103 generates a resonance circuit for forming a slot radiator 207 operating as a focused radiation source 303 in the first polarization, for boosting the propagation of the electromagnetic signal through the building material, where said resonance circuit of said slot radiator 207 is arranged in resonance at at least one frequency between 300 MHz and 30 GHz, and said slot radiator 207 comprises at least a first loading area 403 and a second loading area 404 arranged in said low emissivity surface 103, wherein said opening 203 is configured to constitute at least one electrically non-conductive discontinuity within the electrically conductive area between said loading areas (403/404), and in which building material 110 the slot radiator 207 between said loading areas 403 and 404 is loaded with an impedance 405.

In a method according to an advantageous embodiment of the present disclosure, the propagation of a signal through a building material 110 is boosted, the building material 110 comprising at least one conductive low emissivity surface 103, wherein the method comprises providing the low emissivity surface 103 with an opening 203 whose conductivity is substantially lower than that of the low emissivity surface 103, and the edge of the opening 203 formed in the low emissivity surface 103 constitutes at least one closed edge curve 223, wherein said opening defines a closed envelope curve 224 so that said opening 203 is within the closed envelope curve 224, and the surface defined by the closed envelope curve 224 has an area substantially larger than the area of the opening 203 within the closed envelope curve 224 and a length substantially smaller than the length of the closed envelope curve 224, whereby at least one such low emissivity surface 103 area 231 is formed inside the area defined by the closed envelope curve 224, at which the closed envelope curve 224 is not congruent with the edge curve 223.

In a method according to an advantageous embodiment of the present disclosure, the closed edge curve 223 of the opening 203 is arranged to be congruent with the closed edge curve 227 delimiting the low emissivity surface 103.

In a method according to an advantageous embodiment of the present disclosure, the closed edge curve 223 of the opening 203 constitutes a closed edge curve separated from the closed edge curve 227 delimiting the low emissivity surface 103.

In an advantageous embodiment of the present disclosure, said opening 203 is used to form at least one positive 208 and one negative 209 charge distribution acting as poles in the surface current formed on the low emissivity surface 103, by the effect of the electromagnetic signal oscillating in the first polarization and impinging on the building material 110, as well as an electric field vector oscillating in the first polarization within the opening 203, between its two edges, wherein the electric field vector in combination with said surface current formed in the low emissivity surface 103 generates a resonance circuit for forming a slot radiator 207 to operate as a focused radiation source 303 in the first polarization, for boosting the transmission of the electromagnetic signal through the building material.

In a method according to an advantageous embodiment of the present disclosure, the low emissivity surface 103 is provided with an array 202 of slot radiators comprising at least two slot radiators 207 for forming an aperture 201 for transmitting radio signals, wherein said slot radiators 207 are configured to constitute focused radiation sources 303 emitting an electric field vector at least in the direction of said first polarization, and wherein said aperture 201 for transmitting radio signals defines an area in the building material 110 which is delimited by a closed curve 230 wherein said aperture 201 for transmitting radio signals is within said closed curve 230, and the area of the surface delimited by the closed curve 230 is substantially smaller than the area of the surface delimited by the closed edge curve 227 defining the low emissivity surface 103.

In a method according to an advantageous embodiment of the present disclosure, said aperture 201 for transmitting radio signals is formed to have a width smaller than one wavelength and a height of at least one wavelength at the lowest resonant frequency of said slot radiators 207 of the array of slot radiators 202 comprised by the aperture 201.

In a method according to an advantageous embodiment of the present disclosure, the low emissivity surface 103 is provided with an array of slot radiators 202 comprising at least two said slot radiators 207, wherein the focused radiation sources 303 comprised by said slot radiators 207 are arrayed as a vertical row, wherein the vertical distance between two said focused radiation sources 303 adjacent to each other is arranged to be not greater than one wavelength at the lowest resonant frequency of said slot radiators 207, and wherein said vertical row may be arranged to be straight or meandering.

In an advantageous embodiment of the present disclosure, said opening 203 is used to form at least one positive 208 and one negative 209 charge distribution acting as poles in the surface current formed on the low emissivity surface 103, by the effect of the electromagnetic signal oscillating in the second polarization and impinging on the building material 110, as well as an electric field vector oscillating in the second polarization within the opening 203, between its two edges, wherein the electric field vector in combination with said surface current formed in the low emissivity surface 103 generates a resonance circuit for forming a slot radiator 207 operating as a focused radiation source 303 in the second polarization for boosting the transmission of the electromagnetic signal through the building material, whereby the first and second polarizations are crosswise.

In a method according to an advantageous embodiment of the present disclosure, the low emissivity surface 103 is formed on the surface of a dielectric material.

In a method according to an advantageous embodiment of the present disclosure, glass is used as the dielectric material.

In a method according to an advantageous embodiment of the present disclosure, an insulation material is used as the dielectric material.

In an advantageous embodiment of the present disclosure, there is provided a building material 110 comprising at least one electrically conductive low emissivity surface 103 provided with at least one opening 203 for boosting the transmission of an electromagnetic signal through the building material, the opening having a substantially lower electrical conductivity than the low emissivity surface 103, characterized in that the edges of said at least one opening 203 provided in said low emissivity surface 103 constitutes at least one closed edge curve 223, and that said openings 203 being configured to form at least one positive 208 and negative 209 charge distribution acting as poles for the surface current formed on the low emissivity surface 103, by the effect of the electromagnetic signal oscillating in the first polarization and impinging on the building material 110, as well as an electric field vector oscillating in the first polarization within the opening 203, between its two edges, wherein the electric field vector in combination with said surface current formed in the low emissivity surface 103 generates a resonance circuit for forming a slot radiator 207 operating as a focused radiation source 303 in the first polarization, for boosting the propagation of the electromagnetic signal through the building material, where said resonance circuit of said slot radiator 207 is arranged in resonance at at least one frequency between 300 MHz and 30 GHz, and said slot radiator 207 comprises at least a first loading area 403 and a second loading area 404 arranged in said low emissivity surface 103, wherein said opening 203 is configured to constitute at least one electrically non-conductive discontinuity within the electrically conductive area between said loading areas 403/404, and in which building material 110 the slot radiator 207 between said loading areas 403 and 404 is loaded with an impedance 405.

In an embodiment, there is provided a building material 110 comprising at least one electrically conductive low emissivity surface 103 provided with at least one opening 203 for boosting the transmission of electromagnetic signals through the building material by at least two diversity channels, the opening having a substantially lower electrical conductivity than the low emissivity surface 103, where said at least two diversity channels through the low emissivity surface 103 being provided by a first 201' and a second 201" aperture for transmitting radio signals, where the low emissivity surface 103 is provided with an array 202 of slot radiators comprising at least two slot radiators 207 for forming said first aperture 201' for transmitting radio signals, wherein said slot radiators 207 are configured to constitute focused radiation sources 303' having a phase, and emitting an electric field vector in the direction of at least said first polarization at a first frequency, and the low emissivity surface 103 is provided with an array 202 of slot radiators comprising at least two slot radiators 207 for forming said second aperture 201" for transmitting radio signals, wherein said slot radiators 207 are configured to constitute focused radiation sources 303" having a phase, and emitting an electric field vector in the direction of the first polarization or a second polarization at a first frequency, and said radiation sources 303' of said first aperture 201' being arranged to oscillate at the first frequency by the energy received from a planar wave 301 arriving from an azimuth angle such that the continuous phase shift between any two members of said focused radiation sources 303' of said first aperture 201', which are arranged to operate at the first frequency and in the first polarization, is less than 360°, and the continuous phase shift between two adjacent members of said focused radiation sources 303' of said first aperture 201', which are arranged to operate at the first frequency and in the first polarization, is less than 180°, and said radiation sources 303" of said second aperture 201" being arranged to oscillate at the first frequency by the energy received from a planar wave 301 arriving from said azimuth angle such that the continuous phase shift between any two members of said focused radiation sources 303" of said second aperture 201", which are arranged to operate at the first frequency and in the first polarization or in the second polarization, is less than 360°, and the continuous phase shift between two adjacent members of said focused radiation sources 303' of said first aperture 201', which are arranged to operate at the first frequency and in the first polarization, is less than 180°, and at least two adjacent focused radiation sources 303' of said first aperture 201' being arranged to form envelope correlation coefficient larger than a threshold, and at least two adjacent focused radiation sources 303" of said second aperture 201" being arranged to form envelope correlation coefficient larger than said threshold, and said at least two adjacent focused radiation sources 303' of said first aperture 201' being arranged to form envelope correlation coefficient less than said threshold with said at least two adjacent focused radiation sources 303" of said second aperture 201".

In an embodiment, said first aperture 201' being delimited by a width 305' of less than a wavelength at the first frequency, and said second aperture 201" being delimited by a width 305" of less than a wavelength at the first frequency.

In an embodiment, said first aperture 201' for transmitting radio signals defines an area in the building material 110 which is limited by a closed curve 230, wherein said aperture 201 for transmitting radio signals is arranged within said closed curved 230, and the area of the surface defined by the closed curve 230 is substantially smaller than the area of the surface defined by the closed edge curve 227 delimiting the low emissivity surface 103.

In an embodiment, said second aperture 201" for transmitting radio signals defines an area in the building material 110 which is limited by a closed curve 230, wherein said aperture 201 for transmitting radio signals is arranged within said closed curved 230, and the area of the surface defined by the closed curve 230 is substantially smaller than the area of the surface defined by the closed edge curve 227 delimiting the low emissivity surface 103.

In an embodiment, each of the slot radiators 207 of said first aperture 201' or said second aperture 201" being arranged to activate as radiation sources by the energy of a planar wave 301, such that said planar wave 301, arriving from the horizon illuminates each of said slot radiators 207 as it propagates a distance not greater than one wavelength 309 from the moment when the wave front of the incoming planar wave 301 first impinges the edge of the area defined by the aperture (201' or 201") for transmitting radio signals.

In an embodiment, said at least one opening 203 is arranged to form said at least two slot radiators 207 of said first aperture 201' such that said at least one opening 203 is configured to form at least one positive 208 and negative 209 charge distribution acting as poles for the surface current formed on the low emissivity surface 103, by the effect of the electromagnetic signal oscillating in the first polarization and impinging on the building material 110, as well as an electric field vector oscillating in the first polarization within the opening 203, between its two edges, wherein the electric field vector in combination with said surface current formed in the low emissivity surface 103 generates a resonance circuit for forming said slot radiators 207 operating as a focused radiation sources 303 in the first polarization, and the edges of said at least one opening 203 provided in said low emissivity surface constitutes at least one closed edge curve 223, and that the edges of said openings 203 define a closed envelope curve 224 so that said openings 203 are within the closed envelope curve 224, and the surface defined by the closed envelope curve 224 has an area substantially larger than the area of the openings 203 within the closed envelope curve 224 and a length substantially smaller than the length of the closed envelope curve 224, whereby at least one electrically conducting area 231 of the low emissivity surface 103 is formed within the area defined by the closed envelope curve 224, at which the closed envelope curve 224 is not congruent with the edge curve 223.

In an embodiment, said at least one opening 203 comprises at least two sections of openings which are separated by an electrically conductive area 231 of the low emissivity surface 103, wherein said sections of the openings comprise two or more narrow openings, and that the distance 234" between said sections is multiple compared with the distance 234' between said narrow openings.

In an embodiment, at least one of said slot radiators 207 comprises at least a first loading area 403 and a second loading area 404 arranged in said low emissivity surface 103, wherein said opening 203 is configured to constitute at least one electrically non-conductive discontinuity within the electrically conductive area between said loading areas (403/404), and in which building material 110 the slot radiator 207 between said loading areas 403 and 404 is loaded with an impedance 405.

In an embodiment, the building material is an insulating glass unit 100 comprising at least two glass panes 102, a space 105 between these, and at least one of the glass panes 102 is provided with said low emissivity surface 103.

In an embodiment, the low emissivity surface 103 is arranged on the surface of a dielectric material, where said dielectric material is insulation material having a density lower than 200 kg/m$^3$.

In an embodiment, any of said focused radiation sources 303' of said first aperture 201', which are arranged to operate at the first frequency and in the first polarization being arranged to form envelope correlation coefficient less than said threshold with any of said focused radiation sources 303" of said second aperture 201", which are arranged to operate at the first frequency and in the first polarization or in the second polarization.

In an embodiment, said azimuth angle is significantly deviating from the direction of the normal of the low emissivity surface 103.

In an embodiment, said threshold for the envelope correlation coefficient is 0.1.

The invention claimed is:

1. A wall or façade structure for improving quality of reception of a wireless communication device inside a building from a base station located outside of the building, said building having the wall or façade structure as a part of a building envelope, wherein said wall or façade structure is configured to boost transmission of electromagnetic signals through the building envelope, said wall or façade structure comprising at least one electrically conductive low emissivity surface, wherein the wall or façade structure comprises a first aperture and a second aperture, wherein said first aperture and said second aperture are isolated from each other for providing narrow aperture diffraction and to obtain diversity reception at a first frequency in shadow areas inside the building, said first aperture and said second aperture comprise a plurality of focused radiation sources separated by isolating the focused radiation sources of separate apertures by binding the adjacent focused radiation sources within the first aperture together by providing an envelope correlation coefficient larger than 0.1 between any of said adjacent focused radiation sources, and a distance between said first aperture and said second aperture is between 1 and 10 meters to provide an envelope correlation coefficient of less than 0.1 for said apertures at the first frequency.

2. The wall or façade structure according to claim 1, wherein said first aperture and said second aperture are in the same electrically conductive low emissivity surface.

3. The wall or façade structure according to claim 1 further comprising a first electrically conductive low emissivity surface and a second electrically conductive low emissivity surface, wherein said first aperture is in the first electrically conductive low emissivity surface and said second aperture is in the second electrically conductive low emissivity surface.

4. The wall or façade structure according to claim 1 further comprising at least one insulation glass unit having the at least one electrically conductive low emissivity surface, wherein said at least one insulation glass unit comprises said first aperture and said second aperture.

5. The wall or façade structure according to claim 1 further comprising at least a first insulation glass unit having at least a first electrically conductive low emissivity surface and a second insulation glass unit having at least a second electrically conductive low emissivity surface, wherein said first aperture is in the first electrically conductive low emissivity surface and said second aperture is in the second electrically conductive low emissivity surface.

6. The wall or façade structure according to claim 1, wherein a circumference of said at least one electrically conductive low emissivity surface forms a closed edge curve, at least one of said first aperture and said second aperture are within said closed edge curve, a circumference of the aperture within said closed edge curve forms a closed curve, and an area of the surface defined by the closed curve is smaller than the area of the surface defined by the closed edge curve.

7. The wall or façade structure according to claim 1, wherein at least one of said first aperture and said second aperture comprises an array of slot radiators.

8. The wall or façade structure according to claim 1, wherein a physical width of each of said first aperture and said second aperture is less than a wavelength at the first frequency.

9. The wall or façade structure according to claim 1, wherein said first aperture and said second aperture are isolated from each other, wherein each of the isolated apertures comprises a plurality of focused radiation sources next to each other in a direction defined by the physical width of the aperture, wherein said first aperture and said second aperture are configured to provide envelope correlation coefficient larger than 0.1 between any of said adjacent focused radiation sources for separating said first aperture and said second aperture by binding the adjacent focused radiation sources within the first aperture together.

10. The wall or façade structure according to claim 9, wherein said first aperture and said second aperture are configured to provide envelope correlation coefficient smaller than 0.1 between any focused radiation sources of the first aperture and the second aperture for separating said first aperture and said second aperture.

11. The wall or façade structure according to claim 1, wherein said focused radiation sources being arranged with at least one opening in a low emissivity surface, and said isolated apertures being separated by isolating the focused radiation sources of the separate apertures by binding the adjacent focused radiation sources within a first aperture together by providing envelope correlation coefficient larger than 0.5 between any of said adjacent focused radiation sources, and separating the first and second aperture by providing envelope correlation coefficient smaller than 0.1 between any focused radiation sources of the first aperture and the second aperture, wherein said at least one opening is configured to generate an electric field so that at least partly interlaced edges of said at least one opening are interlaced in the direction of the electric field effective across said edges to provide said envelope correlation coefficient larger than 0.5.

12. An insulation glass unit for a wall or façade of a building envelope for improving quality of reception of a wireless communication device inside the building from a base station located outside of the building by boosting transmission of electromagnetic signals through the building envelope, the insulation glass unit comprising at least one electrically conductive low emissivity surface having at least a first aperture and a second aperture, wherein said first aperture and said second aperture are isolated from each other for providing narrow aperture diffraction and to obtain diversity reception at a first frequency in shadow areas inside the building, said first aperture and said second aperture comprise a plurality of focused radiation sources separated by isolating the focused radiation sources of separate apertures by binding the adjacent focused radiation sources within the first aperture together by providing an envelope correlation coefficient larger than 0.1 between any of said adjacent focused radiation sources, and a distance between said first aperture and said second aperture is between 1 and 10 meters to provide an envelope correlation coefficient of less than 0.1 for said apertures at the first frequency.

13. The insulation glass unit according to claim 12, wherein said first aperture and said second aperture are arranged with a plurality of focused radiation sources, and said isolated apertures being separated by isolating the focused radiation sources of the separate apertures by binding the adjacent focused radiation sources within the first aperture together by providing envelope correlation coefficient larger than 0.1 between any of said adjacent focused radiation sources, and separating the first and second aperture by providing envelope correlation coefficient smaller than 0.1 between any focused radiation sources of the first aperture and the second aperture.

14. The insulation glass unit according to claim 12, wherein said first aperture and said second aperture are arranged with a plurality of focused radiation sources, wherein said focused radiation sources being arranged with at least one opening in a low emissivity surface, and said isolated apertures being separated by isolating the focused radiation sources of the separate apertures by binding the adjacent focused radiation sources within a first aperture together by providing envelope correlation coefficient larger than 0.5 between any of said adjacent focused radiation sources, and separating the first and second aperture by providing envelope correlation coefficient smaller than 0.1 between any focused radiation sources of the first aperture and the second aperture, wherein said at least one opening is configured to generate an electric field so that at least partly interlaced edges of said at least one opening are interlaced in the direction of the electric field effective across said edges to provide said envelope correlation coefficient larger than 0.5.

15. An insulation glass unit for a wall or façade of a building envelope for improving quality of reception of a wireless communication device inside the building from a base station located outside of the building by boosting transmission of electromagnetic signals through the building envelope, the insulation glass unit comprising at least two glass panes and at least one of the two glass panes comprising at least one electrically conductive low emissivity surface having at least a first aperture and a second aperture, wherein said first aperture and said second aperture are isolated from each other for providing narrow aperture diffraction and to obtain diversity reception at a first frequency in shadow areas inside the building, said first aperture and said second aperture comprise a plurality of focused radiation sources separated by isolating the focused radiation sources of separate apertures by binding the adjacent focused radiation sources within the first aperture together by providing an envelope correlation coefficient larger than 0.1 between any of said adjacent focused radiation sources, and a distance between said first aperture and said second aperture is between 1 and 10 meters to provide an envelope correlation coefficient of less than 0.1 for said apertures at the first frequency.

16. The insulation glass unit according to claim 15, wherein said first aperture and said second aperture are in the same glass pane.

17. The insulation glass unit according to claim 15, wherein said first aperture and said second aperture are in different glass panes.

18. The insulation glass unit according to claim 15, wherein said first aperture and said second aperture are isolated from each other, wherein each of the isolated apertures comprises a plurality of focused radiation sources next to each other in a direction defined by the physical width of the aperture, wherein said first aperture and said second aperture are configured to provide envelope correlation coefficient larger than 0.1 between any of said adjacent focused radiation sources for separating said first aperture and said second aperture by binding the adjacent focused radiation sources within the first aperture together.

19. The insulation glass unit according to claim 18, wherein said first aperture and said second aperture are configured to provide envelope correlation coefficient smaller than 0.1 between any focused radiation sources of the first aperture and the second aperture for separating said first aperture and said second aperture.

20. The insulation glass unit according to claim 15, wherein said first aperture and said second aperture are arranged with a plurality of focused radiation sources, wherein said focused radiation sources being arranged with at least one opening in a low emissivity surface, and said isolated apertures being separated by isolating the focused radiation sources of the separate apertures by binding the adjacent focused radiation sources within a first aperture together by providing envelope correlation coefficient larger than 0.5 between any of said adjacent focused radiation sources, and separating the first and second aperture by providing envelope correlation coefficient smaller than 0.1 between any focused radiation sources of the first aperture and the second aperture, wherein said at least one opening is configured to generate an electric field so that at least partly interlaced edges of said at least one opening are interlaced in the direction of the electric field effective across said edges to provide said envelope correlation coefficient larger than 0.5.

* * * * *